US006390611B1

(12) United States Patent
Kobayashi et al.

(10) Patent No.: US 6,390,611 B1
(45) Date of Patent: May 21, 2002

(54) INK JET RECORDING APPARATUS, SUB-TANK UNIT ADAPTED THERETO, AND INK DROPLET EJECTION CAPABILITY RECOVERY METHOD

(75) Inventors: Atushi Kobayashi; Satoshi Shinada; Takahiro Naka; Takeo Seino; Hisashi Miyazawa; Hitoshi Matsumoto; Yoshiharu Ariga; Hitotoshi Kimura, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/637,900

(22) Filed: Aug. 14, 2000

Related U.S. Application Data

(63) Continuation of application No. PCT/JP99/00614, filed on Feb. 12, 1999.

(30) Foreign Application Priority Data

| | | |
|---|---|---|
| Feb. 13, 1998 | (JP) | 10-046315 |
| Feb. 25, 1998 | (JP) | 10-059078 |
| Jun. 9, 1998 | (JP) | 10-175341 |
| Jul. 15, 1998 | (JP) | 10-200377 |
| Jul. 22, 1998 | (JP) | 10-221137 |
| Jan. 13, 1999 | (JP) | 11-006600 |
| Jan. 21, 1999 | (JP) | 11-013141 |
| Jan. 21, 1999 | (JP) | 11-013142 |
| Jan. 29, 1999 | (JP) | 11-023298 |

(51) Int. Cl.[7] ..... B41J 2/175
(52) U.S. Cl. ..... 347/84; 347/85
(58) Field of Search ..... 347/84, 85, 86, 347/87

(56) References Cited

U.S. PATENT DOCUMENTS

| | | | | |
|---|---|---|---|---|
| 4,694,307 A | | 9/1987 | Toganoh et al. | 347/85 |
| 5,367,328 A | | 11/1994 | Erickson | 347/7 |
| 5,539,437 A | | 7/1996 | Penwell | 347/54 |
| 5,666,146 A | | 9/1997 | Mochizuki et al. | 347/86 |
| 5,777,646 A | | 7/1998 | Barinaga et al. | 347/86 |
| 5,796,419 A | * | 8/1998 | Clark et al. | 347/85 |
| 6,000,788 A | | 12/1999 | Iida | 347/86 |
| 6,022,102 A | * | 2/2000 | Ikkatai et al. | 347/85 |

FOREIGN PATENT DOCUMENTS

| | | | |
|---|---|---|---|
| EP | 0 412 643 A1 | 2/1991 | |
| EP | 0 552 472 A2 | 7/1993 | |
| EP | 0 581 531 A1 | 2/1994 | |
| EP | 0 707 969 A2 | 4/1996 | |
| EP | 0 773 109 A2 | 5/1997 | B41J/2/175 |
| EP | 0 855 731 A2 | 12/1998 | |
| JP | 56-13183 | 2/1981 | B41J/3/10 |
| JP | 57-24282 | 2/1982 | B41J/27/00 |

(List continued on next page.)

*Primary Examiner*—Anh T. N. Vo
(74) *Attorney, Agent, or Firm*—Sughrue Mion, PLLC

(57) ABSTRACT

An inkjet recording apparatus is provided, which comprises a sub-tank unit mounted on a carriage for supplying ink to an ink jet record head and an ink replenishment unit connected to a main tank installed on a housing by a duct and being able to be connected to and disconnected from the sub-tank unit. The sub-tank unit comprises an ink injection port and an exhaust port that are communicated with an ink storage chamber via self-seal type valve means, and a valve mechanism for opening and closing the exhaust port based on a liquid level of ink, wherein ink is supplied to the ink storage chamber by negative pressure from negative pressure generation means for sucking air through the exhaust port. Also provided is an ink droplet ejection capability recovery method for a recording head of an ink jet recording apparatus for determining an amount of ink remaining in the sub-tank unit, replenishing the sub-tank unit with ink from the main tank, and performing a recovery operation.

73 Claims, 56 Drawing Sheets

FOREIGN PATENT DOCUMENTS

| | | | | |
|---|---|---|---|---|
| JP | 60-24954 | | 2/1985 | ..... B41J/3/04 |
| JP | 62-15939 | | 1/1987 | ..... B41J/3/04 |
| JP | 62-225352 | | 10/1987 | ..... B41J/3/04 |
| JP | 362225352 A | * | 10/1987 | ..... 347/86 |
| JP | 63-257644 | | 10/1988 | ..... B41J/3/04 |
| JP | 2-63746 | | 3/1990 | ..... B41J/2/175 |
| JP | 4-43785 | | 7/1992 | ..... B41J/2/175 |
| JP | 4-347653 | | 12/1992 | ..... B41J/2/175 |
| JP | 7-125242 | | 5/1995 | ..... B41J/2/175 |
| JP | 8-11319 | | 1/1996 | ..... B41J/2/175 |
| JP | 8-174860 | | 7/1996 | ..... B41J/2/175 |
| JP | 9-11489 | | 1/1997 | ..... B41J/2/175 |
| JP | 9-20013 | | 1/1997 | ..... B41J/2/175 |
| JP | 9-29991 | | 2/1997 | ..... B41J/2/175 |
| JP | 9-174876 | | 7/1997 | ..... B41J/2/175 |
| JP | 9-187959 | | 7/1997 | ..... B41J/2/175 |
| JP | 10-6521 | | 1/1998 | ..... B41J/2/175 |
| JP | 10-29318 | | 2/1998 | ..... B41J/2/175 |
| JP | 10-128999 | | 5/1998 | ..... B41J/2/175 |
| JP | 10-244685 | | 9/1998 | ..... B41J/2/175 |
| JP | WO99/41083 | | 8/1999 | ..... B41J/2/175 |
| WO | 97/42035 | | 11/1997 | ..... B41J/2/175 |

* cited by examiner

INK JET RECORDING APPARATUS, SUB-TANK UNIT ADAPTED THERETO, AND INK DROPLET EJECTION CAPABILITY RECOVERY METHOD

CROSS-REFERENCE TO RELATED APPLICATIONS

This is a continuation application of International Application No. PCT/JP99/00614 filed on Feb. 12, 1999.

TECHNICAL FIELD

This invention relates to an ink jet recording apparatus in which ink is supplied from an ink container placed on a housing to a record head mounted on a carriage though a tube, and more particularly to an ink supply system, a sub-tank unit adapted thereto, and operation techniques associated therewith.

BACKGROUND OF THE INVENTION

An ink jet recording apparatus used for printing a large number of pages adopts a structure wherein an ink container such as a cassette is placed on a housing and is connected to a sub-tank unit mounted on a carriage through an ink supply tube for supplying ink consumed for print to a record head through the sub-tank unit, for example, as shown in JP-B-4-43785.

Such a structure makes it possible to remarkably prevent change in ink pressure caused by stretching and bending the tube as the carriage moves, thereby maintaining print quality.

On the other hand, to improve the print quality in a color print mode, a recording apparatus using different types of ink to produce light and shade in the same color group involves the following problem: As the ink types increase, the number of ink tubes increases and for the necessity for guiding the tubes so as to be able to follow a movement of a carriage, the structure for routing the tubes becomes complicated and receives restrictions and moreover the elasticity and rigidity of the tubes affect motion of the carriage, making it difficult to execute print at high speed.

To solve such a problem, JP-A-10-244685 proposes a recording apparatus comprising a sub-tank unit mounted on a carriage for supplying ink to an ink jet record head, and an ink replenishment unit connected to an ink cartridge placed on a housing by a duct and detachably connectable to the sub-tank unit.

According to the recording apparatus, the carriage is moved in a disconnection state from the duct of a tube, etc., during printing, and connection to the duct is made only when it becomes necessary to replenish the sub-tank unit with ink. Therefore, it is not necessary to cause the tube forming the duct to follow the carriage movement, routing of the tube can be simplified, and expanding or contracting of the tube is not involved in the carriage movement, so that the carriage can be moved at high speed, making it possible to execute print at high speed.

However, ink supply to the sub-tank unit from the ink cartridge placed on the housing relies on slight negative pressure caused by an expansion force produced by an elastic member preliminarily built in the sub-tank unit, thus if air accumulates in the sub-tank unit as the sub-tank unit is replenished with ink a large number of times, the negative pressure lowers, the replenishment amount lowers, and it takes time in replenishing the sub-tank unit with ink; this is a problem.

To solve such a problem, JP-A-9-29991 proposes a system wherein an ink full sensor and an ink empty sensor are contained in a sub-tank unit, an ink injection port incorporating a projection member for pushing and opening a valve on the side of an ink supply nozzle is provided for injection ink from an ink replenishment tank positioned in an upper part, and replenishment with ink is stopped based on a signal from the ink full sensor.

This system involves a problem of complicated control because stopping of replenishing the sub-tank unit with ink depends on the sensor.

A record head in which a pressure generation chamber is expanded and contracted by displacement of a piezoelectric vibrator involves the following problem: If air is solved in ink, bubbles easily occur in the pressure generation chamber, causing an ink drop jet failure to occur.

DISCLOSURE OF THE INVENTION

An ink jet recording apparatus of the invention comprises a sub-tank unit mounted on a carriage for supplying ink to an ink jet record head and an ink replenishment unit connected to a main tank installed on a housing by a duct and being able to be connected to and disconnected from the sub-tank unit, wherein the sub-tank unit comprises an ink injection port and an exhaust port that are communicated with an ink storage chamber via self-seal type valve means, and a valve mechanism for opening and closing the exhaust port based on a liquid level of ink, wherein ink is supplied to the ink storage chamber by negative pressure from negative pressure generation means for sucking air through the exhaust port.

According to the configuration, normally print is executed using ink in the sub-tank unit, and at the stage at which the ink in the sub-tank unit is decreased, the sub-tank unit is connected to the ink replenishment unit and pressure in the ink storage chamber is reduced for causing ink in the main tank to flow into the ink storage chamber. When the ink arrives at a predetermined level, flow-in of the ink is stopped by a float valve. The duration in the reduced pressure state can be prolonged to subject ink filled in the sub-tank unit to a degassing process.

It is therefore an object of the invention to provide an ink jet recording apparatus that can replenish a sub-tank unit with a predetermined amount of ink reliably in a short time regardless of the number of filling times with ink, and that can degas ink in the sub-tank unit as required.

It is another object of the invention to provide a sub-tank unit used with the ink jet recording apparatus.

It is another object of the invention to propose a method of recovering an ink droplet ejection capability of a record head of the ink jet recording apparatus.

The present disclosure relates to the subject matter contained in Japanese patent application Nos.:

Hei. 10-46315 (filed on Feb. 13, 1998);

Hei. 10-59078 (filed on Feb. 25, 1998);

Hei. 10-175341 (filed on Jun. 9, 1998);

Hei. 10-200377 (filed on Jul. 15, 1998);

Hei. 10-221137 (filed on Jul. 22, 1998);

Hei. 11-6600 (filed on Jan. 13, 1999);

Hei. 11-131141 (filed on Jan. 21, 1999);

Hei. 11-131142 (filed on Jan. 21, 1999); and

Hei. 11-13298 (filed on Jan. 29, 1999);

which are expressly incorporated herein by reference in their entireties.

BRIEF DESCRIPTION OF THE DRAWINGS

FIG. 57 is a perspective view of the pressure detection unit and FIGS. 58(A) and (B) are a top view thereof and a sectional view taken on line D—D in the arrow direction in FIG. 58(A) respectively.

BEST MODE FOR CARRYING OUT THE INVENTION

Referring now to the accompanying drawings, the invention will be discussed in detail based on embodiments.

Figure 1:
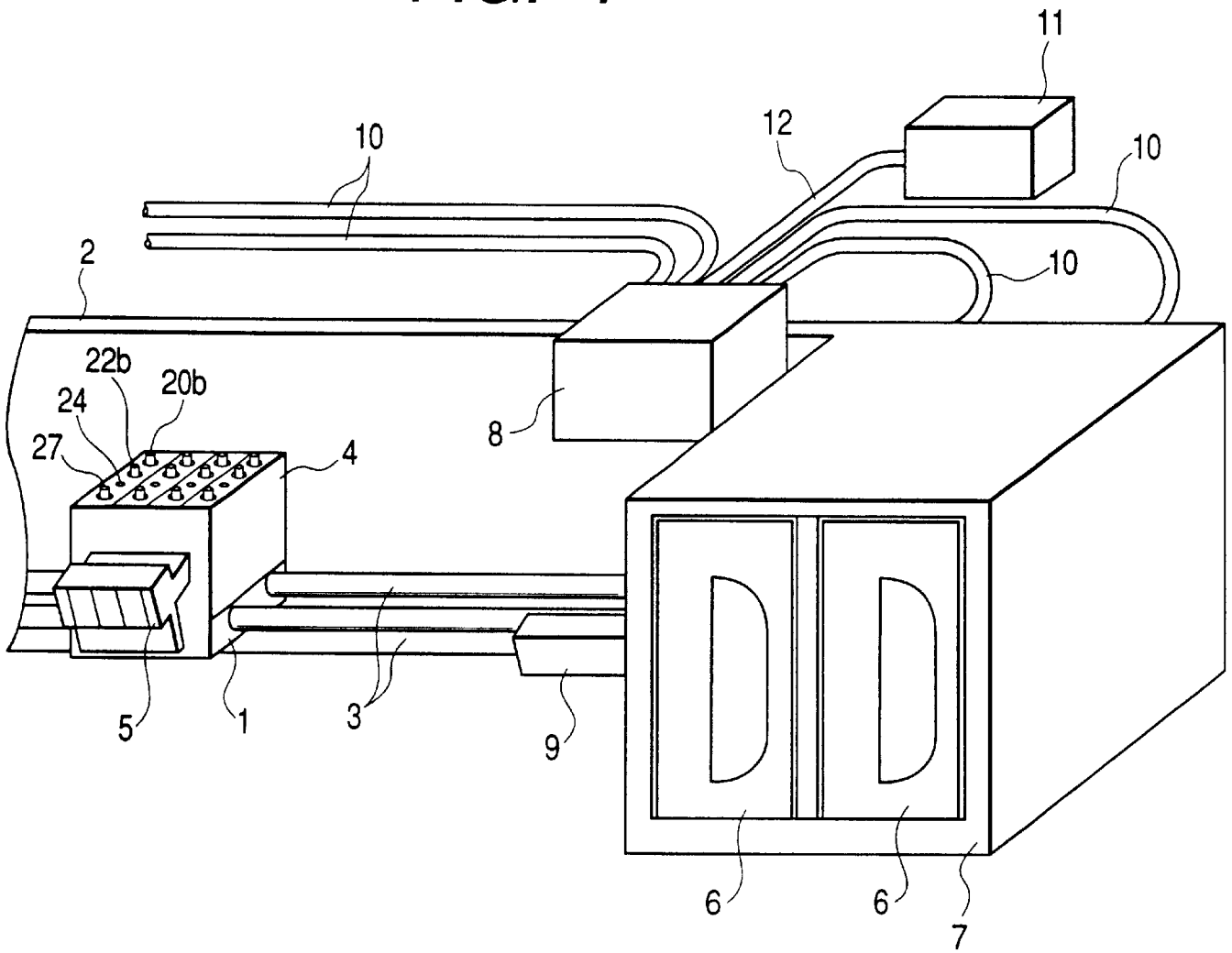
FIG. 1 is a drawing to show an ink supply mechanism of an ink jet recording apparatus of the invention.

FIG. 1 shows one embodiment of the invention. A carriage 1 is guided by guide members 3 fixed to a frame 2, and driven to reciprocate by drive means (not shown). A sub-tank unit 4 described later is mounted on the top of the carriage 1, and a record head 5 is mounted on the front of the carriage 1. A cartridge holder 7 for storing ink cartridges 6 is disposed on one side of the frame 2, an ink replenishment unit 8 described later is disposed in an upper part of a non-print area within the movable range of the carriage 1, and a capping mechanism 9 for sealing the record head 5 is disposed on a front side thereof. The ink replenishment unit 8 is connected to the cartridges 6 by tubes 10 and is also connected to a suction pump 11 by a tube 12.

Figure 2:
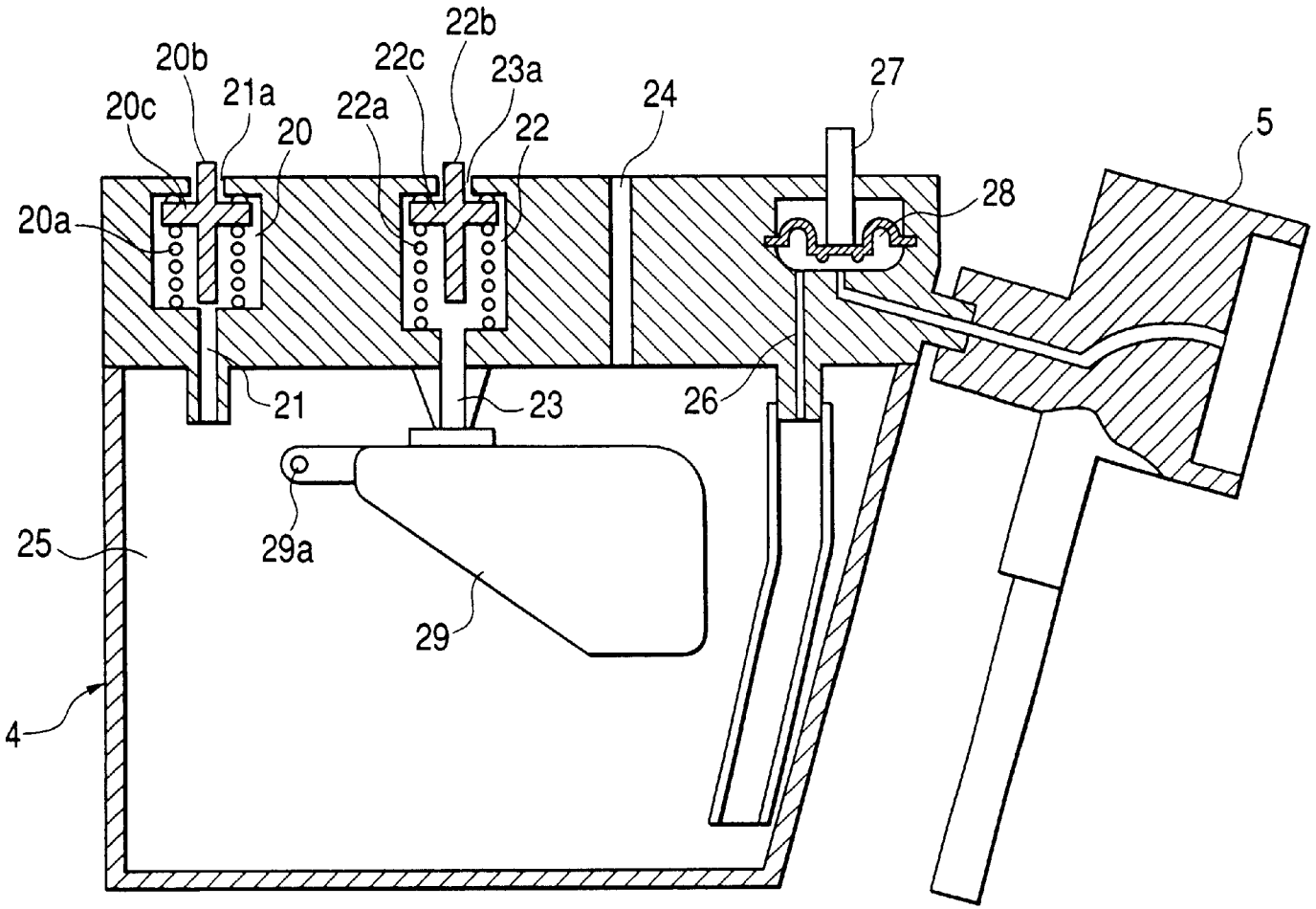
FIG. 2 is a sectional view to show one embodiment of a sub-tank unit with respect to one ink storage chamber.

FIG. 2 shows one embodiment of the above-described sub-tank unit 8 with respect to one ink storage chamber 25. Disposed in the top of the sub-tank unit 4 are an ink injection port 21 having a self-seal type valve 20, an exhaust port 23 having a self-seal type valve 22, an atmospheric communication port 24, and a valve chamber 28 that is opened and closed by an operation rod 27 and that is located in an intermediate portion of a flow passage 26 connecting the record head 5 to the ink storage chamber 25.

The self-seal type valves 20 and 22 are made up of springs 20*a* and 22*a*, and valve bodies 20*c* and 22*c* that are pressed by the springs 20*a* and 22*a* against openings 21*a* and 23*a* of the ink injection port 21 and the exhaust port 23 and that have operation rods 20*b* and 22*b* the upper ends of which are at the sealing time. A float valve 29 is pivoted at one end on a shaft 29*a*, and seals the exhaust port 23 when ink rises to a predetermined liquid level. The float valve 29 is housed in the ink storage chamber 25.

Figure 3:
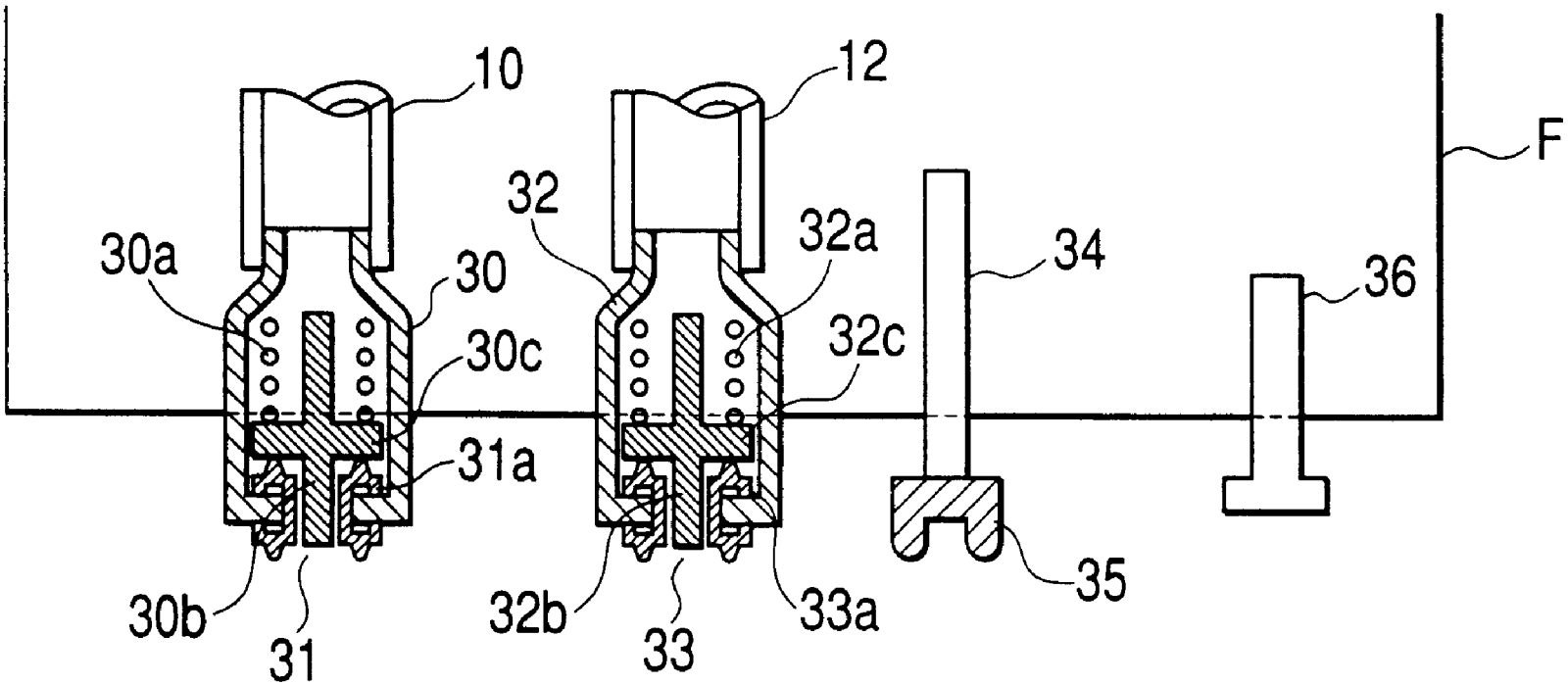
FIG. 3 is a sectional view to show one embodiment of an ink replenishment unit with respect to one ink storage chamber.

FIG. 3 shows one embodiment of the ink replenishment unit 8 related to one ink storage chamber. The ink replenishment unit 8 includes an ink replenishment port 31 having a self-seal type valve 30, a suction port 33 having a self-seal type valve 32, a seal valve 35 provided on the tip of an operation rod 34, and a valve drive rod 36. These are provided in a frame F moved up and down by a drive mechanism (not shown) so as to face the ink injection port 21, the exhaust port 23, the atmospheric communication port 24, and the operation rod 27 of the sub-tank unit 4, respectively. The ink replenishment port 31 is connected to the cartridge holder 7 by the tube 10 and the suction port 33 is connected to the suction pump 11 by the tube 12.

The self-seal type valves 30 and 32 are made up of springs 30*a* and 32*a*, and valve bodies 30*c* and 32*c* that are pressed by the springs 30*a* and 32*a* against valve seats 31*a* and 33*a* of the ink replenishment port 31 and the suction port 33 and that have operation rods 30*b* and 32*b* to be pushed in by the operation rods 20*b* and 22*b* of the sub-tank unit.

In the embodiment, to replenish the sub-tank unit 4 with ink, the carriage 1 is moved to the non-print area and the sub-tank unit 4 is made to face the ink replenishment unit 8, then the ink replenishment unit 8 is moved down.

Figure 4A:
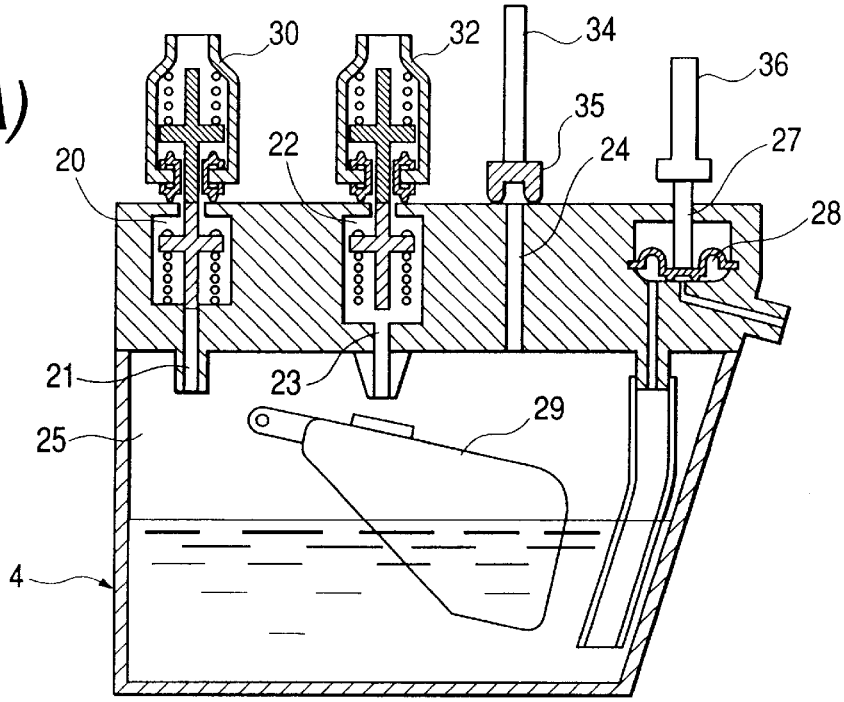
FIGS. 4(A) and (B) are drawings to show the ion of filling the sub-tank unit with ink.

Thus, as shown in FIG. 4(A), the operation rods 30*b* and 32*b* of the self-seal type valves 30 and 32 of the ink replenishment unit 8 rise while pushing down the operation rods 20*b* and 22*b* of the self-seal type valves 20 and 22 of the sub-tank unit 4, the ink replenishment port 31 and the ink injection port 21 communicate with each other, the suction port 33 and the exhaust port 23 communicate with each other, the seal valve 35 seals the atmospheric communication port 24, and the valve drive rod 36 pushes down the operation rod 27 to close the valve chamber 28.

In this state, if the suction pump 11 is operated, pressure in the ink storage chamber 25 is reliably reduced without incurring flow-in of air from the atmospheric communication port 24 and back flow of ink from the record head 5. Accordingly, ink in the ink cartridge 6 flows into the ink storage chamber 25 and is degassed.

Figure 4B:
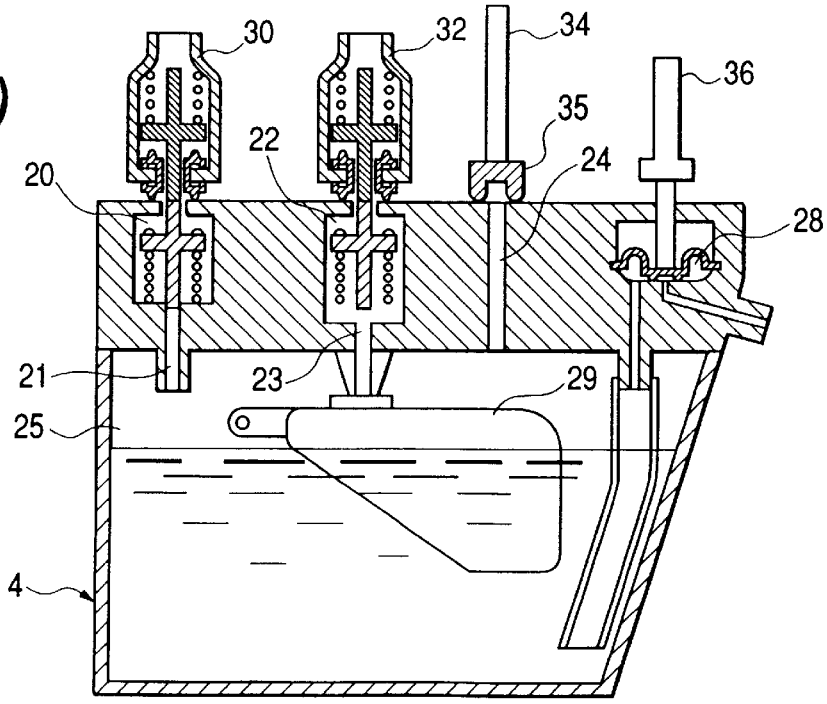

When ink in the ink storage chamber 25 reaches a predetermined liquid amount, the float valve 29 rises and seals the exhaust port 23 (FIG. 4(B)). Flow-in of ink automatically stops at the stage where a small amount of ink further flows in to balance pressure in the ink storage chamber 25 with pressure in the ink cartridge 6.

In other ink storage chambers 25, similar operation is performed and all the ink storage chambers 25 are automatically filled with ink to a predetermined level. If the ink replenishment unit 8 is moved upward at such a timing that filling the ink storage chambers 25 with ink is complete, as shown in FIG. 2, the self-seal type valves 20 and 22 of the sub-tank unit 4 and the self-seal type valves 30 and 32 of the ink replenishment unit 8 are automatically closed by the urge force of the springs 20*a*, 22*a*, 30*a*, and 32*a*, and the atmospheric communication port 24 and the valve chamber 28 are opened as the operation rod 34 and the drive rod 36 retreat.

After replenishment with ink, and if necessary, the record head 5 is sealed by the cap unit 9 so that ink is forcibly discharged from the record head 5 by negative pressure generation means such as the suction pump 11 to recover destruction of the meniscus of the record head 5 caused by replenishment with ink, and thereafter the print operation is started.

In the print process, the carriage 1 and the ink supply tubes 10 are separated from each other, thus the carriage 1 can move freely regardless of the number of the ink supply tubes 10, making it possible to execute print at high speed. Since ink in the ink storage chamber 25 is sufficiently degassed by negative pressure at the ink replenishing time, occurrence of bubbles during printing can be suppressed and stable print can be continued even with such an ink droplet ejection type record head that pressurizes the pressure generation chamber by a piezoelectric element, etc.

When print advances and the ink amount of the sub-tank unit 4 decreases, the above-described process is executed and the sub-tank unit 4 is replenished with ink. The ink amount of the ink storage chamber 25 can be determined by adding up and calculating the amounts of ink consumed by print and suction or providing the ink storage chamber with optical liquid level detection means or float-type liquid level detection means.

In the above-described embodiment, comparatively strong negative pressure is made to act on the ink storage chamber 25 for injection of ink rapidly, thus the valve chamber 28 is closed during the replenishment period. However, negative pressure may act on the ink storage chamber 25 to such an extent that the meniscus of the record head 5 can be maintained during injection of ink. In this case, the ink storage chamber 25 can be filled with ink with the ink storage chamber 25 maintained in a negative pressure state by means of the meniscus even if the flow passage 26 with the record head 5 is opened.

Figure 5:
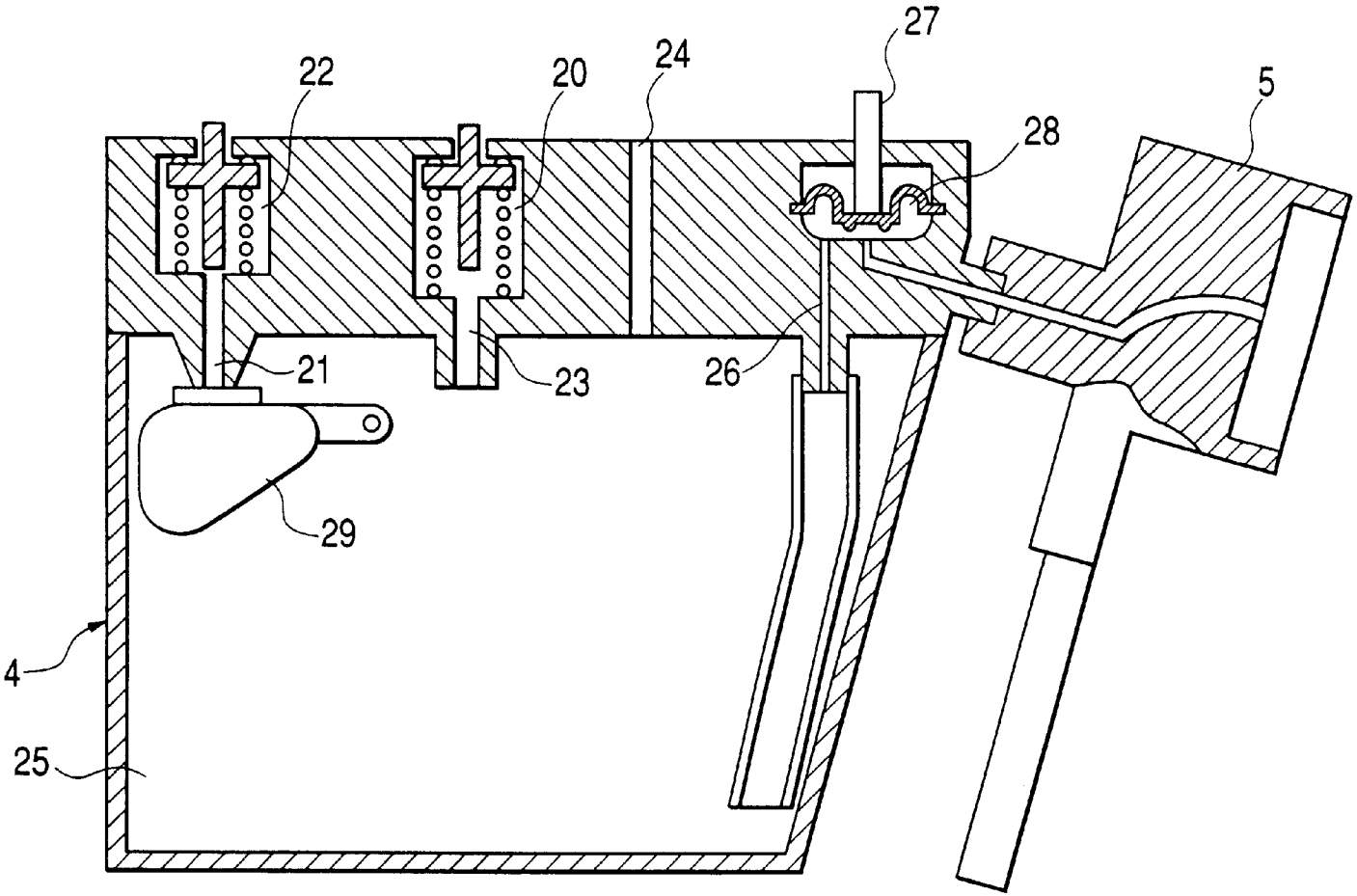
FIG. 5 is a sectional view to show another embodiment of sub-tank unit with respect to one ink storage chamber.

Further, in the above-described embodiment, when a predetermined amount of ink is injected, the exhaust port 33 is closed. However, as shown in FIG. 5, if the float valve 29 may be placed on the ink injection port 21 side to seal the ink injection port 21 at the stage where the predetermined level is reached. In this case, after filling with ink, exhaust from the exhaust port 23 can be continued to sufficiently degas ink.

Figure 6:
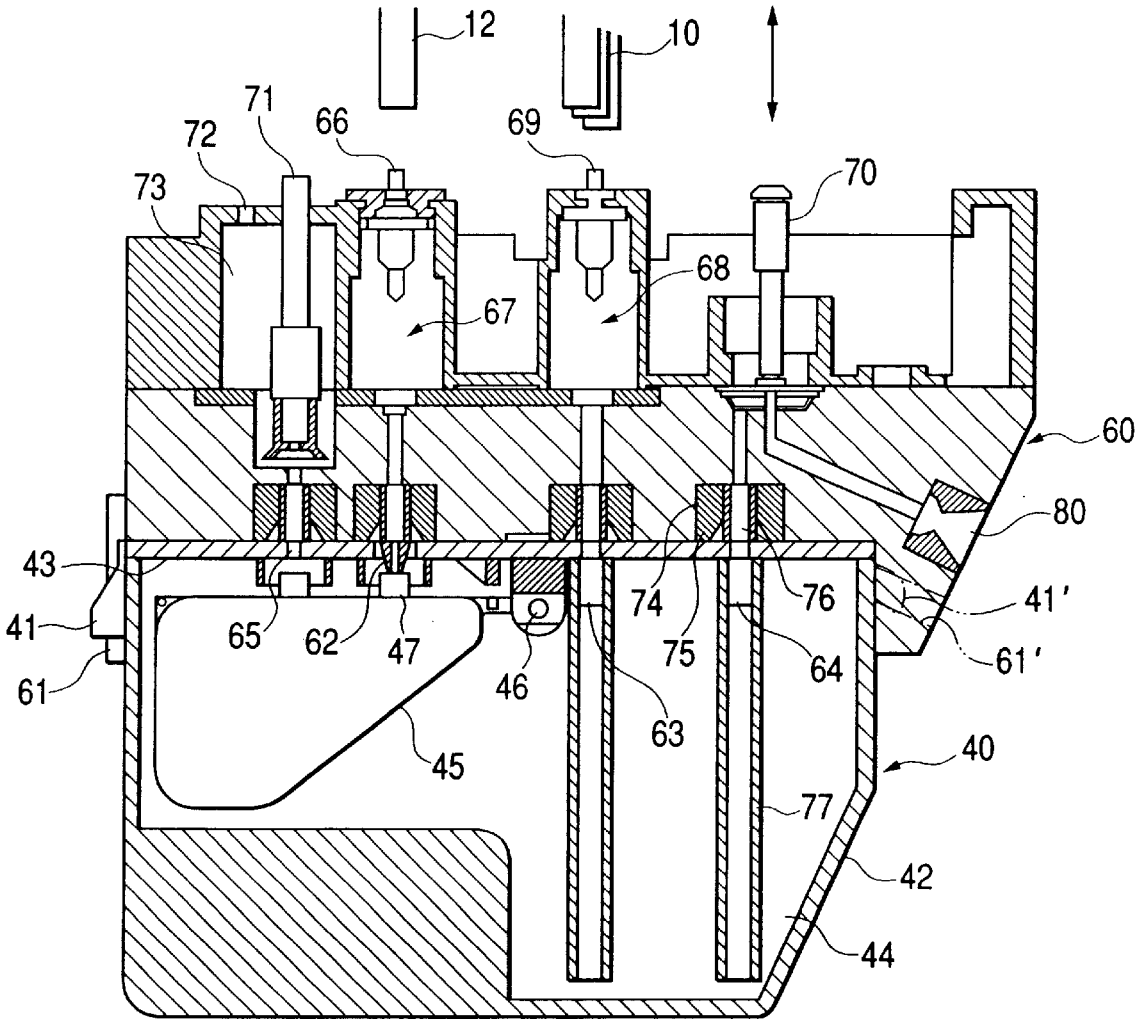
FIG. 6 is a sectional view to show another embodiment of sub-tank unit with respect to one ink storage chamber.

FIG. 6 shows a second embodiment of sub-tank unit 4. An ink storage chamber formation member 40 and a valve unit 60 are provided as separate bodies, and the valve unit 60 is coupled to the top of the ink storage chamber formation member 40 integrally by fitting a projection 41,41' on one side wall of the ink storage chamber formation member 40, into an engagement hole 61, 61' formed in the valve unit 60.

The ink storage chamber formation member 40 is made up of a case 42 opened on the top and a lid 43 for covering the top, whereby an ink storage chamber 44 that can be hermetically sealed is provided. In the ink storage chamber 44, a float member 45 floating up by ink in the ink storage chamber 44 rotates on a support shaft 46 in response to the ink amount.

A seal member 47 is placed on the top of the float member 45, and abuts a valve member 62 to close a suction passage communicating with a pressure reducing pump at the stage where filled ink reaches a predetermined amount.

An ink injection port 63 for receiving ink supplied from a main tank, an ink supply port 62 for supplying ink to the record head via the valve unit 60, and an atmospheric communication port 65 are placed on the top of the ink storage chamber formation member 40.

On the other hand, the valve unit 60 has a valve member 66 common to suction spaces 67, which is connected to the pressure reducing pump side and which is opened at the stage where it is connected to a replenishment unit placed on an ink supply stage. If a plurality of ink storage chambers are formed, the suction spaces 67 are formed one for each ink storage chamber 44 in a direction perpendicular to the paper plane in the figure and are made to communicate with each other so that negative pressure can be supplied from a common pressure reducing pump.

In the valve unit 60, each injection space 68 for feeding ink into the ink injection port 63 is formed separately for a respective ink storage chamber, and is provided with a valve unit 69 opened at the stage where it is connected to replenishment unit placed on ink supply stage, and the valve unit 60 is adapted for connection to replenishment unit (described later) placed on ink supply stage.

In the valve unit 60, ink supply valves 70 opened and closed each in an intermediate portion of an ink supply passage from the ink supply port 64 to the record head are placed separately in a one-to-one correspondence with the ink storage chambers. The atmospheric communication port 65 in the valve unit 60 can be opened and closed by an air introduction valve 71, which is housed in an air introduction space 73 having an atmospheric communication hole 72 made in the upper end. If a plurality of ink storage chambers are formed, the atmosphere introduction valves 73 are formed one for each ink storage chamber in a direction perpendicular to the paper plane in the figure.

The ink storage chamber formation member 40 and the valve unit 60 are connected such that, as can be seen, for example, in the ink supply port 64, a pipe 77 is extended to a tubular connection part 76 pressure-inserted into an annular flexible seal member 75 disposed in a recess part 74 formed in the valve unit 60 side. Similar structure is also adopted for the ink injection port 63, as seen in FIG. 6. In the figure, numeral 80 denotes a connection port for the record head 5.

Figure 7:
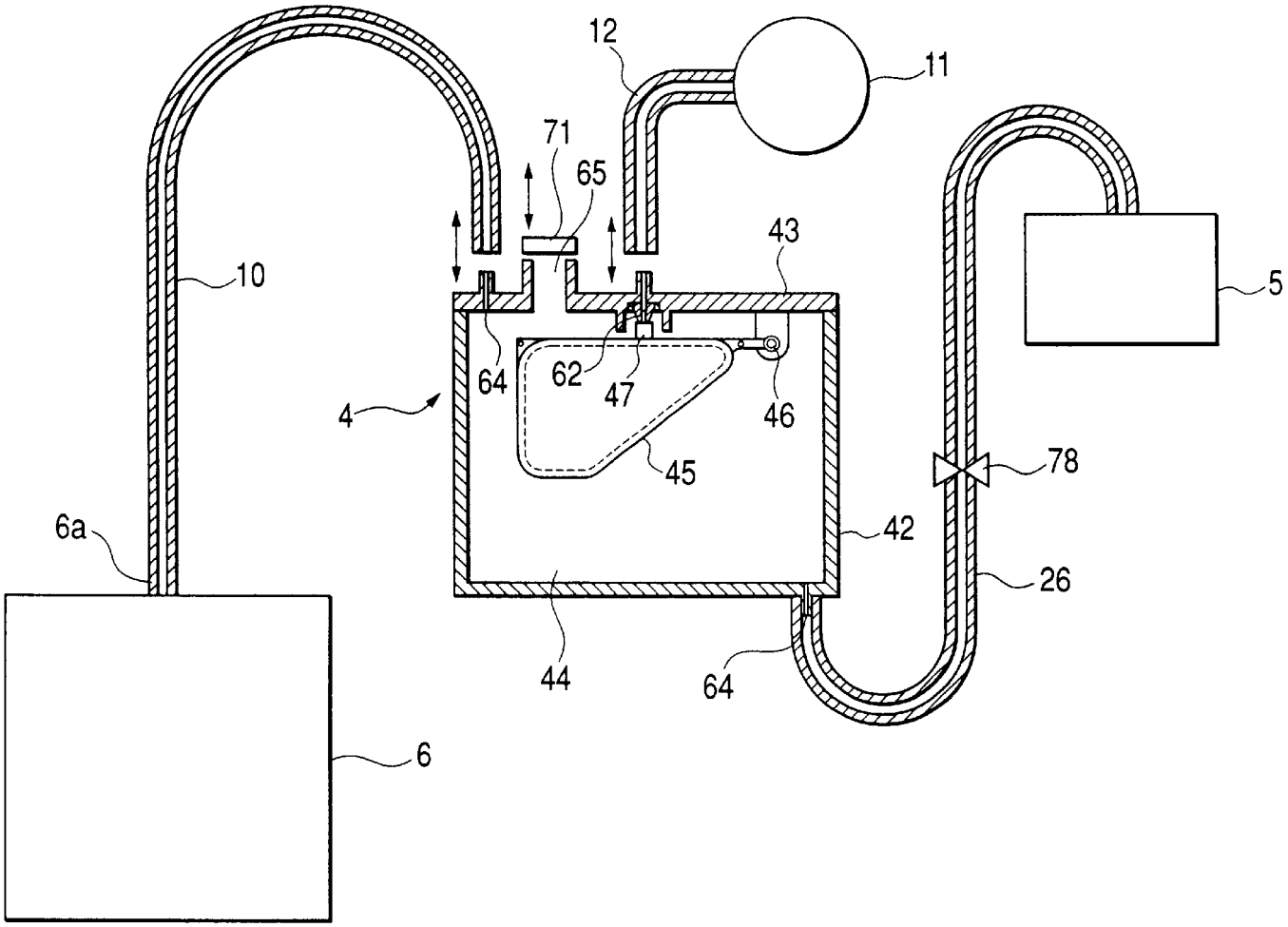
FIG. 7 is a drawing to schematically show an ink supply system for supplying ink from a main tank via the sub-tank unit to a record head.

FIG. 7 schematically shows one ink supply system for supplying ink from the ink cartridge 6 as the main tank via the sub-tank unit 4 to the record unit 5 without showing the valve unit 60 on the sub-tank unit side and the replenishment unit on the ink supply stage.

The ink cartridge 6 forming the main tank is mounted to the cartridge holder 7 disposed, for example, on either of outer sides of the recording apparatus as described above. The ink cartridge 6 is connected to the ink replenishment unit 8 by the tube 10 forming the ink supply passage so as to supply ink via the ink replenishment unit 8 to the sub-tank unit 4 mounted on the carriage 1.

On the other hand, the sub-tank unit 4 is connected to the record head 5 by the ink supply duct 26, and a valve 78 made up of a valve chamber and an operation rod is disposed at an intermediate portion of the ink supply duct 26. Locating an ink flow exit 6*a* of the ink cartridge 6 forming the main tank below the ink injection port 64 of the sub-tank unit 4 can prevent natural flow-in of ink by a siphon phenomenon is and thus ink leakage caused by an unforeseen accident. If the value 78 is closed at least when power is shut off, increasing the viscosity of ink in the ink cartridge 6 can be prevented.

Figure 8:
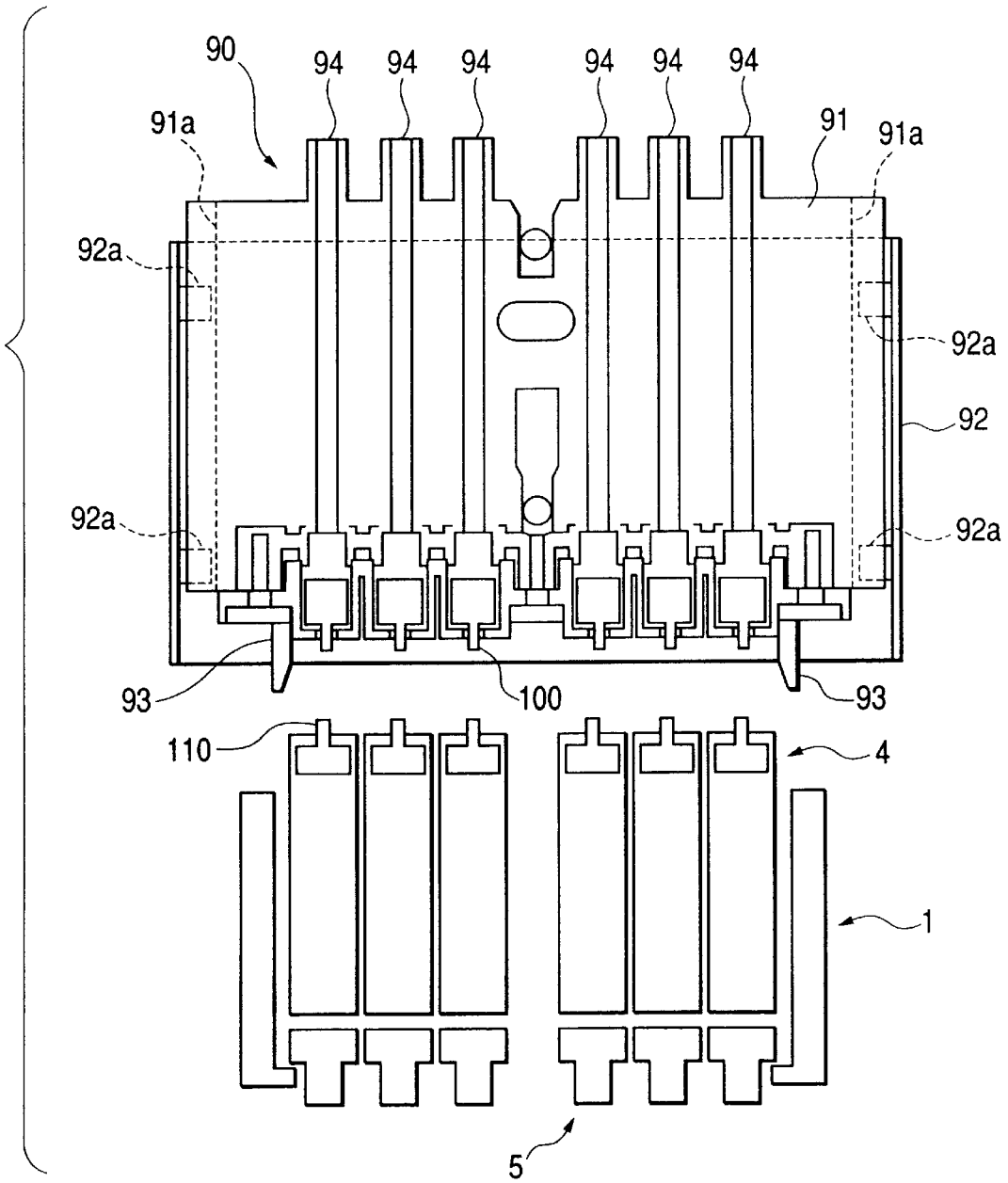
FIG. 8 is a drawing to show one embodiment of a connection mechanism.

FIG. 8 shows one embodiment of a connection mechanism. The embodiment will be discussed by taking as an example such a connection mechanism for supplying ink to a recording apparatus that six ink storage chambers are formed independently to construct a sub-tank unit which is mounted on a single carriage.

A replenishment unit 90 is adapted to be moved vertically by an up and down drive mechanism (described later) in the range in which it can be attached to and detached from the sub-tank unit, with a replenishment member 91 formed with vertically guiding elongated grooves 91*a* at left and right end parts thereof and a guide case 92 having four guide projections 92*a*. A plurality of guide ribs 93 for engagement with guide members of the sub-tank unit are formed at the bottom of the replenishment unit 90.

The replenishment unit 90 is formed at the top with tube connection ports 94 for connection by the tubes 10 to the ink cartridges 6 in which inks of six colors are respectively stored. Valve members 100 (described later) are formed in the bottom of the replenishment unit 90 to correspond to the arrangement pitch in the sub-tank unit 4.

Figure 9:
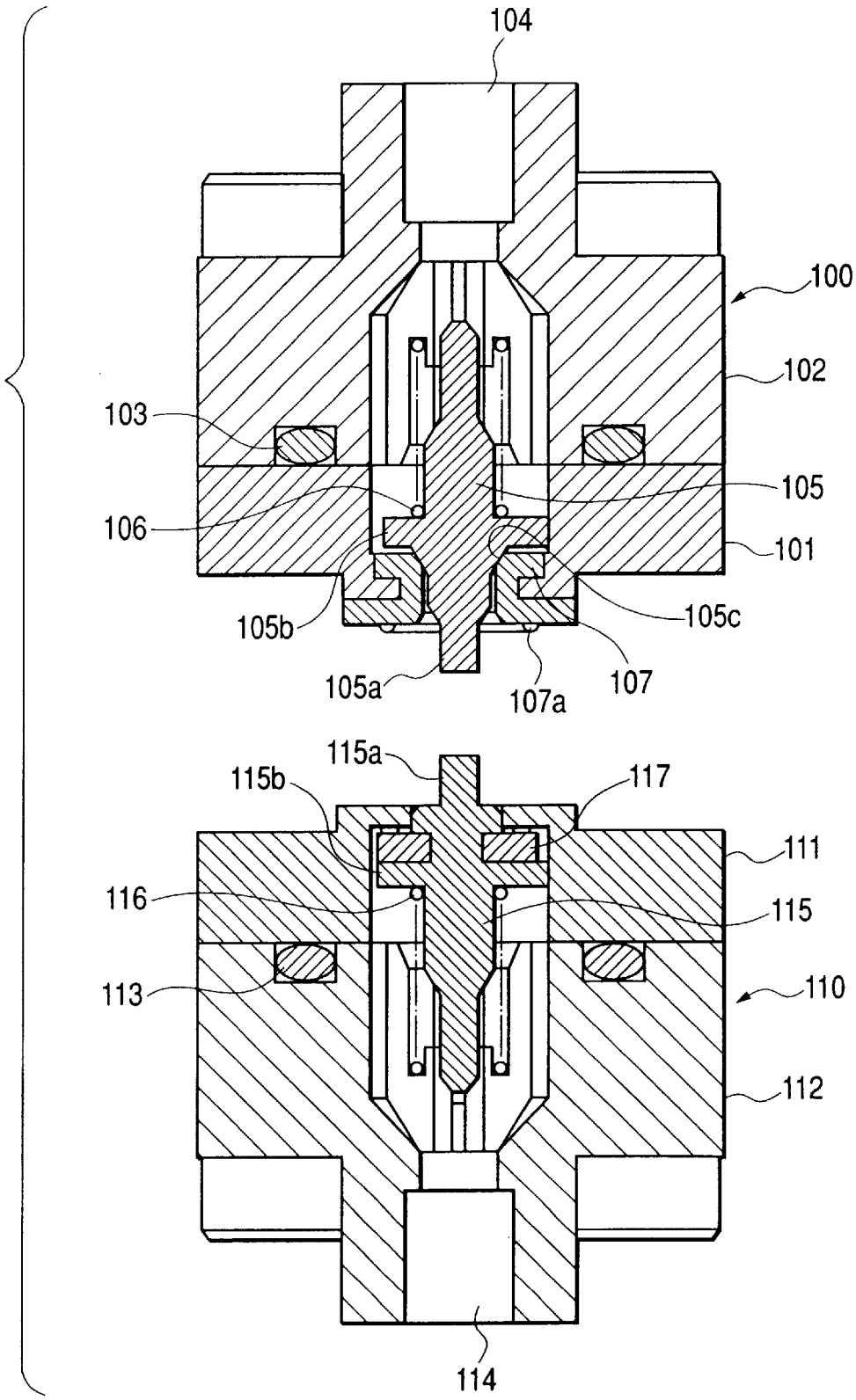
FIGS. 9 and 10 are sectional views to show one embodiment of valve unit used with the connection mechanism in FIG. 8 in a disconnection state and a connection state.
Figure 10:
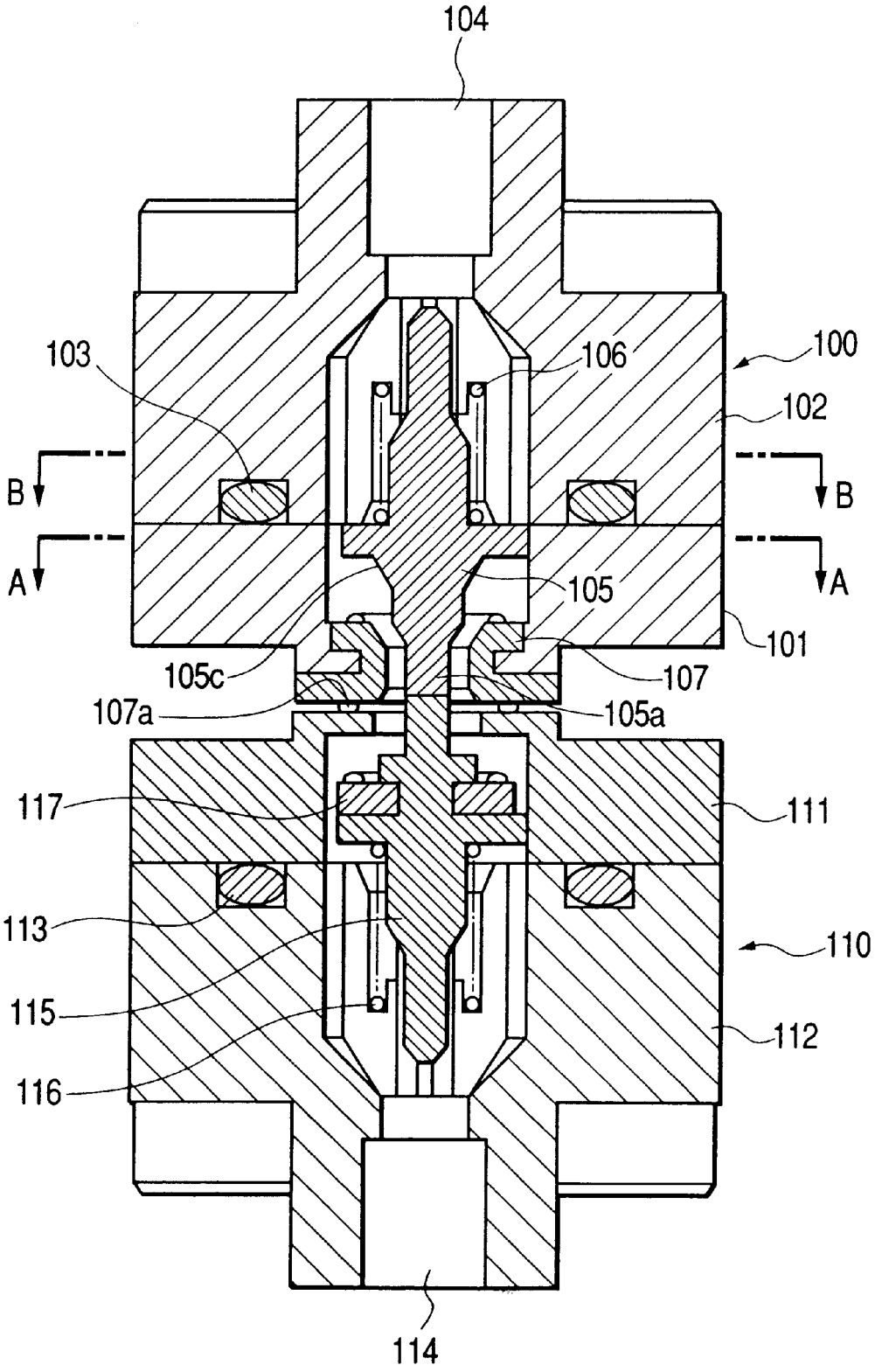

FIGS. 9 to 11 show one embodiment of the valve member 100 of the replenishment unit 90 and one embodiment of a valve member 110 of the valve unit 60 of the sub-tank unit 4.

First, the outer shell of the valve member 100 of the replenishment unit is formed by axially joining first and second cylindrical cases 101 and 102, and an O ring 103 is placed therebetween in an elastically press state to join the first and second cylindrical cases 101 and 102 in a hermetic state. An opening 104 made at the top in the figure communicates with the ink cartridge via the tube connection port 94 of the replenishment unit 90.

A push rod 105 formed with a convex part 105*a* on the connection end face side is placed slidably in the axial direction in the axis center part of the cylindrical case 101, 102, and is always urged so that the convex part 105 of the push rod 105 projects to the connection end face side (downward in the figure) by means of a coil spring 106 placed between a flange part 105*b* formed on the push rod 105 and the second case 102.

The push rod 105 is formed on the outer periphery with a taper part 105*c* spread upward, and in the projection state of the push rod 105 the taper part 105*c* is brought into elastic contact with a seal member 107 for providing sufficient hermeticity.

A part of the seal member 107 is extended to the end face side integrally, and the end faces of the valve members are sealed by means of an extension part 107*a* on the end face side in a state in which the valve members are connected to each other shown in FIG. 10.

On the other hand, the outer shell of the valve member 110 of the sub-tank unit is formed by axially joining first and second cylindrical cases 111 and 112, and an O ring 113 is placed therebetween in an elastically pressed state to join the first and second cylindrical cases 111 and 112 in a hermetic state. An opening 114 made at the bottom in the figure can communicate with the sub-tank unit side.

A push rod 115 formed with a convex part 115*a* on the connection end face side is placed slidably in the axial direction in the axis center part of the cylindrical case 111, 112, and is always urged so that the convex part 115*a* of the push rod 115 projects to the connection end face side (upward in the figure) by means of a coil spring 116 placed between a flange part 115*b* formed on the push rod 115 and the second case 112.

An annular seal member 117 is attached to the flange part 115*b* formed on the push rod 115 and is brought into elastic contact with an inner wall of the cylindrical case 111 by the urge force of the coil spring 116 to provide hermeticity.

The springs 106 and 116 contained in the valve members 100 and 110 almost balance with each other in elastic pressure so that the push rods 105 and 115 can retreat evenly for reliably opening the two valve units when they are placed in a joint state as shown in FIG. 10.

Figure 11A:
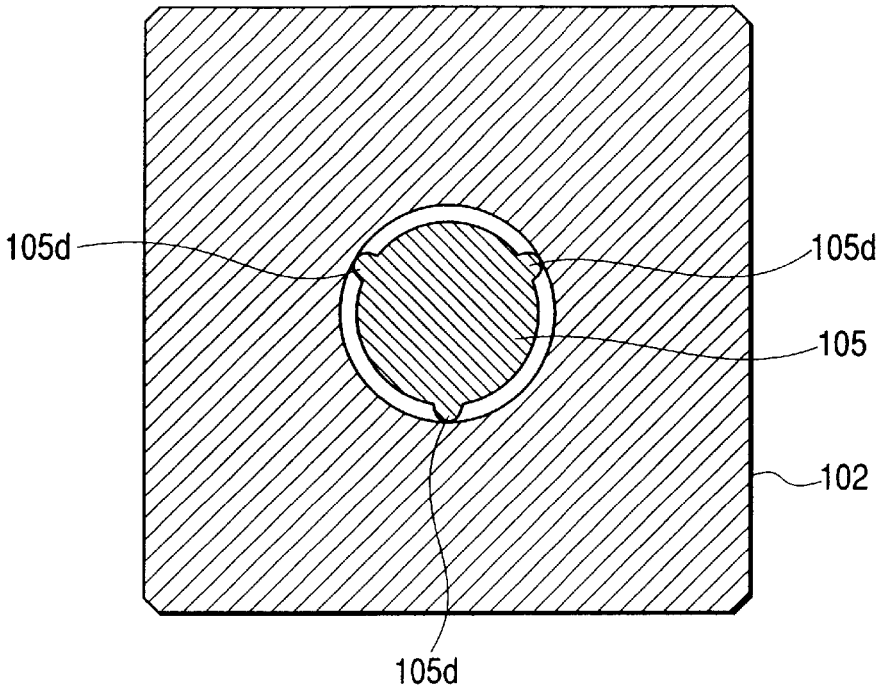
FIGS. 11(A) and (B) are drawings to show sectional structures taken on lines A—A and B—B in the arrow directions in FIG. 10.
Figure 11B:
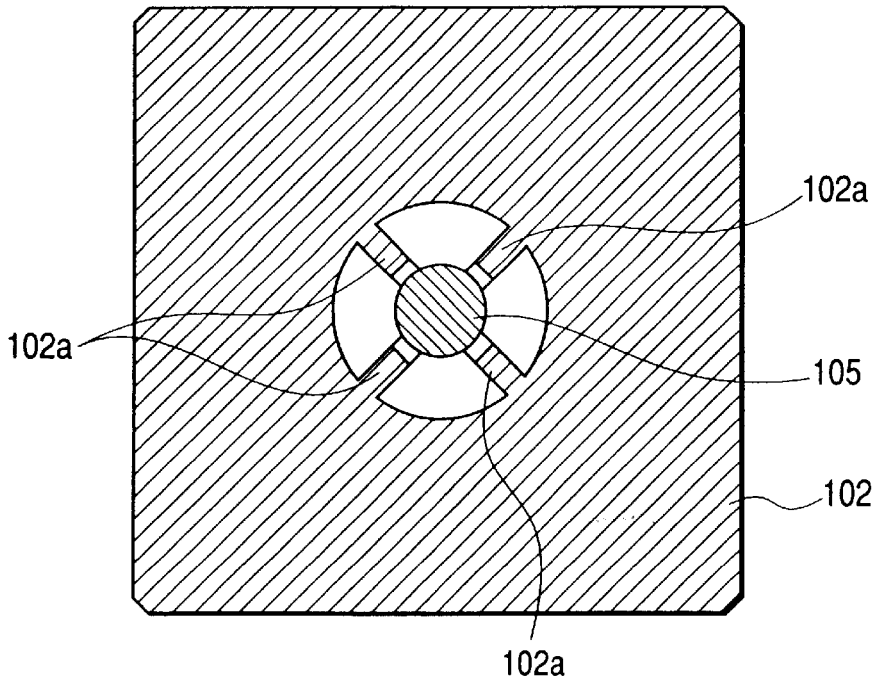

The valve member 100 can be formed with three projections 105*d* in the circumferential direction of the flange part 105*b* between the flange part 105*b* of the push rod 105 and the case 102 as shown in FIG. 11(A) on the cross section taken on line A—A in FIG. 10 to providing a sufficient ink flow passage while preventing axial rocking. As shown in FIG. 11(B), three or more (in the embodiment, four) fins 102*a* are projected radially toward the axis center of the case 102 on the upper side above the flange part 105*b* of the push rod 105 (cross section taken on line B—B in FIG. 10) to reliably support the push rod 105 movably in the axial direction while providing an ink flow passage. Preferably, such a support structure is also applied to the valve member 110.

In the embodiment, when the ink amount in the ink storage chamber 44 decreases so that an ink near end state is established, the float member 45 moves downwardly. In this state, the carriage is moved to the ink supply stage and the valve unit 60 of the sub-tank unit is made to face the replenishment unit 90 placed on the ink supply stage as shown in FIG. 8, then the replenishment unit 90 is moved downwardly.

Thus, the ink supply valve 70 and the air introduction valve 71 are closed as described above and the valve members 100 and 110 shown in FIG. 9 forming the valve member 69 are opened.

That is, the push rods 105 and 116 move relatively evenly to establish a state in which ink can flow.

On the other hand, the seal member 47 of the float member 45 is away from the valve member 62, thus negative pressure from the pressure reducing pump 11 acts on the ink storage chamber 44 and ink from the ink cartridge 6 flows into the sub-tank unit 4.

When the ink storage chamber 44 is thus replenished with ink almost fully, the float member 45 moves upwardly so that the seal member 47 seals the valve member 62. Since negative pressure of the pressure reducing pump 11 acts directly on the seal member 47, the seal member 47 comes in intimate contact with the valve member 62 to reliably seal the same, pressure reduction in the ink storage chamber 44 stops, and flow-in of ink stops automatically when the pressure therein is balanced with the atmospheric pressure.

Other ink storage chambers are automatically replenished with different types of ink until they become full by performing similar operation.

When all ink storage chambers are replenished with ink until they become full, the replenishment unit moves upwardly and both are disconnected, whereby the push rods 105 and 115 forming the valve members 100 and 110 are restored to the former state by the urge force of the coil springs 106 and 116 to close the ink supply passage.

The ink supply valve 70 and the air introduction valve 71, which are free from the depression by the replenishment unit 90, are opened to provide the ink supply passage from the ink storage chamber 44 to the record head 5 and communicate the ink storage chamber 44 with the atmosphere, enabling print with the record head.

Whenever an ink near end state is detected in one ink storage chamber, the above-described process is repeated for filling all ink storage chambers fully with ink.

Figure 12:
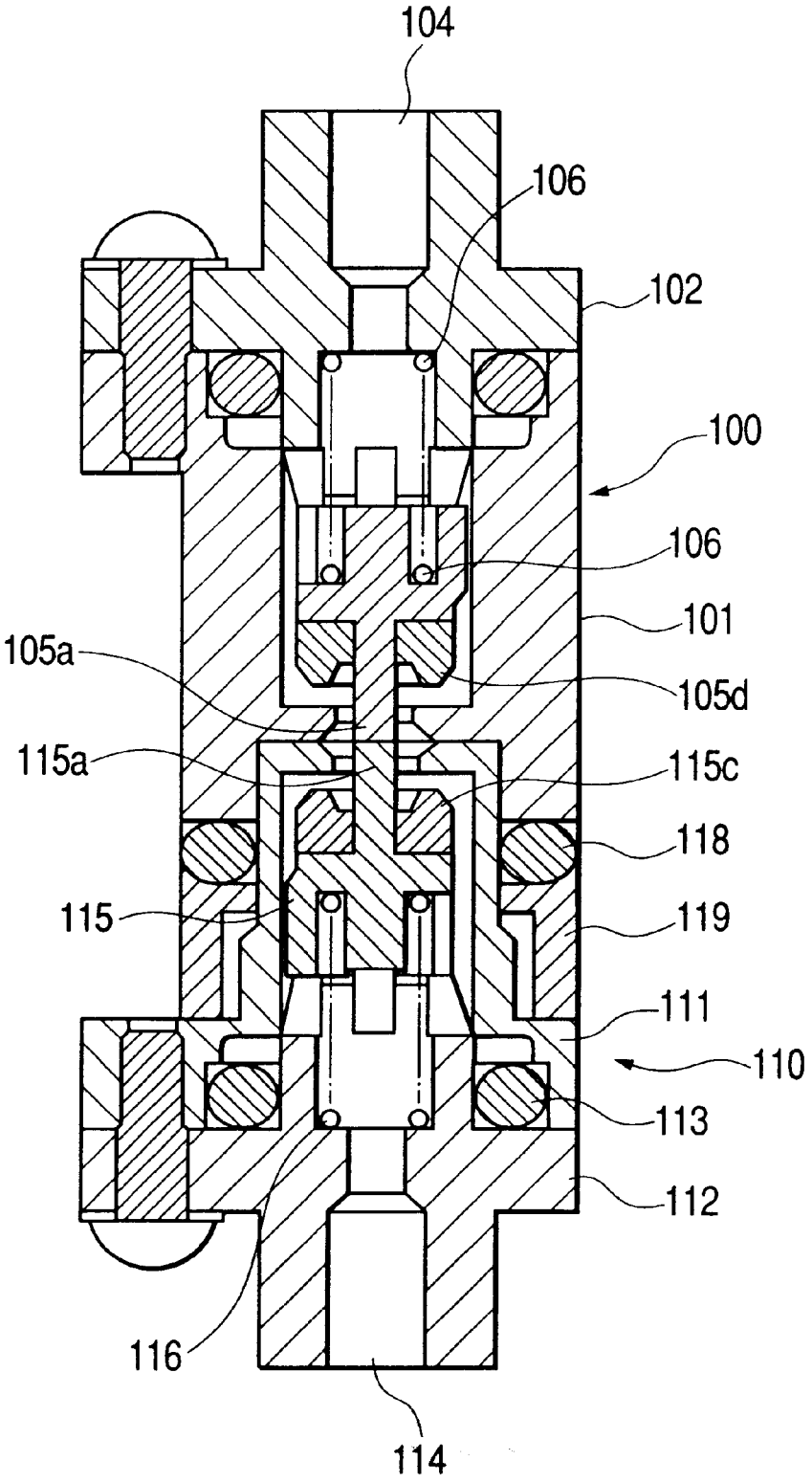
FIG. 12 is sectional a view to show another embodiment of valve unit used with the connection mechanism in FIG. 8 in a connection state, and FIG. 13 a sectional view to show another embodiment of valve unit used with the connection mechanism in FIG. 8 in a disconnection state.

FIG. 12 shows another embodiment of valve unit. The members previously described with reference to FIGS. 9 and 10 are denoted by the same reference numerals in FIG. 12 and only the featured points will be discussed.

A ring retention member 119 for retaining an O ring 118 so as to expose the upper face of the O ring is placed on the outside of a cylindrical case 111. With valve members 100 and 110 joined, the upper face of the O ring 118 is brought into elastic contact with a cylindrical case 101 of the opposed valve member 100 to provide hermeticity, and push rods 105 and 115 projecting from the valve members 100 and 110 are caused to retreat to open an ink flow passage.

Figure 13:
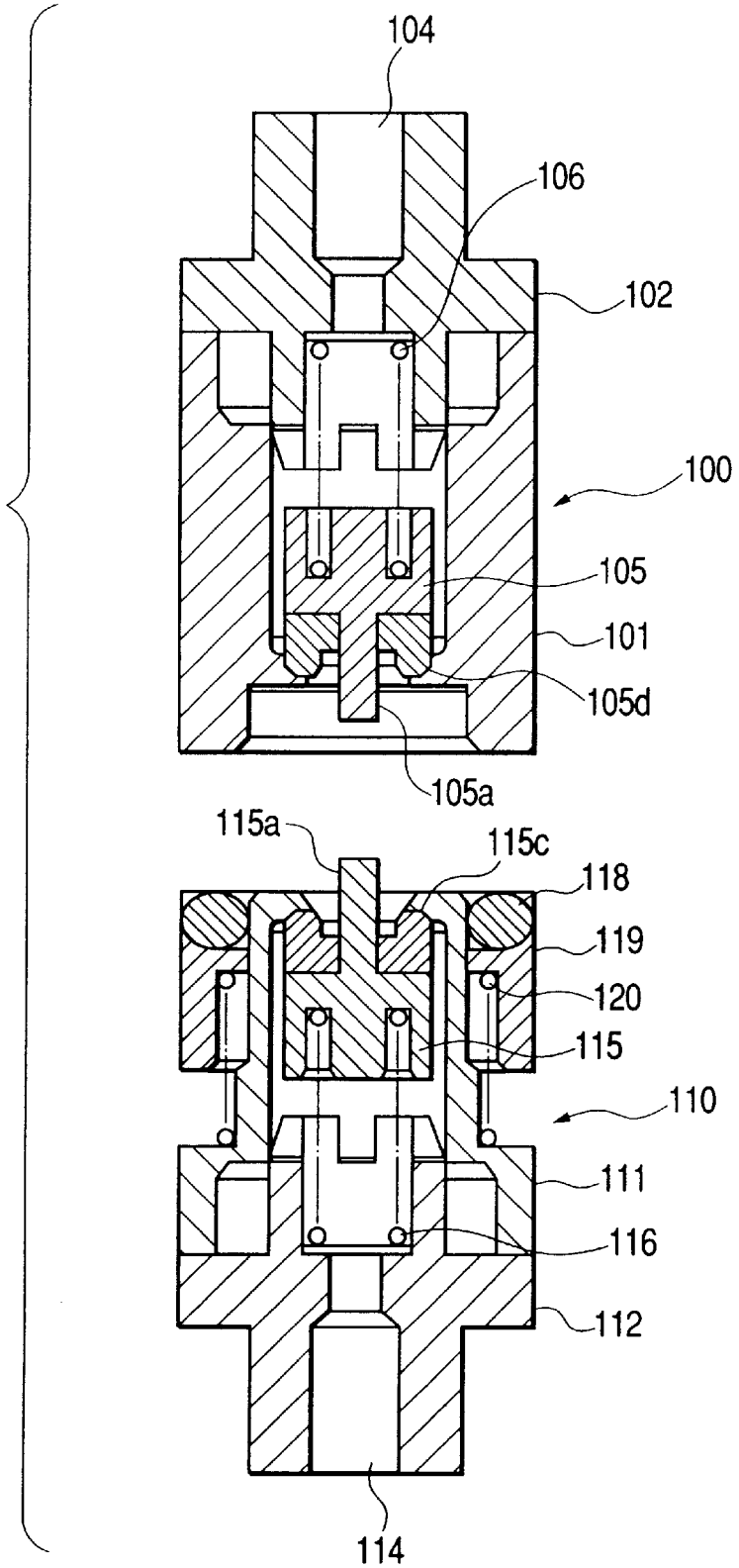

In an embodiment shown in FIG. 13, a coil spring 120 is inserted between a cylindrical case 111 and a ring retention member 119 and an O ring 118 is brought into elastic contact with a cylindrical case 101 to provide hermeticity more reliably.

In the embodiments, valve formation members 105*d* and 115*c* are attached to the push rods 105 and 115 to provide a valve function.

Other members forming the sub-tank unit will be discussed in detail.

First, the float member contained in the ink storage chamber 44 will be discussed.

Figure 14A:
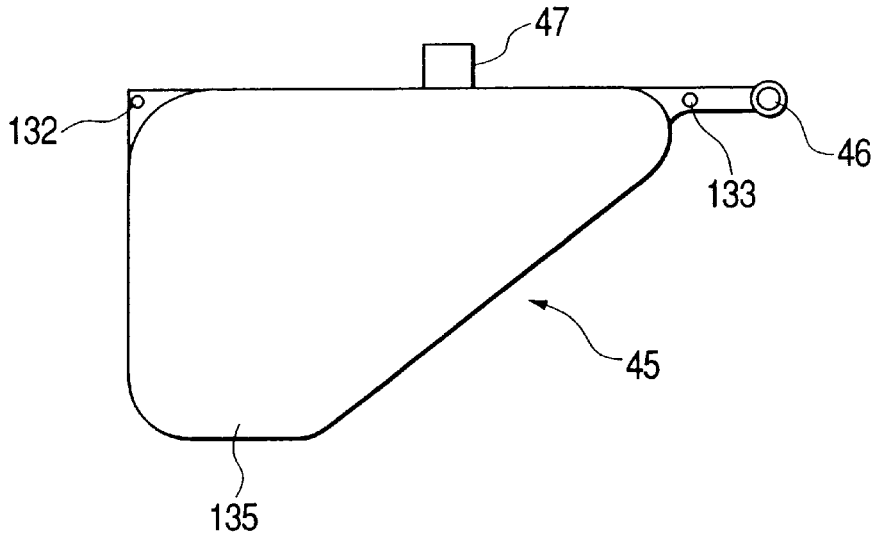
FIGS. 14(A) and (B) are a front view and an exploded perspective view to show one embodiment of a float member attached to a sub-tank unit.
Figure 14B:
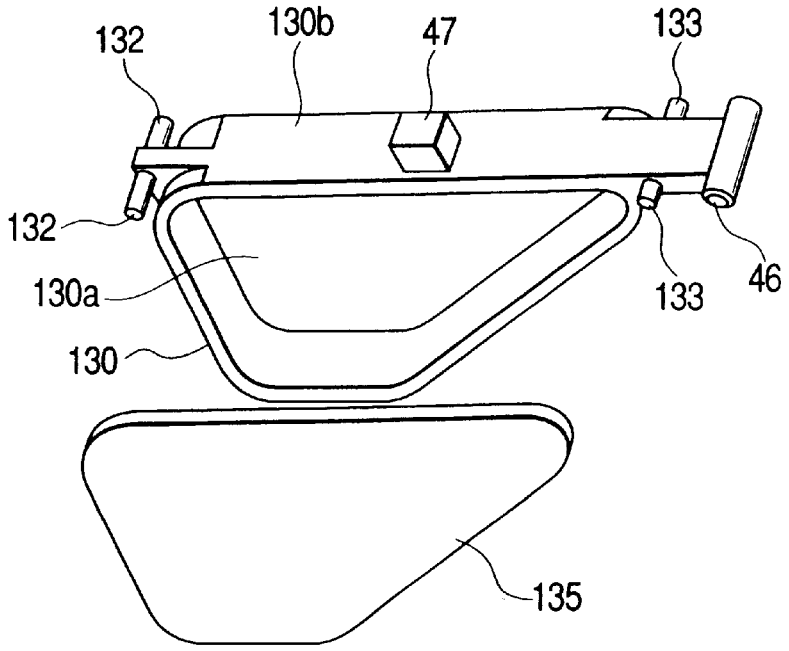

For the float member 45, as shown in FIGS. 14(A) and (B), one end of a long side 130*b* of a trapezoidal frame 130 having a bottom is extended to form a support shaft 46, positioning pins 132 and 133 are provided at an opposite end and in the proximity of the support shaft 46, and a seal member 47 is formed on the surface.

An opening 130*a* on one side of the frame 130 is sealed hermetically by a lid 135, thereby forming the float member as a hollow body. Preferably, the frame 130 and the lid 135 are made lightweight of an easy-to-work material having a comparatively small specific gravity and durability against ink, such as a synthetic resin.

The positioning pins 132 and 133 are formed to project 1 mm or more from the lid 135 on both sides, eliminate the surface tension caused by a gap formed by the float member 45 and an inner wall of the ink storage chamber 44, and guide the float member 45 so as to reliably move following the liquid level of ink.

On the other hand, the valve member 62 for forming the valve in cooperation with the float member 45 is formed of a soft material, for example, soft elastomer, and is designed to reliably provide hermeticity by the seal member 47 that may be made of a hard material provided on the float member 45.

Figure 15A:
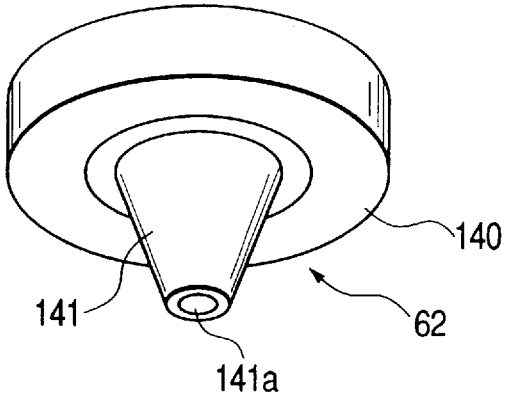
FIGS. 15(A) to (C) are a perspective view and a center sectional view to show one embodiment of a valve member and a drawing to show another embodiment of the valve member as a center cross-sectional structure.
Figure 15B:
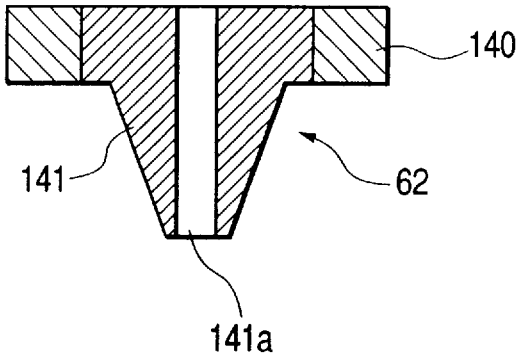

As shown in FIGS. 15(A) and (B), the valve member 62 is made up of an annular fixed member 140 and a packing 141 of a trapezoid body with a through hole 141*a* made in the axial center line, the bottom face of the packing 141 is fitted into the fixed member, and the valve member 62 is fixed hermetically to the rear of the lid 43 of the sub-tank unit via the fixed member 140.

Figure 15C:
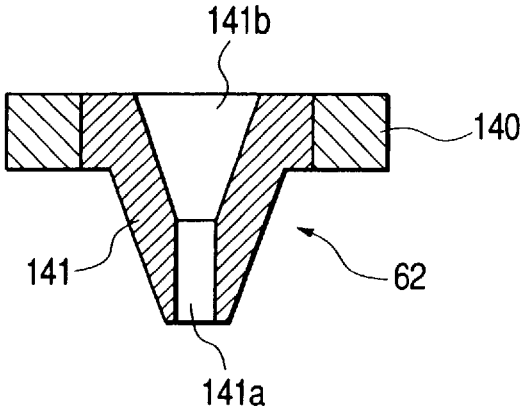

If a spread opening part 141*b* is formed in the through hole 141*a* on the lid side as shown in FIG. 15(C), flexibility can be improved to enhance hermeticity, and the positional tolerance with the opening of the ink supply passage can be enlarged to improve workability when the sub-tank unit 4 is incorporated into the lid 43.

Figure 16A:
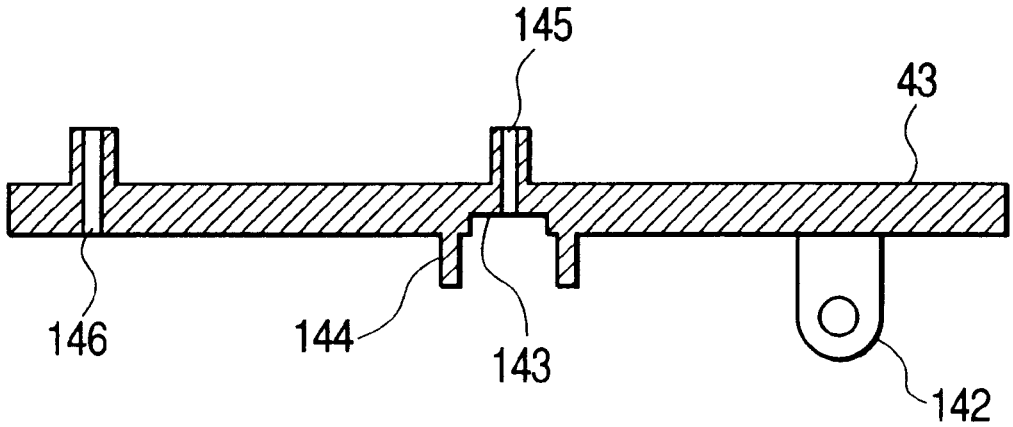
FIGS. 16(A) and (B) are a center sectional view and a bottom view to show one embodiment of a lid of sub-tank unit.
Figure 16B:
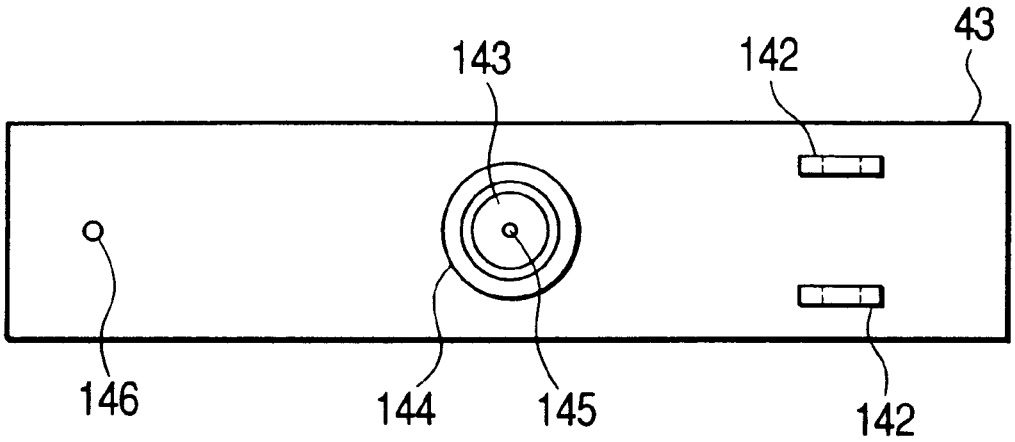

Next, the structure of the lid 43 of the sub-tank unit 4 will be discussed based on FIG. 16.

Figure 18:
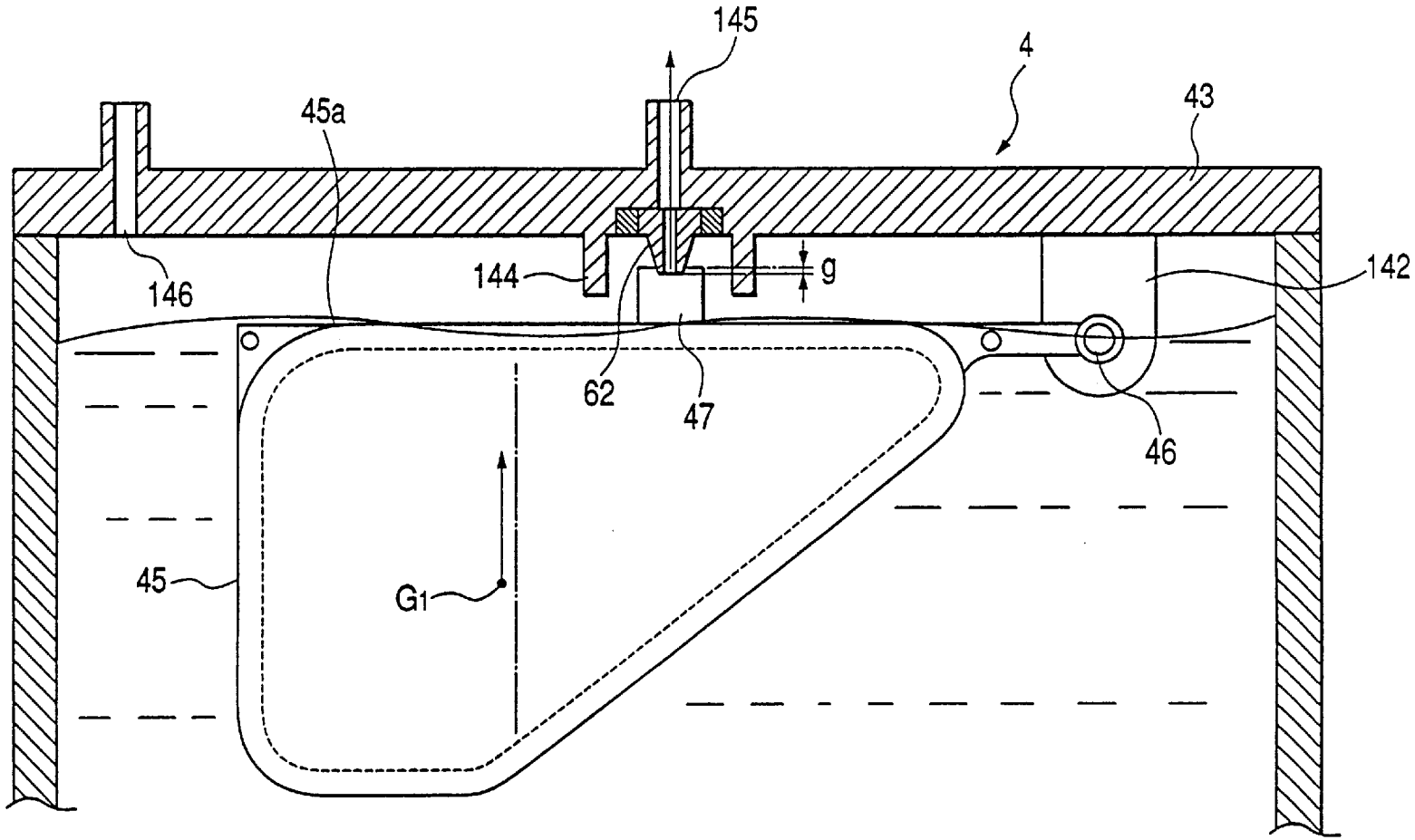
FIG. 18 is a drawing to show an example of incorporating float member into sub-tank unit.

A pair of reception pieces 142 for pivotally supporting the support shaft 46 of the float member 45 is formed at one end part of the lid 43, a concave part 143 for fixing the valve member 62 is formed in the center area, and a cylindrical rib 144 projecting beyond the tip of the valve member 62 is integrally formed around the concave part 143 as shown in FIG. 18. In the figure, numeral 145 denotes an exhaust port and numeral 146 denotes an atmospheric communication port.

The cylindrical rib 144 receives ink droplets at the ink replenishing time, prevents ink from being deposited on the valve member 62, and provides reliability of the operation as an air valve.

Figure 17C:
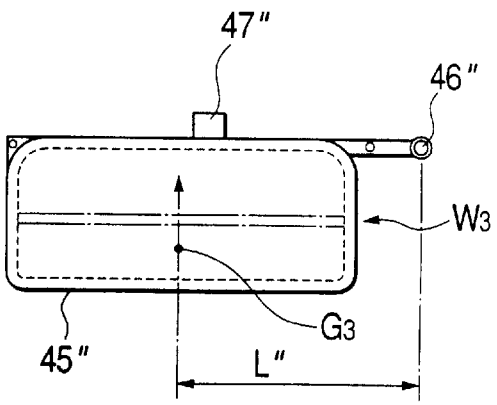
FIGS. 17(A) to (C) are drawings to show embodiments of float members.
Figure 17B:
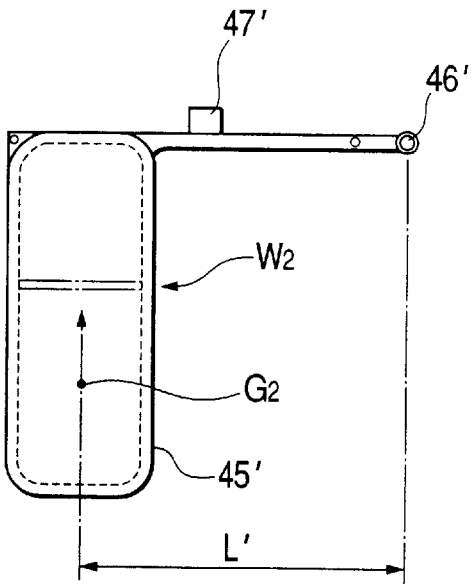
Figure 17A:
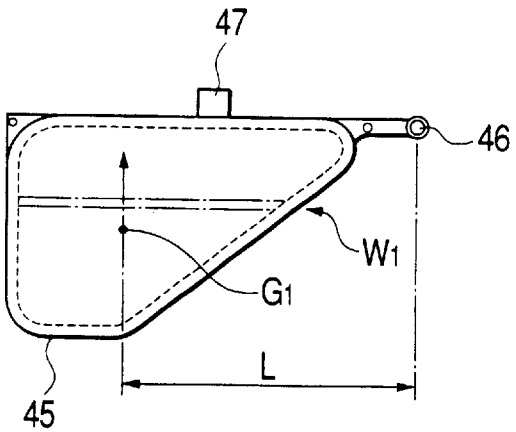

FIGS. 17(A) to (C) show embodiments of the float member 45, wherein each of symbols G1, G2, and G3 denotes the center of gravity of each float member, and the width in the vertical direction indicated by w1, w2, w3 denotes the move distance of each float member when the liquid level of ink rises 1 mm.

FIG. 17(A) shows the float member shaped like the inverse trapezoid previously described in the embodiment, FIG. 17(B) shows the float member shaped like a rectangle long in the length direction, and FIG. 17(C) shows the float member shaped like a rectangle long in the width direction.

As seen in FIGS. 17(A) to 17(C), L'>L>L" stands by comparing distances L, L', and L" that are respectively between support shafts 46, 46', and 46" of the float members 45, 45', and 45" and buoyancy centers of gravity G1, G2, and G3.

Thus, as the distance L, L', L" between the support shaft 46, 46', 46" and the buoyancy center of gravity G1, G2, G3 becomes long, the moment caused by the buoyancy also becomes large, thus the float member 45' shown in FIG. 17(B) has a large elastic contact force of the seal member 47' with the valve member 62 to provide a high seal property, but since the cross-sectional area in the horizontal direction is small, the float-up amount relative to the unit liquid level rise amount becomes small, thus variations in the liquid level of ink at the sealing time become large.

The float member 45" shown in FIG. 17(C) with the shortest distance between the support shaft 46" and the buoyancy center of gravity G3 has a large cross-sectional area in the horizontal direction in contrast to that shown in FIG. 17(B), thus the float-up amount relative to the unit liquid level rise amount is large and the accuracy of the liquid level of ink at the sealing time is high, but since the elastic contact force of the seal member 47" with the valve member 62 is small, the seal property is degraded.

In contrast, the float member 45 shown in FIG. 17(A), which is formed like an inverse trapezoid, has large buoyancy at the sealing time and the distance L between the support shaft 46 and the center of gravity G1 is also provided reasonably, thus when the ink amount arrives at a predetermined level, the seal member 47 can be placed reliably to the valve member 62 to provide reliable sealing by large buoyancy.

FIG. 18 shows an example of incorporating the float member 45 shown in FIG. 17(A) into the sub-tank unit 4 to more effectively exert the characteristic of the float member 45. The float member 45 is attached to a pair of reception pieces 142 of the sub-tank unit 45 for rotation on the support shaft 46 so that, when the ink amount reaches a predetermined full level, a top face 45*a* is placed in a horizontal state and the seal member 47 comes in contact with the valve member 62.

Thus, when ink reaches the predetermined full level, the float member 45 is immersed in ink up to the area where the cross section thereof in the horizontal direction is large. Accordingly, when the top face 45*a* is brought into the horizontal state, the float member 45 receives large buoyancy to strongly press the seal member 47 against the valve member 62, and elastically deform the valve member 62 in compression amount g, thereby delivering reliable sealing.

Figure 19C:
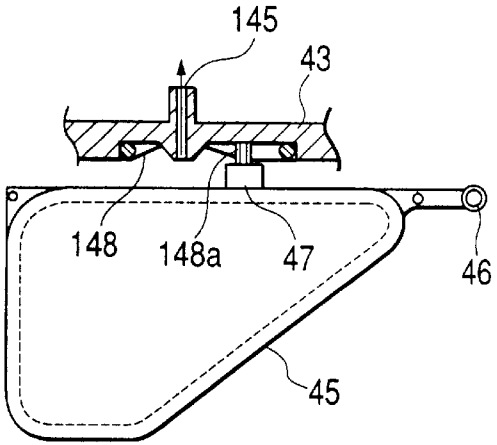
FIGS. 19(A) to (C) are drawings to show another embodiment of a valve mechanism for sealing a suction through hole at the stage where the tank is filled with a predetermined amount of ink in an ink near end state, an ink full state, and a seal state.

In the above-described embodiment, the opening of the valve member is directly sealed by means of the seal member 47. However, a similar effect is produced if a flexible film 148 formed with an opening member 148*a* in an area not facing an opening 62*a* of the valve member 62 is placed so as to be made to face the opening 62*a* in a state in which the flexible film is normally away from the opening 62*a* to define a space 149 and on the other hand, the float member 45 is formed on the top face 45*a* with the seal member 47 at a position facing the flexible film 148, as shown in FIG. 19A.

Figure 19B:
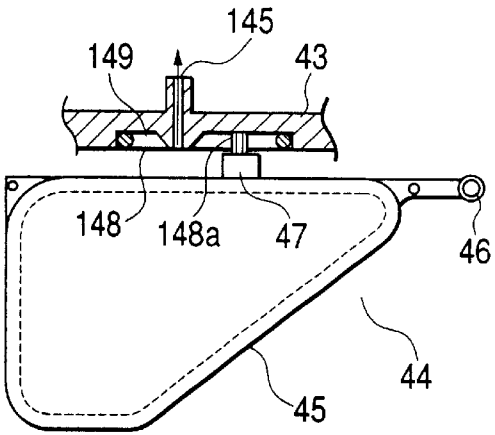
Figure 19A:
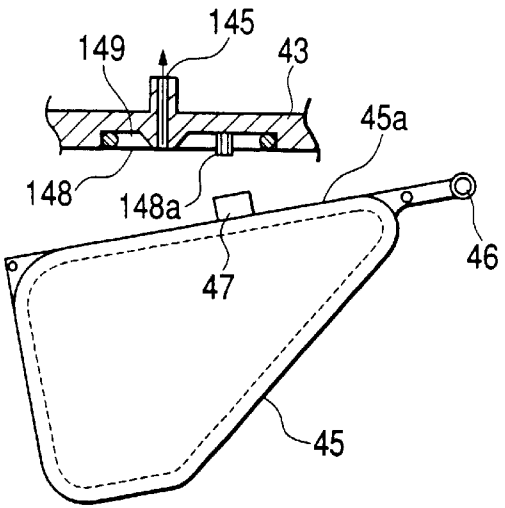

That is, if ink rises to a state in which the tank is fully filled, the seal member 47 abuts the opening member 148*a* to block communication between the ink storage chamber 44 and the exhaust port 145 (FIG. 19(B)).

Thus, pressure in the space 149 is largely reduced and the flexible film 148 is attracted to the exhaust port 145 (FIG. 19(C), providing reliable sealing.

Next, an attachment mechanism between the ink cartridge 6 forming the main tank and the tube 10 will be discussed.

Figure 20:
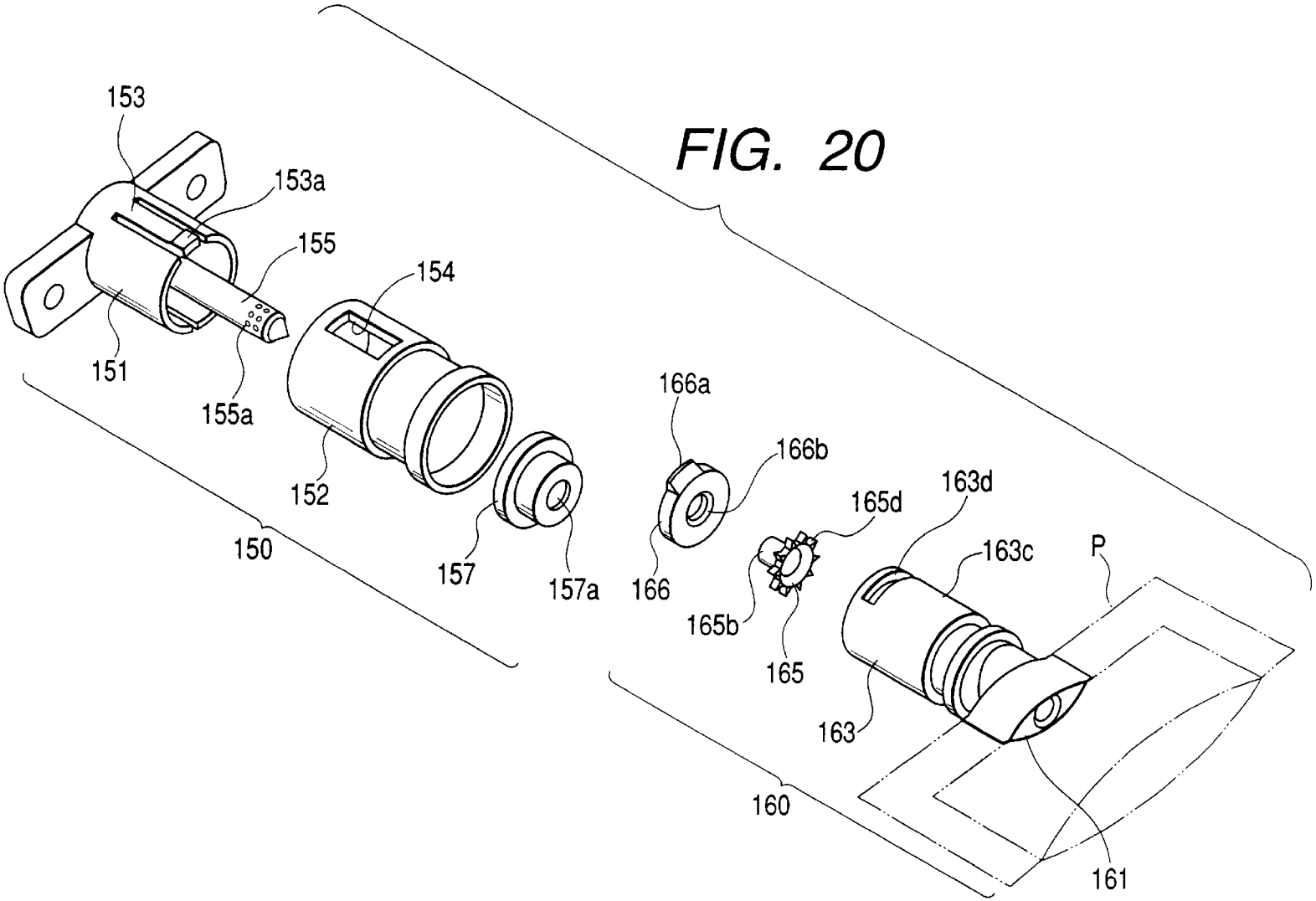
FIG. 20 is an exploded perspective view to show one embodiment of an attachment between an ink cartridge and a tube.

FIG. 20 is an exploded perspective view showing one embodiment of the attachment mechanism. The attachment mechanism is made up of a first mechanism 150 connected to the tube 10 and a second mechanism 160 provided to an in supply port 161 formed in an ink pack P stored in the ink cartridge 6.

Figure 21:
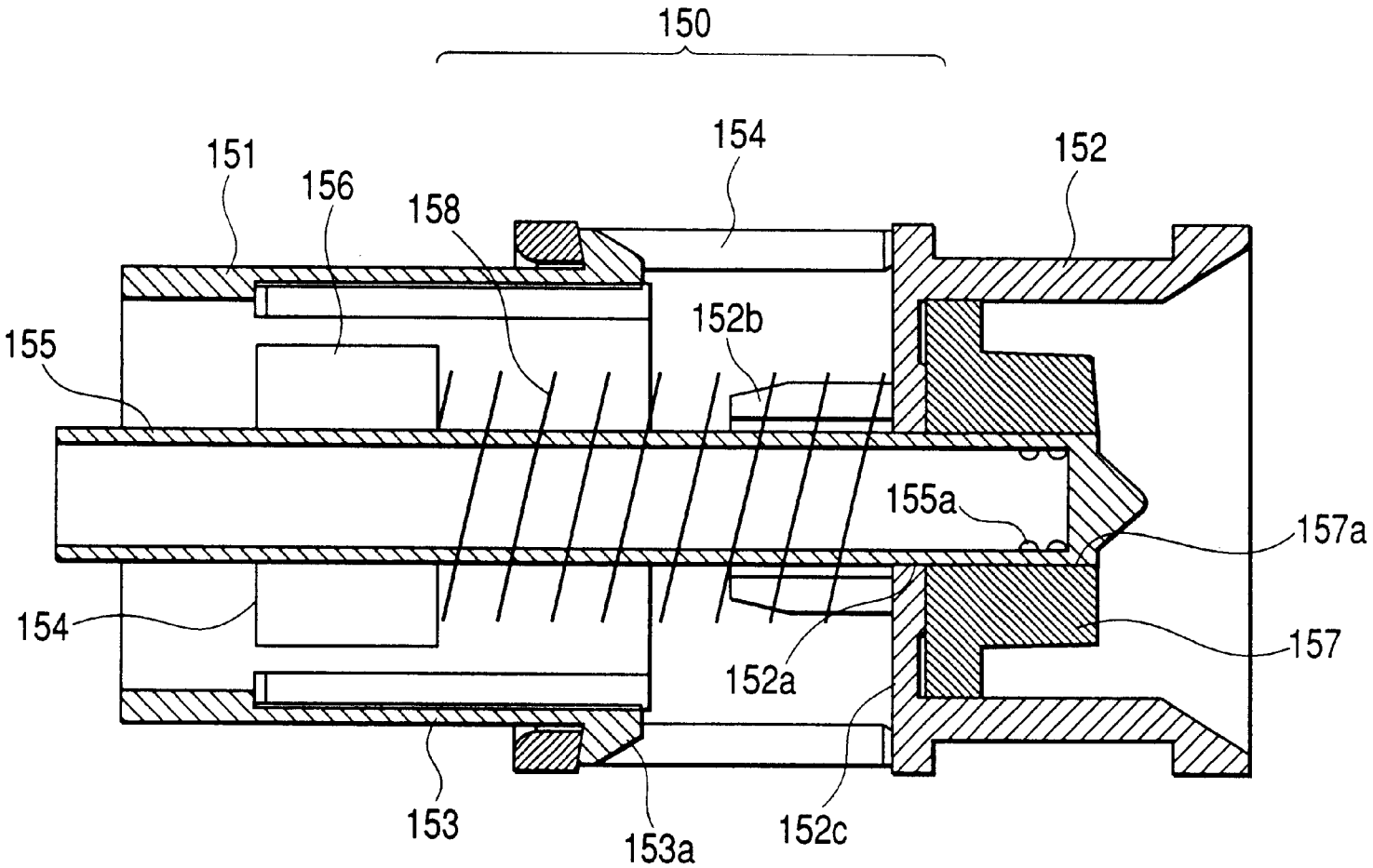
FIGS. 21 and 22 are sectional views to show an embodiment of a first connection part connected to the tube side and an embodiment of a second connection part connected to the ink cartridge side.

As shown in FIG. 21, the first mechanism 150 has a fixed tube part 151 and a moving tube part 152 that are formed by mold-processing a plastic material, etc. The fixed tube part 151 is formed with slits to have a plurality of connection pieces 153 each having an engagement claw 153*a* at the tip, and the moving tube part 152 is formed with elongated holes 154 to which the engagement claws 153*a* are fitted; they are joined in the length direction.

On the center axis of the fixed tube part 151, an ink flow passage formation member 155 with a through hole 155*a* opened at the tip thereof is fixed to and supported on a connection frame 156.

The moving tube part 152 has a bottom part 152*c* comprising a through hole 152*a* allowing the flow passage formation member 155 on the fixed tube part side to pass therethrough, and a spring retention piece 152*b* projecting toward the fixed tube part side. A tubular seal member 157 is fixed on the opposite end side so as to cover the through hole 155*a* at the tip of the flow passage formation member 155 projecting from the bottom part 152*c* and to make the flow passage formation member 155 slidable therealong. The moving tube part 152 is urged to the tip side of the fixed tube part 151 by a compression spring 158 fittingly mounted between the connection frame 156 and the spring retention piece 152*b*.

According to such a structure, in a detachment state from the second connection part 160, the tubular seal member 157 is closely fitted onto the through hole 155*a* at the tip of the flow passage formation member 155, thereby preventing leakage of ink.

Figure 22:
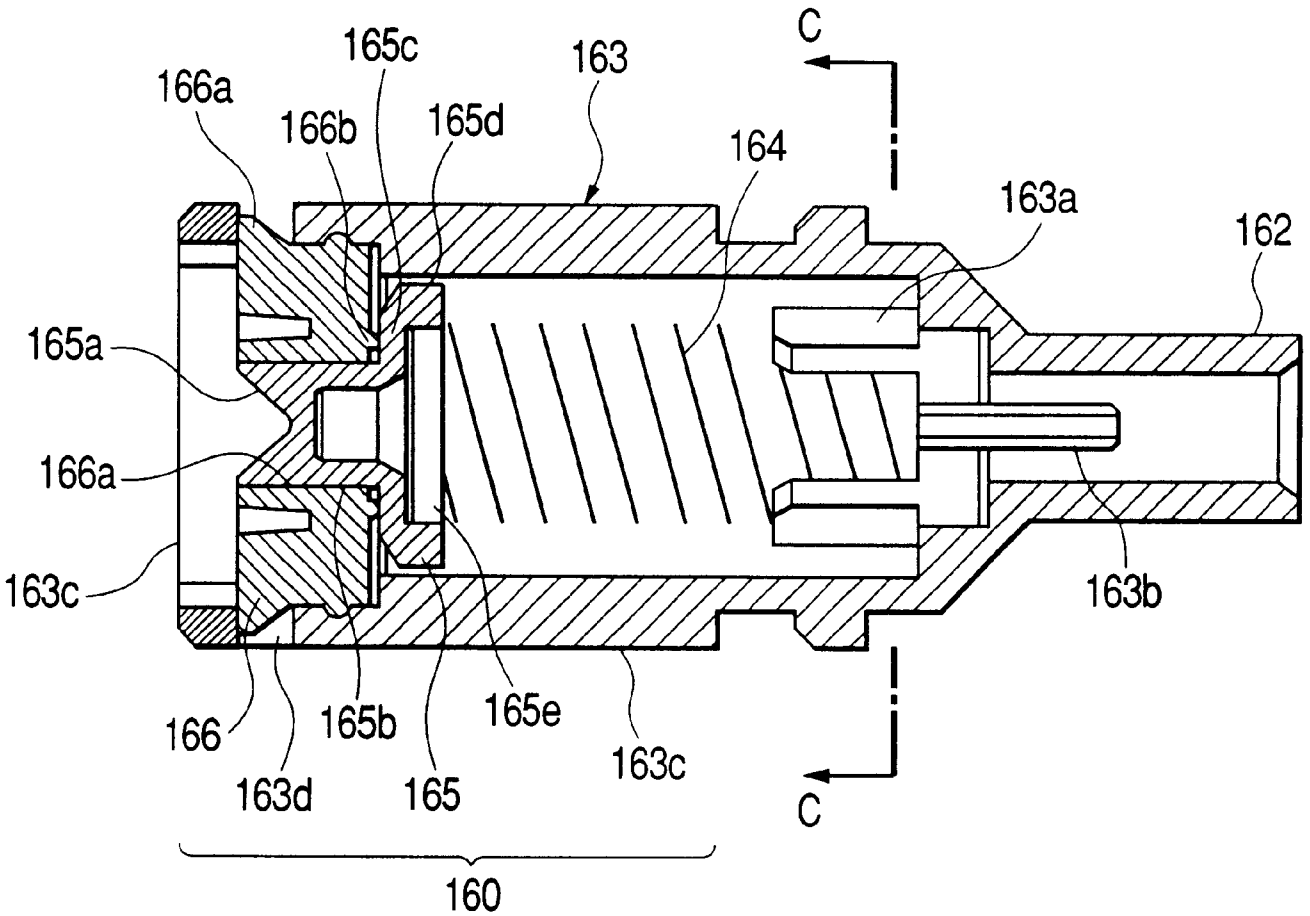

On the other hand, the second connection part 160 is made up of a plastic tubular body 163 comprising a small diameter part 162 that can be inserted into the ink supply port 161 at one end and a large diameter part 163*c* for forming a joint part to the first connection part 150, a slider 165, and a packing 166, as shown in FIG. 22.

Figure 23:
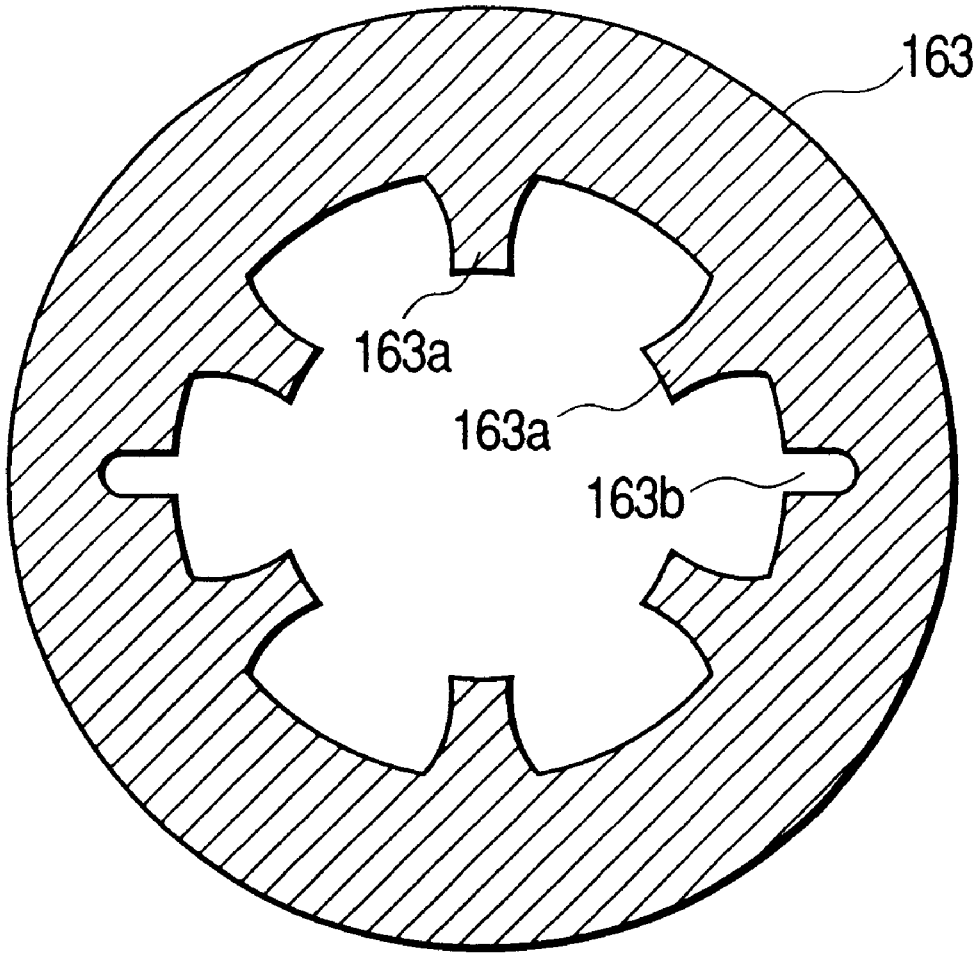
FIG. 23 is a sectional view taken on line C—C in FIG. 22 in the arrow direction to show an embodiment of a large diameter part forming a part of the second connection part.

The tubular body 163 is formed on the side of the small diameter part 162 with radial spring reception projections 163*a* and grooves 163*b* forming the ink flow passage extended therefrom to the small diameter part 162, as shown in FIG. 23. The slider 165 is accommodated in the opposite end of the tubular body 163 such that the projections 166*a* are engaged with holes 163*d* of the tubular body 163 after the slider 165 is movably inserted into the packing 166 in a state that the slider 165 is brought into abutment with the end of the compression spring 164 supported at the other end on the spring reception projections 163.

The slider 165 is made up of a shaft part 165*b* inserted into a through hole 166*b* of the packing 166 on the center line and comprising a concave part 165*a* matching the shape of the tip of the flowpassage formation member 155 at the tip, a bottom face part 165*c* coming in elastic contact with the packing 166, and a guide rib 165*d* formed on the outer periphery of the bottom face part 165*c*. Numeral 165*e* denotes a concave part for spring reception.

According to such a structure, in a detachment state from the first connection part 150, the bottom face part 165*c* of the slider 165 is brought into elastic contact with an annular protrusion part 166*b* of the packing 166 by the spring 164, preventing ink from leaking from the ink pack P.

Figure 24:
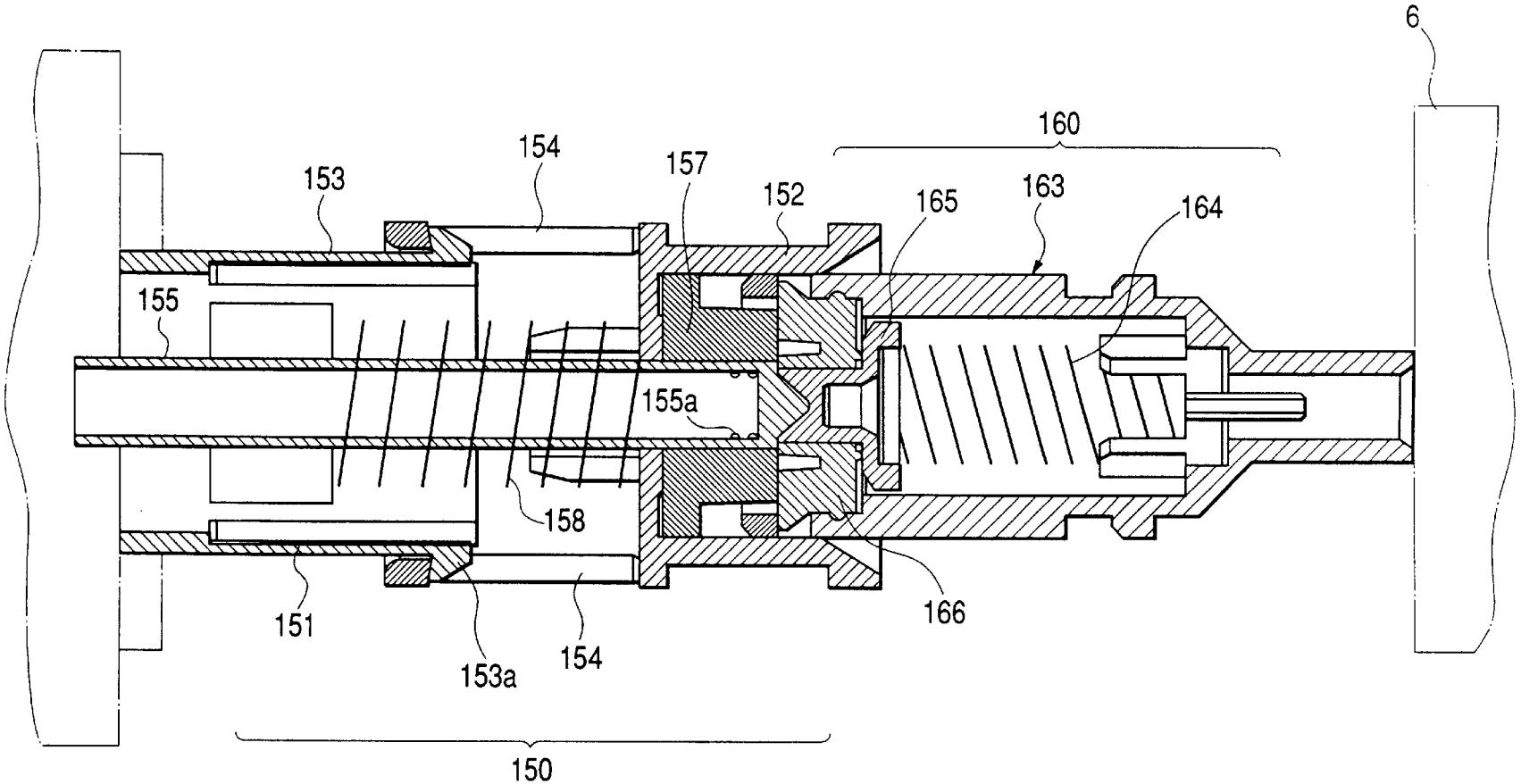
FIGS. 24 and 25 are drawings to show a state in which the connection parts engage each other and a flow passage formation state.

In the embodiment, when the holder 7 is loaded into the ink cartridge 6, the large diameter part 163*c* of the second connection part 160 provided in the ink cartridge 6 is guided by the moving tube part 152 of the first connection part to advance, and the tip of the flow passage formation member 155 is engaged with the concave part 165*a* of the slider 165, as shown in FIG. 24. In the embodiment, since the tip of the flow passage formation member 155 is formed into a conical shape and the concave part 165*a* of the slider 165 is also formed into a conical shape, they are guided by each other through slopes so that the axis centers easily match. In this state, the seal member 157 of the first connection part 150 is pressed at the tip of the packing 166 of the second connection part 160.

Figure 25:
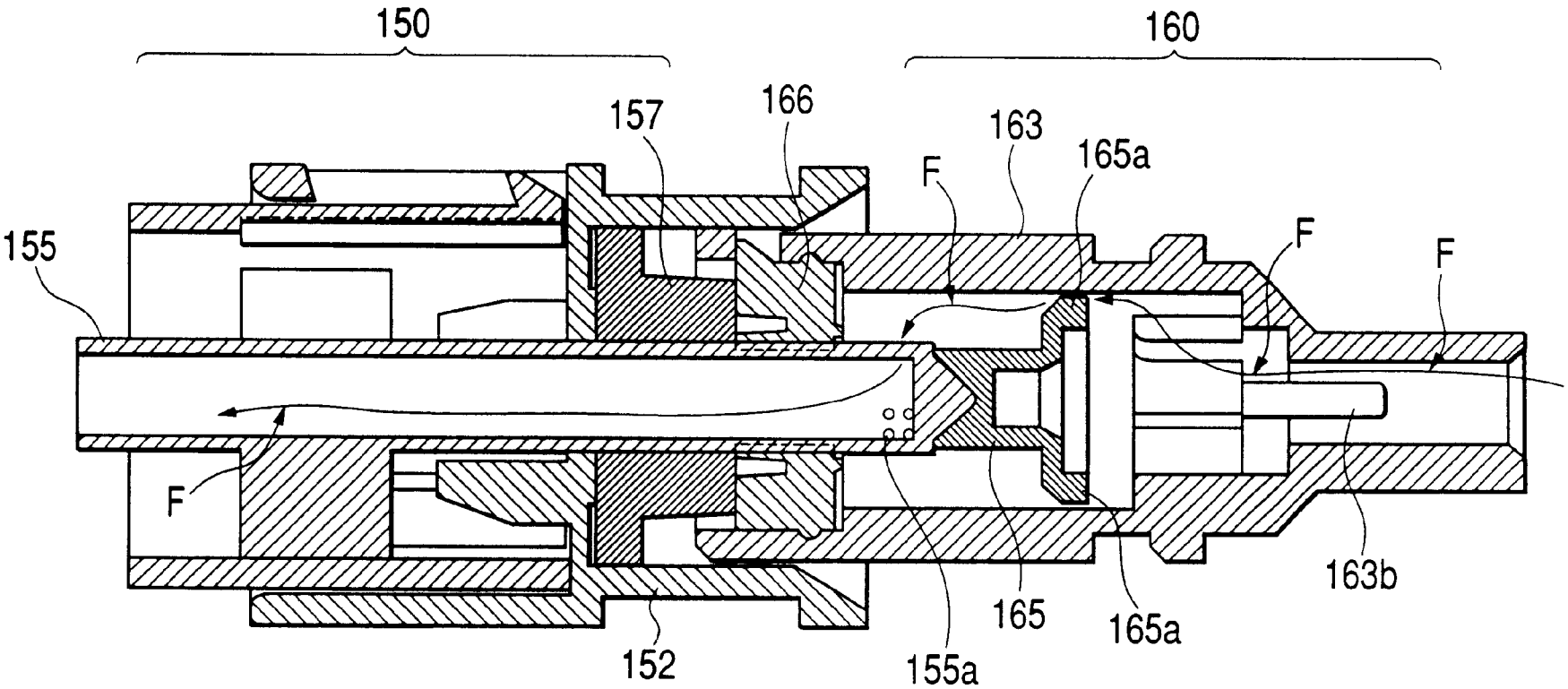

If the cartridge is further pushed in, as shown in FIG. 25, the seal member 157 of the moving tube part 152 is pressed by the packing 166 of the second connection part so that the seal member 157 retreats against the spring 158 and mutually the flow passage formation member 155 projects. This causes the slider 165 to retreat against the spring 164. The through hole 155*a* of the flow passage formation member 155 projects to the large diameter part 163*c* of the second connection part and here communication is established, whereby ink in the ink pack flows into the tube along the ink flow passage indicated by symbol F.

If the ink cartridge is drawn out for replacement, the seal member 157 receives the urge force of the spring 158, moves to the tip side of the flow passage formation member 155 following the movement of the ink cartridge, and seals the through hole 155*a*. The slider 165 of the second connection part 160 also receives the urge force of the spring 164, moves to the side of the packing 166 following a relative retreat of the flow passage formation member 155, and is pressed against the annular protrusion part 166*b* for sealing.

Next, an embodiment of the above-described replenishment unit 90 will be discussed.

Figure 26:
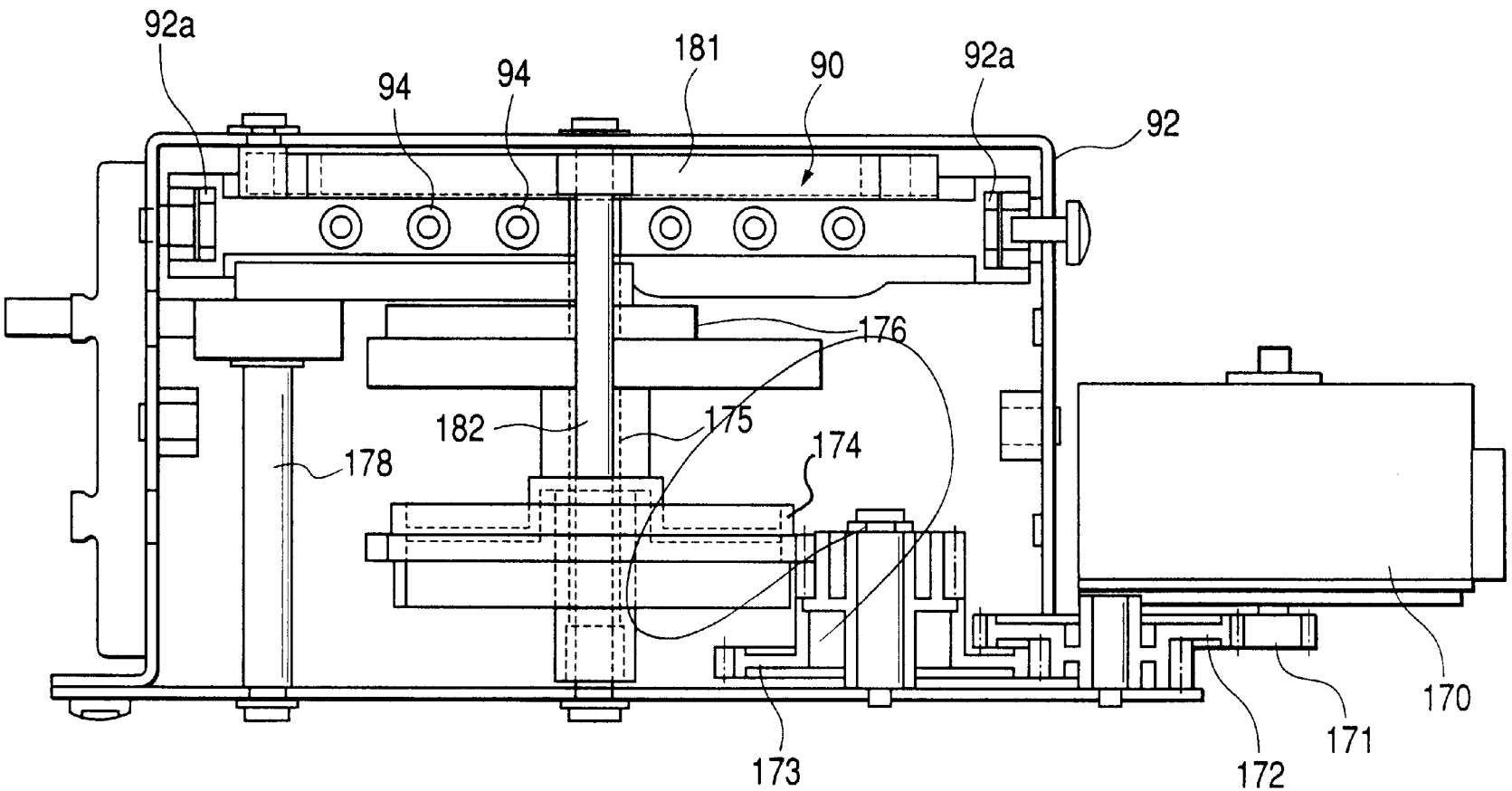
FIG. 26 is a top view to show an up and down drive mechanism of a replenishment unit placed on an ink replenishment stage.

As shown in FIG. 26, a drive motor 170 is disclosed on the outside of the guide case 92, a small gear 172 is driven via a pinion joined to a drive shaft of the motor 170, and a second gear 173 is driven via a small gear disposed on the same axis as the small gear 172.

Further, a third gear 174 is driven via a small gear placed on the same axis as the second gear 173 and a rotation drive force is transmitted to a drive shaft 175 fixed to the third gear 174. That is, the drive force of the motor 170 is speed-reduced in sequence manner by the first to third gears so that the drive shaft 175 can be rotationally driven.

Figure 27:
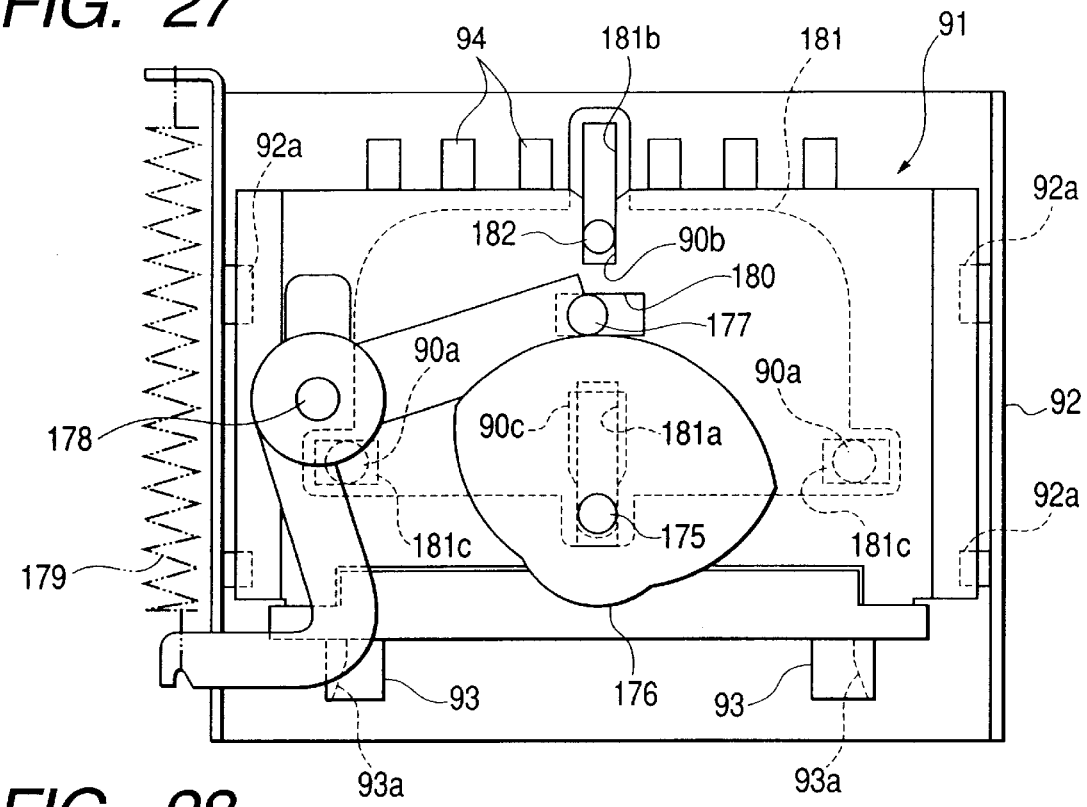
FIGS. 27 and 28 are front views to show a move-up state and a move-down state of the replenishment unit with a drive gear mechanism excluded.
Figure 28:
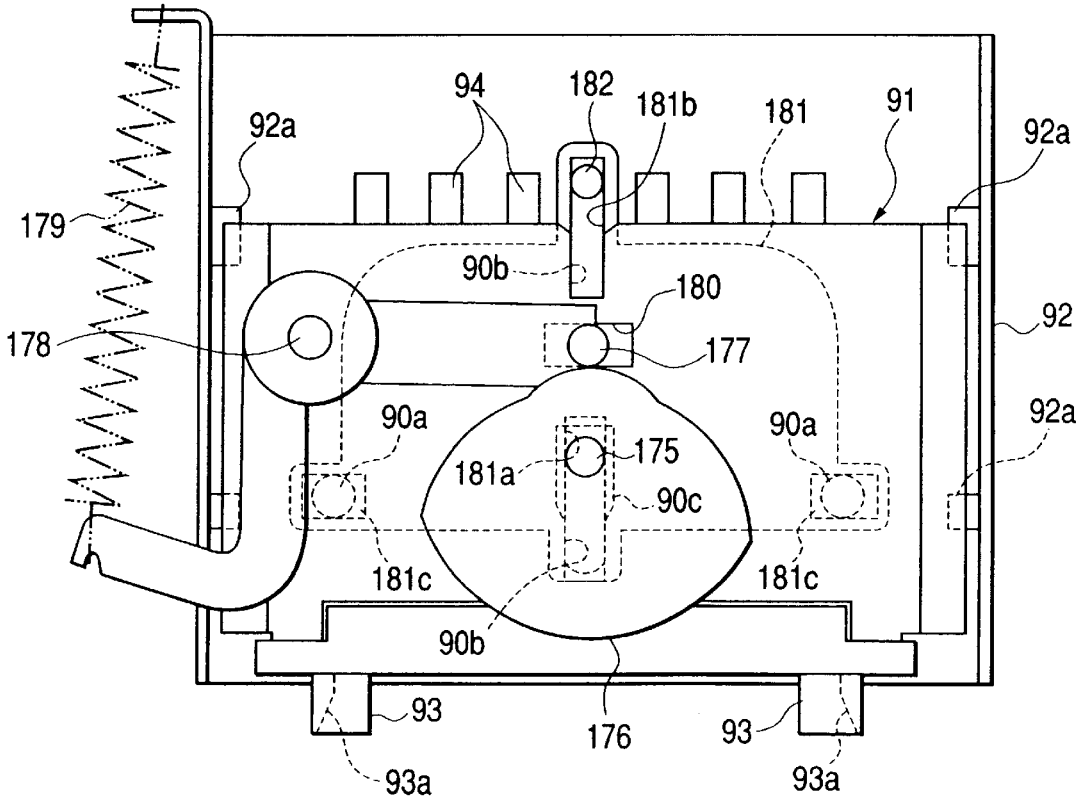

A cam plate 176 is fixed to the drive shaft 175 and as shown in FIGS. 27 and 28, a cam follower 177 abutting the peripheral side face of the cam plate 176 is arranged rotatably by means of a support shaft 178. An opposite side part with respect to the support shaft 178 is pulled by a tensile spring 179 joined at one end to the guide case 92 so that the cam follower 177 is urged to always abut the peripheral side face of the cam plate 176.

The cam follower 177 moved up and down as the cam plate 176 rotates projects also to the rear side of the paper plane in FIGS. 27 and 28, and the projection part engages an elongated hole 180 formed horizontally in the replenishment member 91, causing the replenishment member 91 to reciprocate up and down.

On the other hand, a horizontal maintenance member 181 is disposed on the rear side of the replenishment member 91. The horizontal maintenance member 181 is formed with a pair of elongated holes 181*a* and 181*b* vertically; the drive shaft 175 is inserted into one elongated hole 181*a*, and a support shaft 182 disposed in a parallel state with the drive shaft 175 in the guide case 92 is inserted into the other elongated hole 181*b*. Accordingly, the horizontal maintenance member 181 is moved in a state in which the attitude of the horizontal maintenance member 181 is corrected in the vertical direction by the drive shaft 175 and the support shaft 182. The drive shaft 175 rotationally drives the cam plate 176 and also provides a function of a support shaft for guiding the horizontal maintenance member 181 vertically.

The horizontal maintenance member 181 is formed with a pair of elongated holes 181*c* and 181*c* horizontally, and a pair of protruded parts 90*a* and 90*a* are formed on the side face of the replenishment member 91 corresponding to the elongated holes 181*c* and 181*c*. The protruded parts 90*a* and 90*a* are inserted into the elongated holes 181*c* and 181*c* slidably. Therefore, the replenishment member 91 is supported movably in the horizontal direction with respect to the horizontal maintenance member 181.

The replenishment member 91 is also formed with a pair of elongated holes 90*b* and 90*b* vertically, and is supported in a state in which the drive shaft 175 and the support shaft 182 pass through the elongated holes 90*b* and 90*b*. Each of the elongated holes 90*b* and 90*b* formed in the replenishment member 91 has such a spread part 90*c* that a horizontal width is enlarged to provide a predetermined allowance relative to the drive shaft 175 and the support shaft 182 in a state in which the replenishment member 91 moves downwardly toward the replenishment side unit 4. In the embodiment, the spread part 90*c* for the support shaft 182 is substantially formed at a position out of the upper end part of the replenishment member 91, namely, on the open end side.

Therefore, the replenishment member 91 is supported movably in the horizontal direction with respect to the horizontal maintenance member 181, and moreover can move slightly in the horizontal direction while the attitude of the replenishment member 91 is regulated by the horizontal maintenance member 181 in the range of a predetermined allowance formed between the spread parts 90*c* and the drive shafts 175 and the support shaft 182 only in the state in which the replenishment member 91 moves downwardly toward the sub-tank unit 4.

The aligning operation will be discussed based on FIGS. 29 to 32.

Figure 29B:
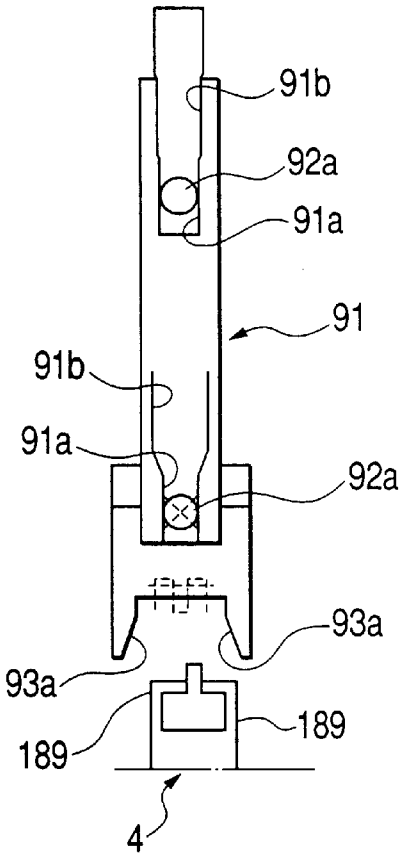
FIGS. 29(A) and (B) to 32(A) and (B) are front views and side views to show an alignment function in a state in which a replenishment member moves up, a state in which the replenishment member slightly moves down, a state in which the replenishment member furthermore moves down, and a state in which the replenishment unit is connected to the sub-tank unit.
Figure 29A:
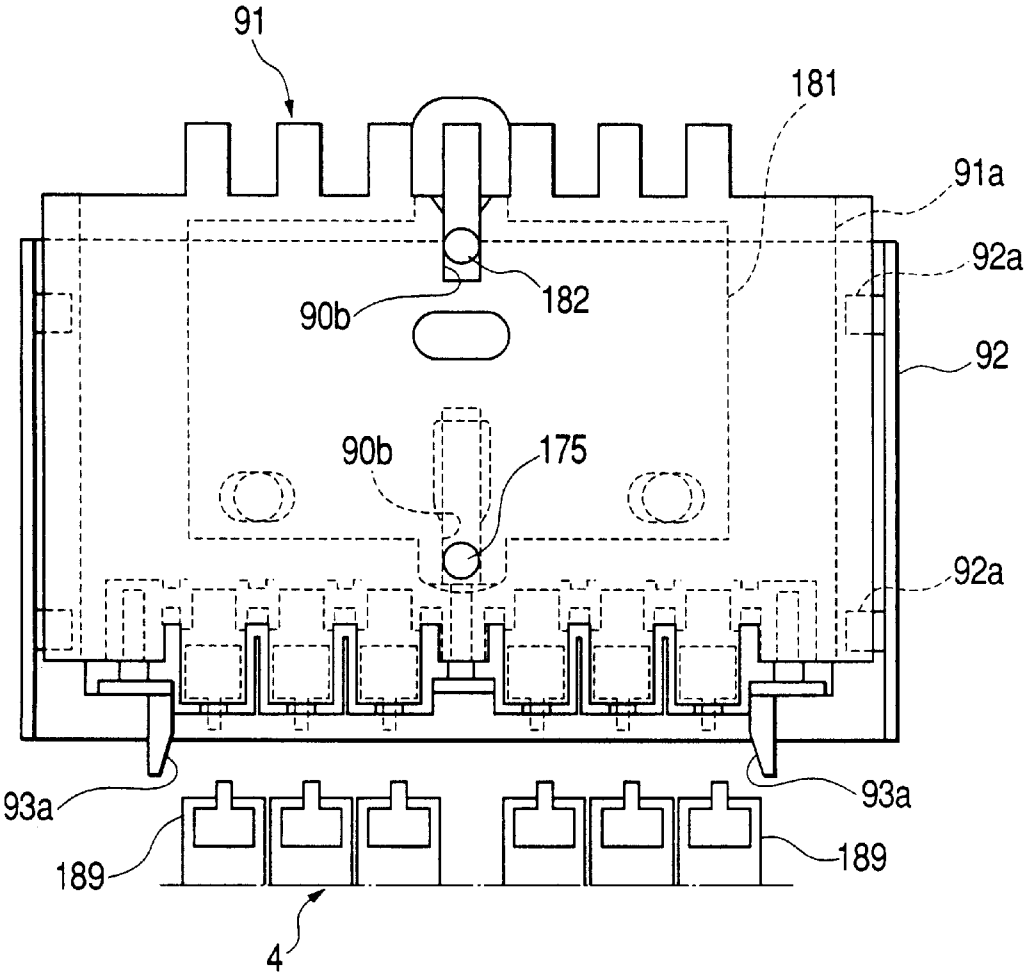

Guide ribs 93 are arranged in the lower bottom part of the replenishment member 91, each being formed with slopes facing inwardly with a distance therebetween increased downwardly. The guide ribs 93 are placed in relation orthogonal to each other in the horizontal direction as shown in FIGS. 29(A) and (B) to 32(A) and (B). On the other hand, the sub-tank unit 4 is formed at corners with guide parts 189.

Therefore, as the replenishment member 91 moves downwardly toward the sub-tank unit 4, the slope part 93*a* of the guide rib 93 arranged in the lower bottom part of the replenishment member 91 abut the guide member 189 at the corner of the sub-tank unit 4 and the replenishment member 91 moves horizontally with the sub-tank unit 4 as the reference, as shown in order in FIGS. 29 to 32.

Figure 30B:
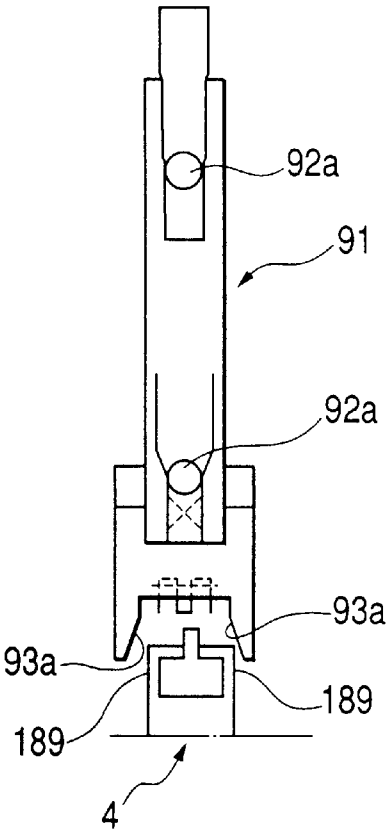
Figure 30A:
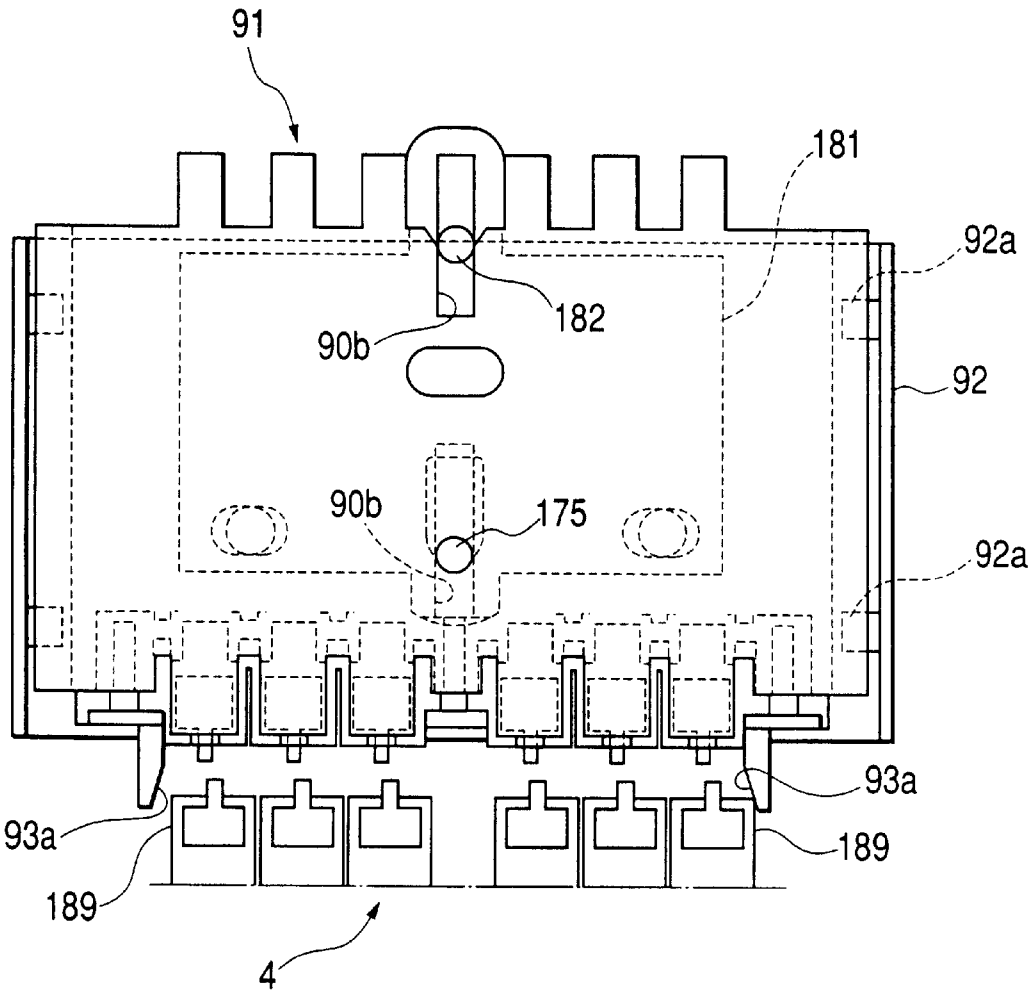
Figure 31B:
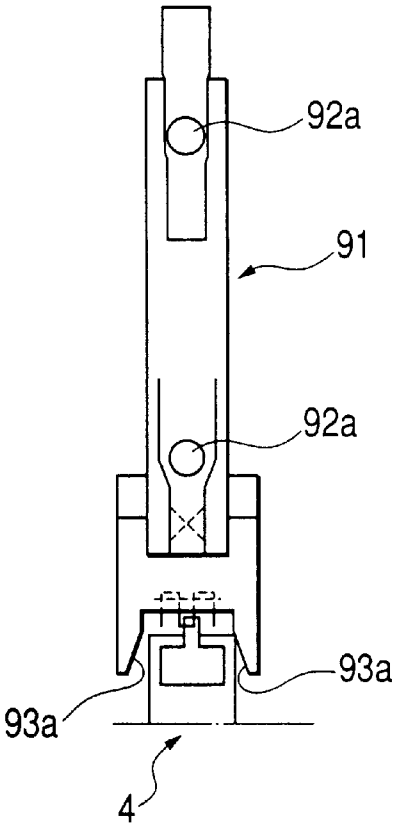
Figure 31A:
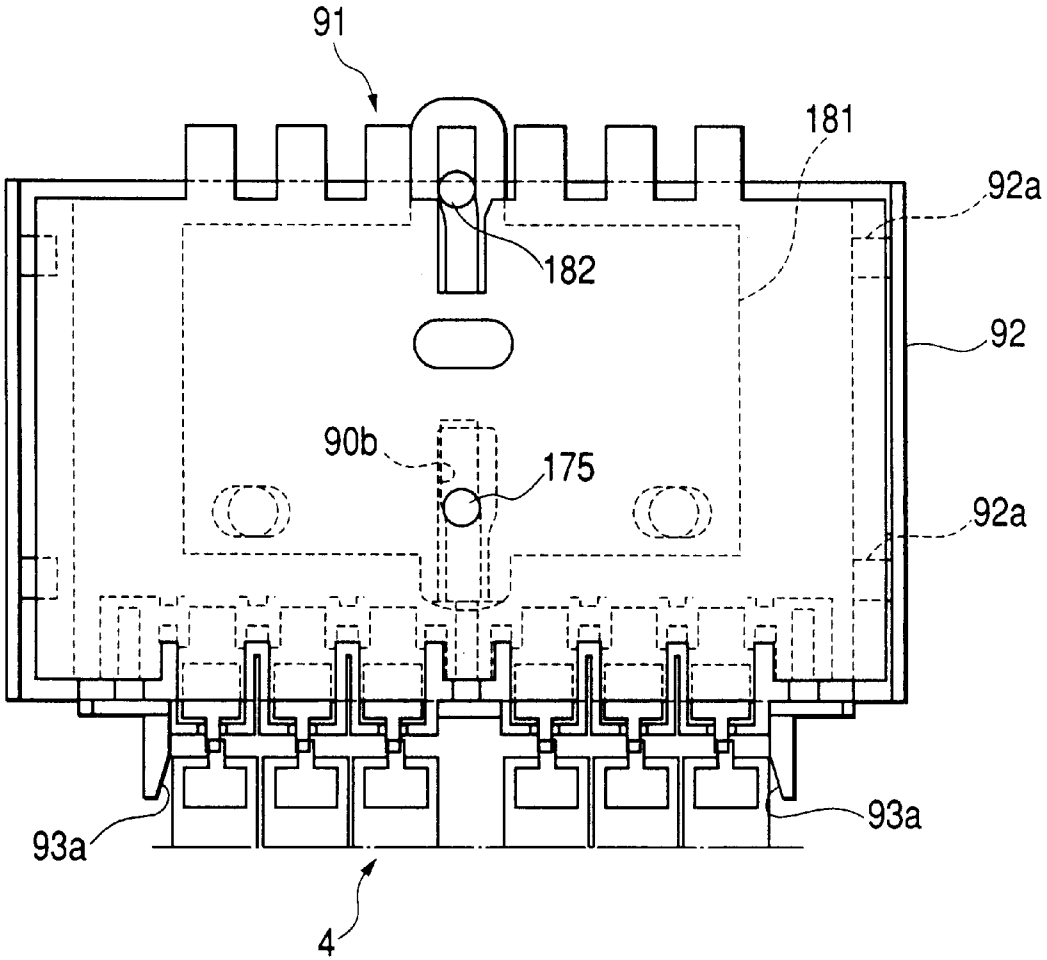

In this case, in the state shown in each of FIGS. 29(A) and 30(A), the elongated holes 90*b* and 90*b* in the replenishment member 91 are guided by the drive shaft 175 and the support shaft 182 arranged in the guide case 92 to move downwardly. When the state shown in FIG. 31(A) is established, the drive shaft 175 and the support shaft 182 are relatively positioned in the areas of the spread parts 90*c* of the respective elongated holes, so that the replenishment member 91 can move horizontally in the range of the predetermined allowance formed between the spread parts 90*c* and the drive shaft 175 and the support shaft 182.

Figure 32B:
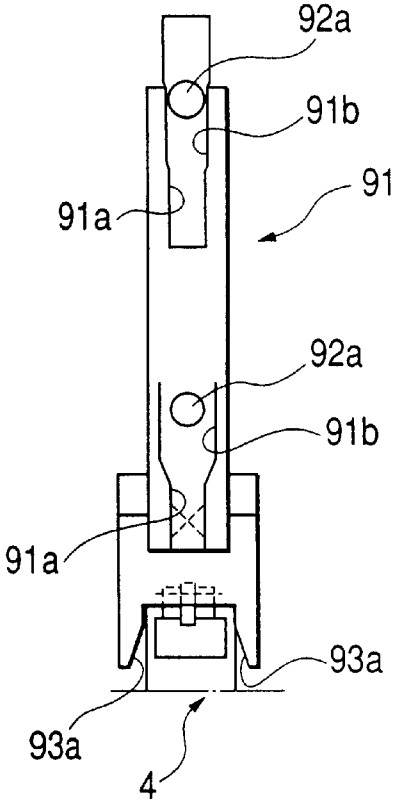
Figure 32A:
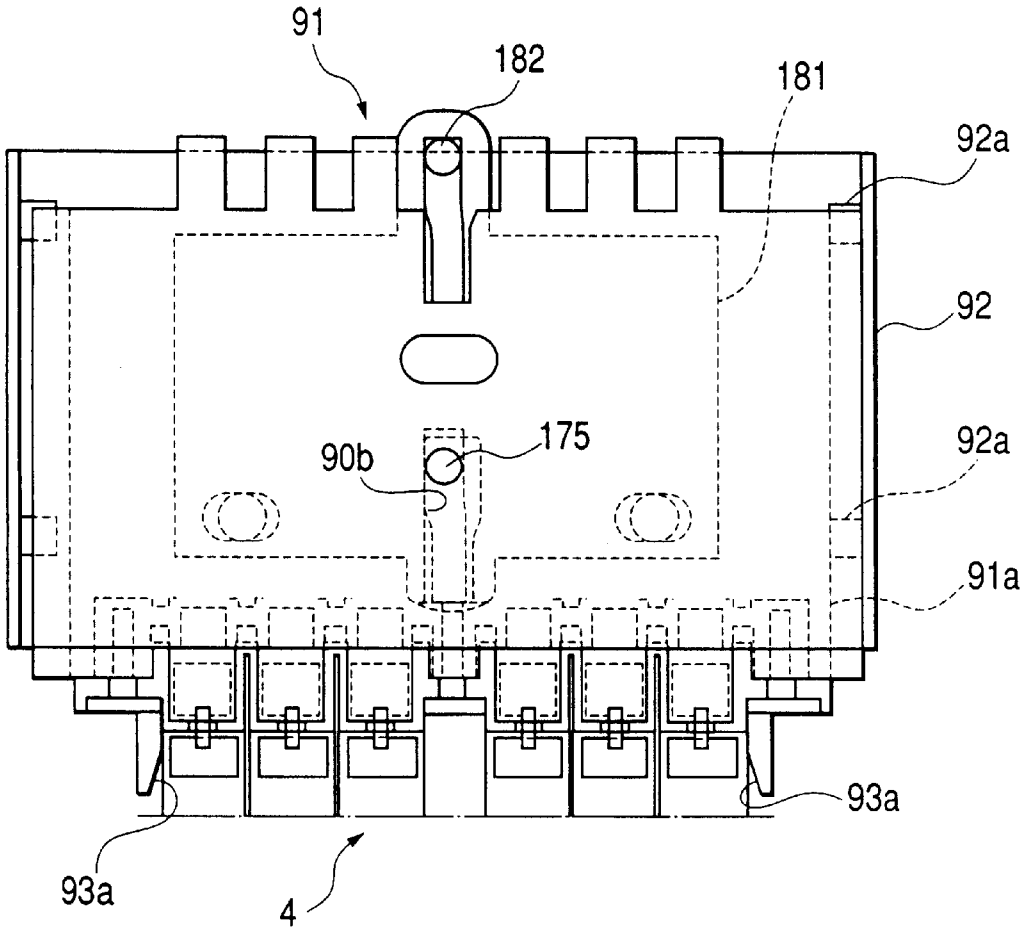

At this time, the slope part 93*a* of the guide rib 93 abuts the guide member 189 so that the replenishment member 91 is moved horizontally while the attitude of the replenishment member 91 is regulated by the horizontal maintenance member 181 with the sub-tank 4 as the reference. As shown in FIG. 32(A), in a state in which the replenishment member 91 most moves downwardly, the replenishment member 91 is aligned at a predetermined position with respect to the sub-tank unit 4 and an ink supply passage is formed.

Thus, even if a plurality of ink supply connection parts are formed in a unit, they can be connected reliably in order to supply plural types of ink to the sub-tank unit 4 simultaneously.

As shown in FIGS. 29(B) to 32(B), the elongated grooves 91*a* formed vertically at left and right end parts of the replenishment member 91 are formed with spread parts 91*b* widening in the upper parts so as to provide a predetermined allowance relative to each guide projection 92*a* in the state in which the replenishment member 91 moves downwardly toward the sub-tank unit 4. Therefore, the replenishment member 91 can also be aligned with the replenishment side unit 2 in a direction orthogonal to the replenishment member 91.

In the above-described embodiment, each of the replenishment unit and the sub-tank unit forming the connection mechanism is provided with ink supply passages arranged in a single row in the carriage scan direction. However, a similar effect is also produced if the ink supply passages are arranged in a single row in a direction orthogonal to the carriage scan direction or if the ink supply passages are arranged in the carriage scan direction and in the direction orthogonal to the carriage scan direction.

Figure 33:
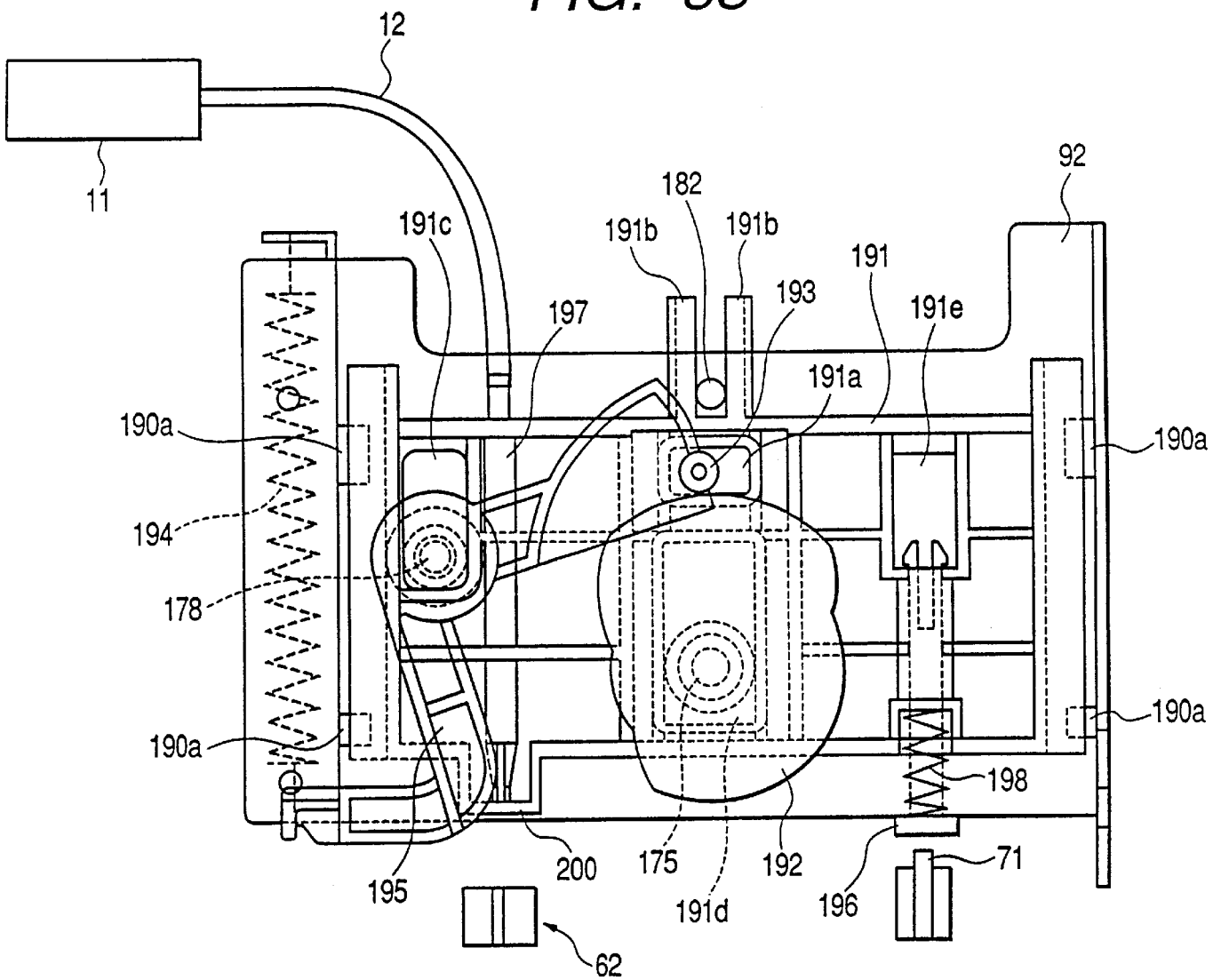
FIG. 33 is a side view to show another embodiment of opening and closing means of a suction pump connection structure and an atmospheric communication port placed on an ink supply stage.

Next, an embodiment of opening and closing means of a suction pump connection mechanism and an air introduction port will be discussed based on FIG. 33.

The embodiment includes, similarly to the above-described arrangement, a slide plate 191 moved up and down while being guided by four guide projections 190*a* oriented inwardly on the guide case 92, a cam plate 192 rotationally driven by the drive motor 170 and train 171 to 175 previously shown in FIG. 26 to determine the movement of the slide plate 191, a pin 193, i.e. a cam follower, coming in contact with the cam plate 192 and loosely fitted into a through hole 191*a* provided in the slide plate 191, a lever 195 having one end to which the pin 193 is fixed and the other end to which a spring 194 is suspended, a closing member 196, disposed opposite from the lever 195 with respect to the cam plate 192 of the slide plate 191, for pressing the air introduction valve 71, i.e. the atmospheric communication port opening and closing means, to close the same (see FIG. 6), a spring 198 attached between the closing member 196 and the slide plate 191, and a connection suction passage 197 formed in the slide plate 191.

The slide plate 191 is formed with two regulation members 191*b* and 191*b* extended upward, and the support shaft 182 is inserted between the regulation members. A through hole 191*d* into which the drive shaft 175 is inserted, and a through hole 191*c* into which the support shaft 178 of the lever 195 is inserted are formed. In order to prevent the up and down movement of the slide plate 91 from being regulated by the drive shaft 175 and the support shaft 178, the through hole 191*c* is elongated up and down, and the through hole 191*d* is formed in a similar fashion as the through hole 191*c*. The width of the through hole 191 is narrowed to such an extent that the drive shaft 175 can be passed therethrough.

The closing member 196 is set so that the tip part thereof is positioned toward the sub-tank unit side (in the figure, downward) relative to the tip part of the connection suction passage 197 connected to the sub-tank unit side. When the slide plate 191 moves downwardly, the atmospheric communication port 65 is closed by the closing member 196 prior to connection of the connection suction passage 197 to the valve unit.

The tube 12 connected to the pressure reducing pump 11 is joined to the upper end opening part of the connection suction passage 197, and a valve connection part 200 described later is provided to the lower end opening part thereof.

Figure 34:
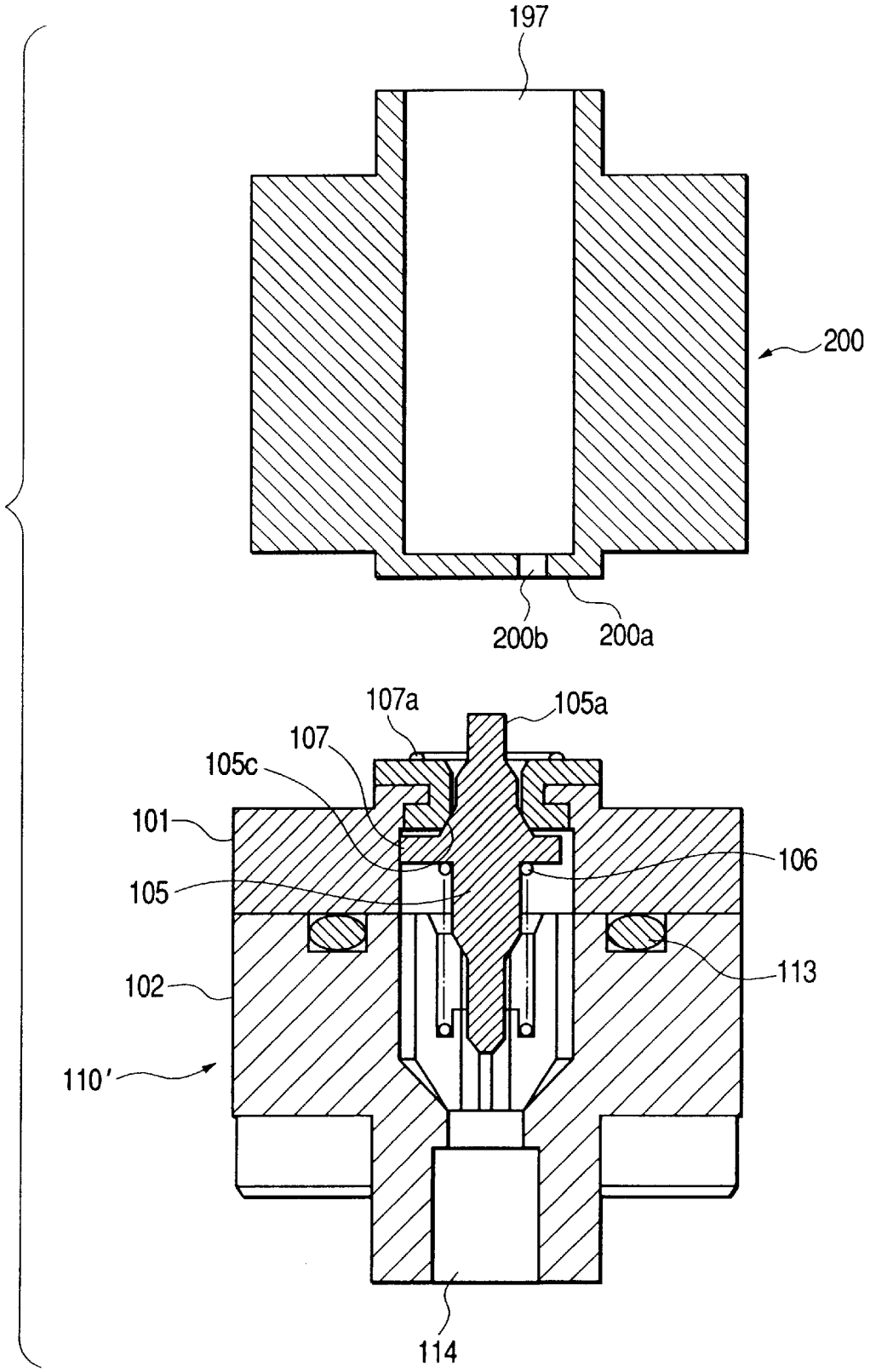
FIG. 34 is a sectional view to show one embodiment of a valve unit suited for the pump connection mechanism.

FIG. 34 is a sectional view showing the valve connection part 200 in a pump connection mechanism 41 disposed on the above-mentioned ink supply stage, and a valve member 110' disposed on the sub-tank unit 4 side.

The valve member 110' provided on the sub-tank unit adopts the same structure as the valve 100 of the two valves 100 and 110 shown in FIG. 9, and the valve 100 arranged upside down is used, and therefore a description thereof will not be given.

On the other hand, the valve connection part 200 is provided with a communication opening 200*b* that communicates with the connection suction passage 197 and that is located in an area of a bottom part 200*a* not opposed to a protruded part 105*a* of a push rod 105. The bottom part 200*a* is finished to define a plane surface coming in intimate contact with an extension part 107*a* of a part of a seal member 107 of the valve member 110' for reliable sealing.

In the embodiment, when the sub-tank unit 4 is brought into an ink near end state and thus replenishment with ink becomes necessary, the sub-tank unit 4 is moved to the ink supply stage by the carriage and the attachment mechanism on the ink replenishment side is connected to the sub-tank unit 4.

Upon the completion of docking, the cam plate 192 is rotated to move the pin 193 downwardly along the path of the cam plate 192, and move the slide plate 191 fixed thereto also downwardly.

Also, in the embodiment, the slide plate 191 is guided by four guide projections 190*a* formed in the guide case 92, the support shaft 182 in the upper part of a guide case 190 almost between the guide projections 190*a,* the regulation members 191*b* and 191*b,* the drive shaft 175, and the through hole 191*d,* so that the slide plate 191 moves smoothly without swinging.

Figure 35:
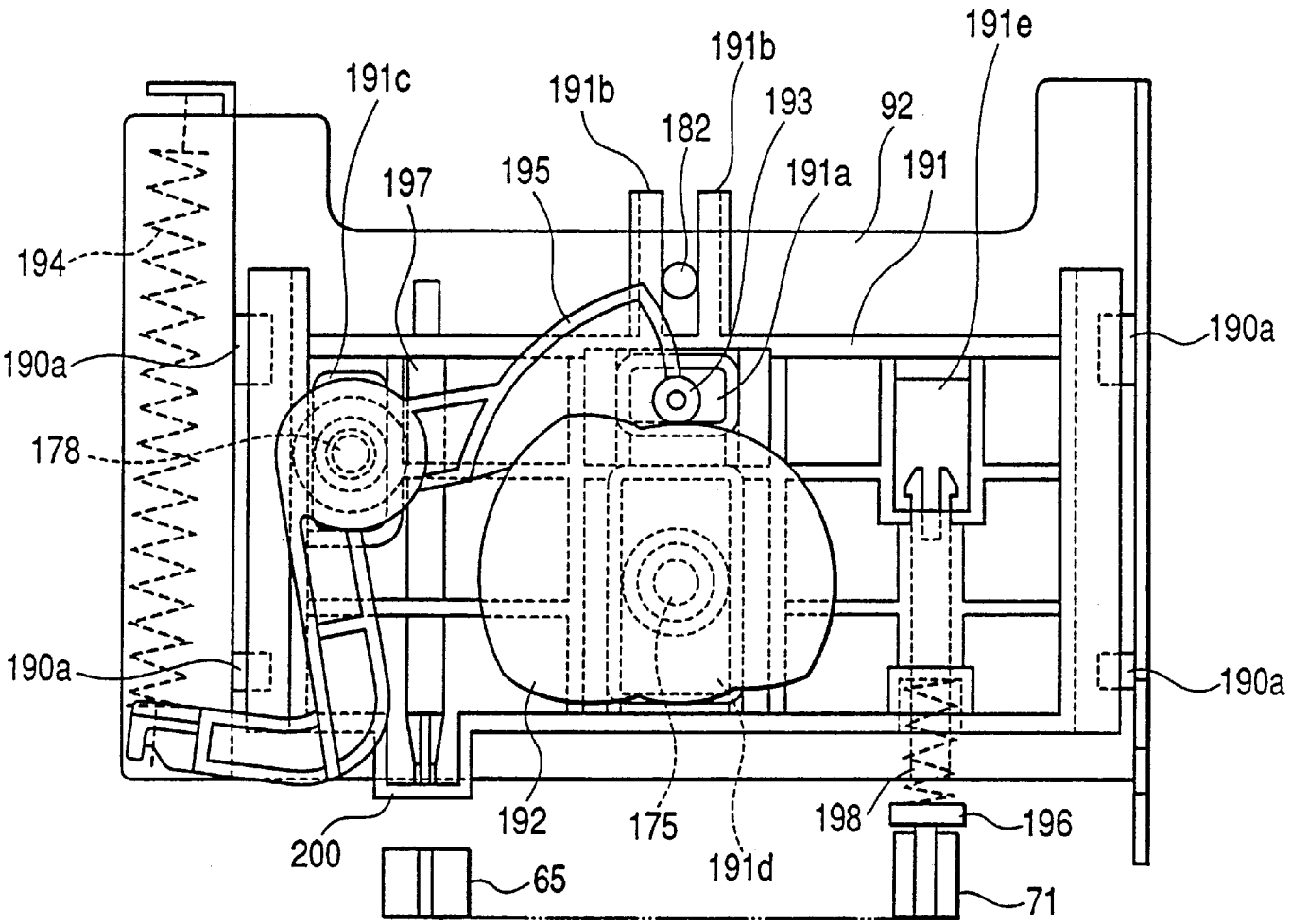
FIG. 35 is a side view to show a move-down process of the pump connection mechanism and an atmospheric communication port introduction port and FIG. 36 is a side view to show a connection state of the pump connection mechanism and a closing state of the opening and closing mechanism of the atmospheric communication port.
Figure 36:
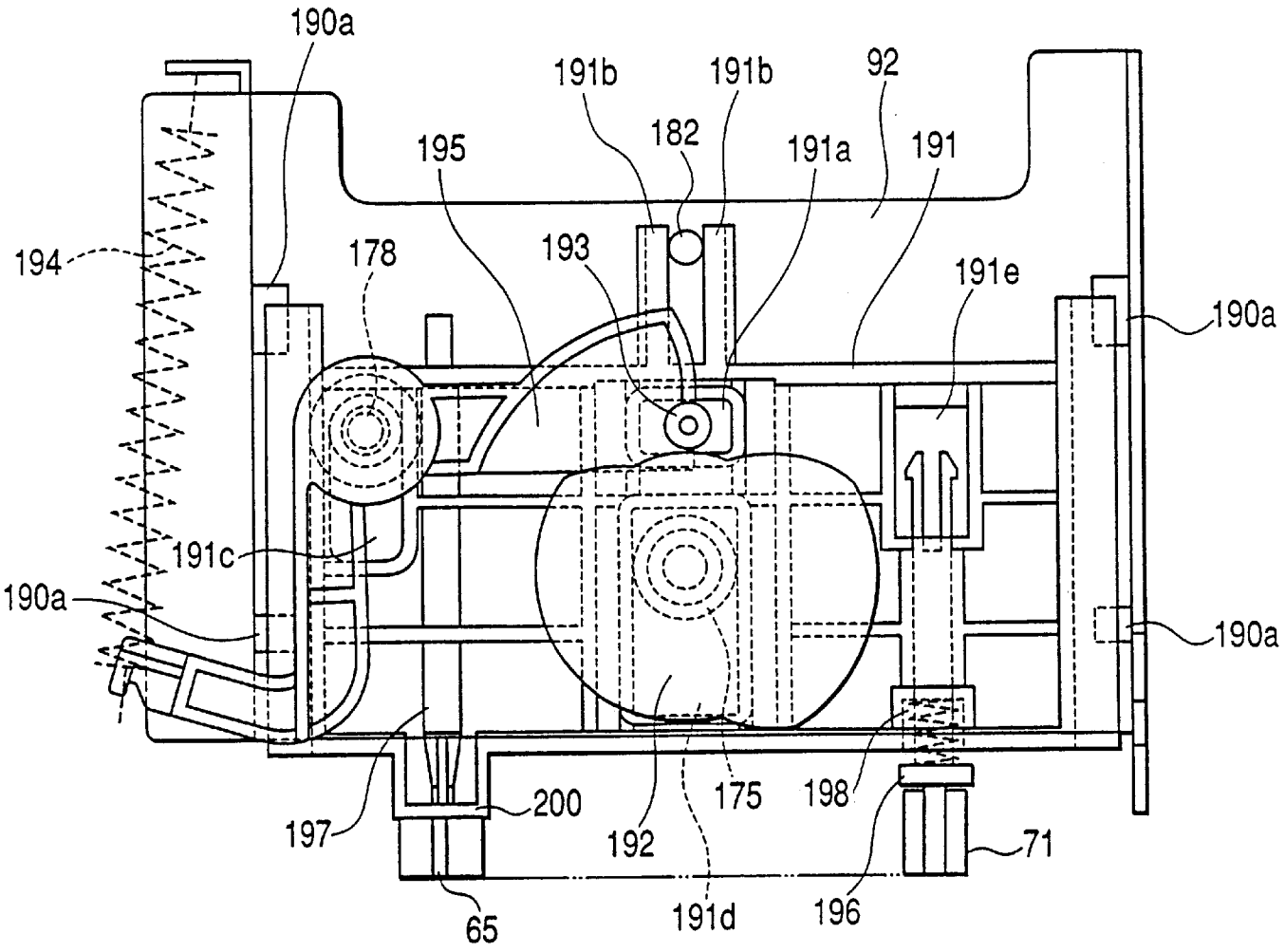

When the slide plate 191 thus arrives at a lower position, as shown in FIG. 35, the closing member 196 first abuts the air introduction valve 71 (see FIG. 6) of the valve unit 60 provided in the sub-tank unit 4, and at the stage where the slide plate 191 further moves downwardly in the state, the closing member 196 presses and first closes the air introduction valve 71 against the compressed spring 197, then when the slide plate 191 further moves downwardly, as shown in FIG. 36, the valve connection part 200 of the connection suction passage 197 communicates with the valve member 110' and communicates with the ink storage chamber 44. The flow passage for connecting the sub-tank unit 4 and the record head 5 is closed by the ink supply valve 70 by a member (not shown) as in the above-described embodiment.

In this state, if negative pressure is supplied from the pressure reducing pump 11, pressure in the ink storage chamber 44 is reduced because the float member 45 moves down due to ink near end, and ink is supplied up to an ink full state in the process similar to that described above.

When all ink storage chambers are filled with ink up to the predetermined level, the slide plate 191 moves upwardly and the connection mechanism and the valve unit 60 of the sub-tank unit 4 are disconnected from each other accordingly. In this process, the push rod 105 of the valve unit 60 is restored by the urge force of the coil spring 106 and first the valve is closed, next the closing member 196 opens the atmospheric communication port 65 via the air introduction valve 71.

According to the embodiment, since the valve 71 of the atmospheric communication port is opened and closed in conjunction with movement of the pump connection mechanism, special valve drive means such as a solenoid becomes unnecessary.

Figure 37:
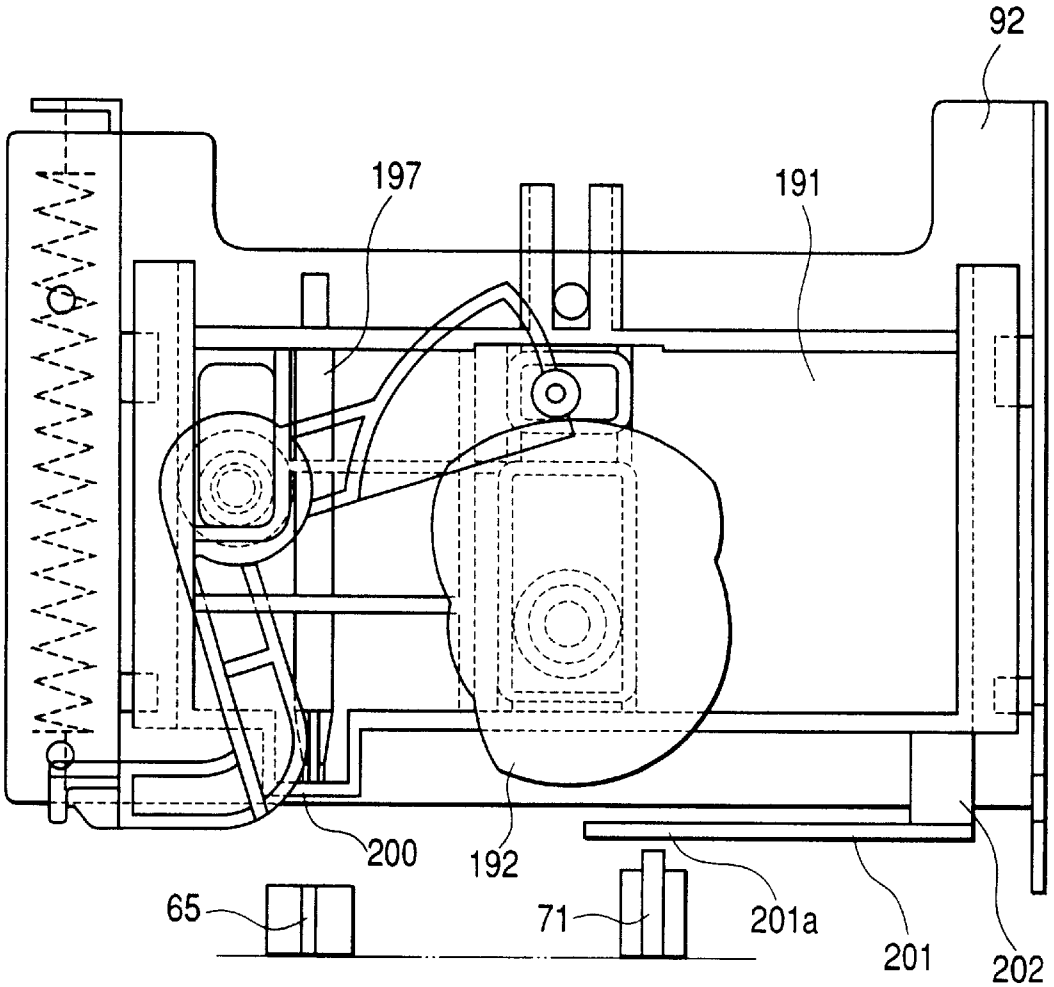
FIGS. 37 to 39 are side views to show other embodiments for opening and closing the atmospheric communication port.
Figure 38:
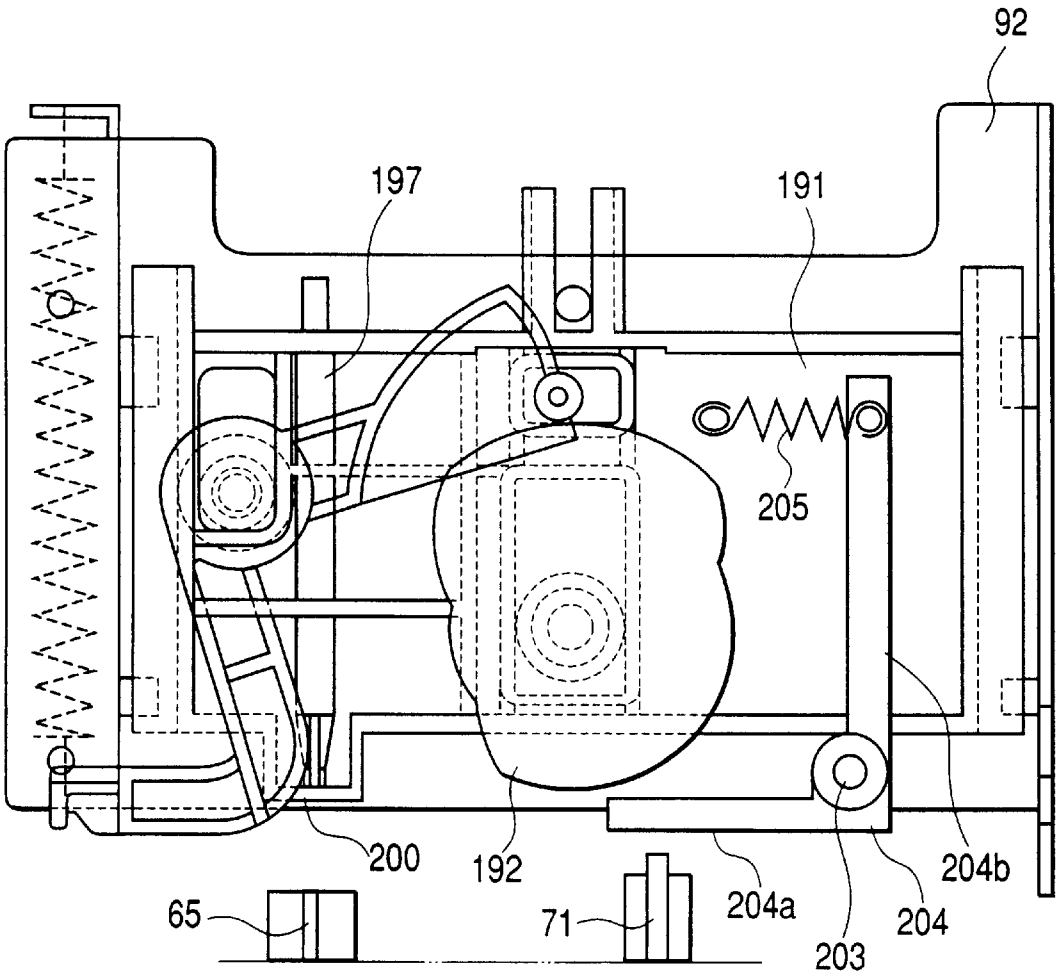

In the above-described embodiment, the atmospheric communication port opening and closing means is constructed as a vertically movable member urged by the coil spring 197. However, a similar effect is produced if a plate spring 201 is fixed by a fixture 202 like a cantilever beam at the lower end of the slide plate 191 and the air introduction valve 71 is operated by a free end 201*a* of the plate spring 201 as shown in FIG. 37 or if an L-shaped arm 204 is rotatably supported by a shaft 203 at the lower end of the slide plate 191, a horizontal part 204*a* is extended to the air introduction valve 71 side, and a horizontal part 204 is urged downwardly by a spring 205 through a vertical part 204*b* as shown in FIG. 38.

Figure 39:
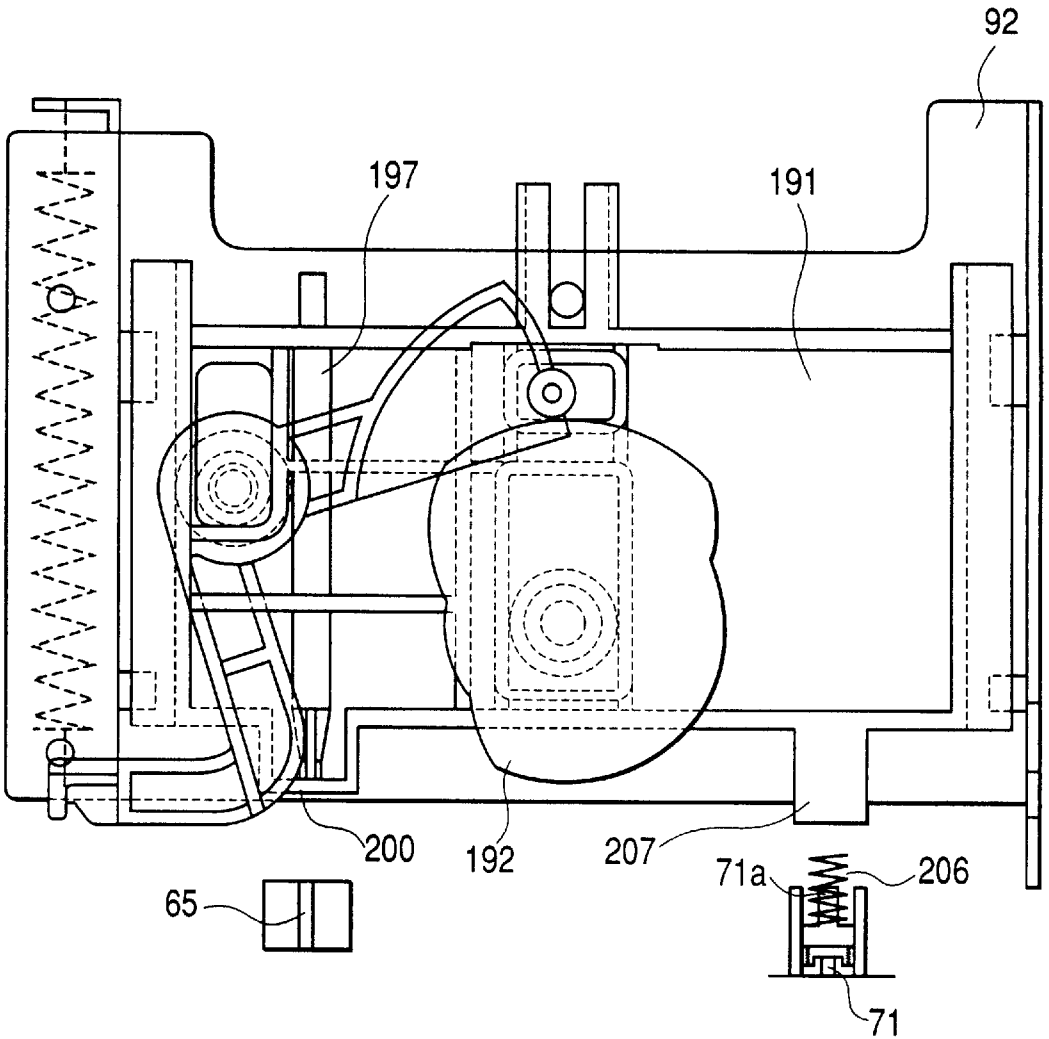

Further, a coil spring 206 may be provided at the upper end of the operation rod 71*a* of the air introduction valve 71 and on the other hand, a projection 207 may be formed in the corresponding area of the slide plate 191, so that the operation rod 71*a* of the air introduction valve 71 may be moved via the spring 206 by the projection 207, as shown in FIG. 39.

Figure 40:
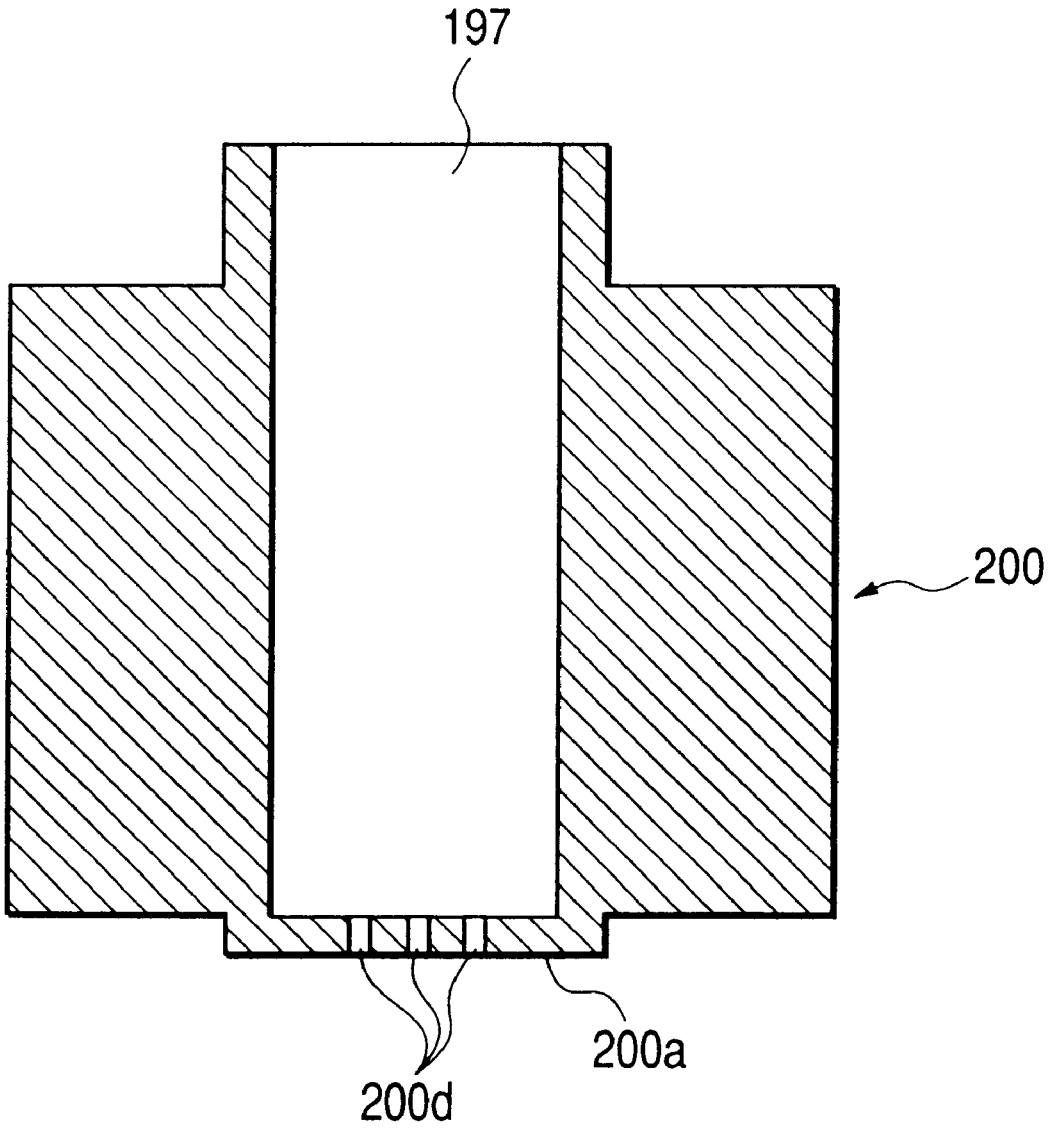
FIG. 40 is a sectional view to show a second embodiment of the communication port placed in the valve connection part on the ink supply stage side of the pump connection structure and FIGS. 41(A) and (B) are a sectional view and a bottom view to show another embodiment of the communication port placed in the valve connection part on the ink supply stage side of the pump connection structure.
Figure 41A:
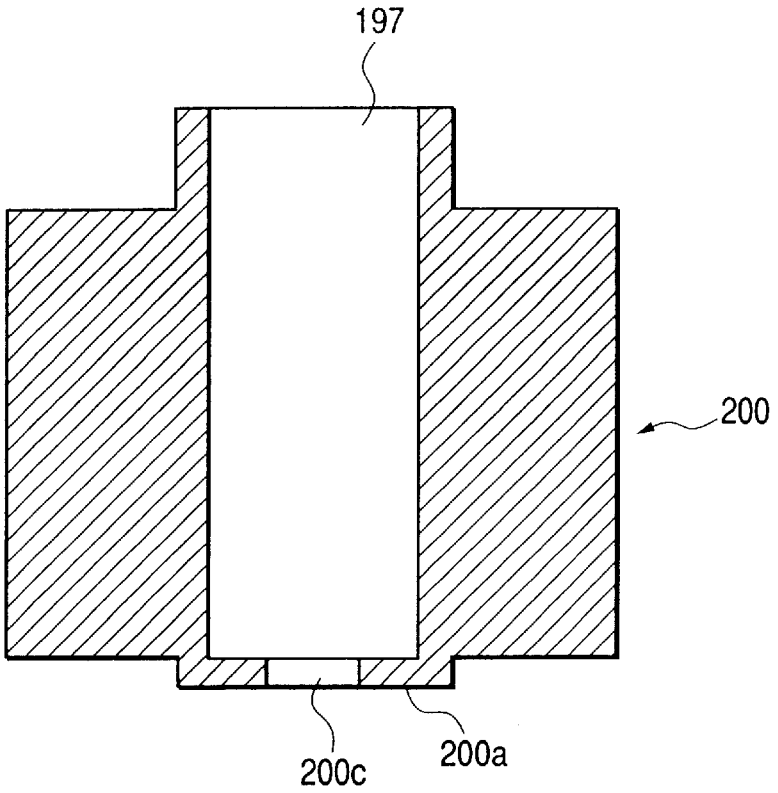
Figure 41B:
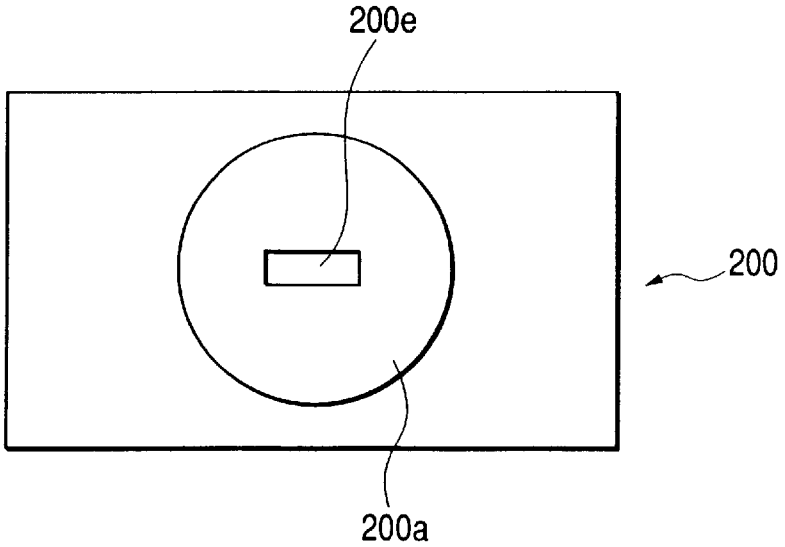

On the other hand, in the valve connection part 200 in the above-described embodiment, the single communication opening 200*b* is formed in the area not opposed to the protruded part 105*a* of the push rod 105. However, a similar effect is produced if a plurality of fine holes 200*d* are formed so that the protruded part 105*a* of the push rod 105 can be pressed or if a slit hole 200*e* narrower than the diameter of the protruded part 105*a* is formed, as shown in FIGS. 40 and 41.

Preferably, the air introduction valve 71 of the valve unit 60 is closed earlier than the suction connection passage 197 when the ink replenishing is performed, and the air introduction valve 71 of the valve unit 60 is opened earlier than the suction connection passage 197 after the ink replenishing is completed, as in the above-described embodiment. However, if they are closed or opened at the same time or at opposite timings, the ink supply operation is not hindered.

Next, a preferred control mode will be discussed.

If the ink storage chamber 44 is brought into an ink end state and required to be filled with ink, the ink supply valve 70 is closed, and after the expiration of a predetermined time the pressure reducing pump 11 is operated. Since this allows negative pressure to act on the ink storage chamber 44 in a state in which communication between the record head 5 and the ink storage chamber 44 is inhibited, it is possible to avoid the meniscus on the nozzle openings from being destroyed by sucking air through the nozzle openings.

At the stage where replenishment of ink to the ink storage chamber 44 is complete, the air introduction valve 71 is opened, and if the ink storage chamber 44 becomes atmospheric pressure, then the ink supply valve 70 is opened. This makes it possible to avoid the meniscus of the nozzle openings from being destroyed by sucking air through the nozzle openings of the record head.

The items can also be controlled by adjusting the operation timings of the pressure reducing pump 11, the ink supply valve 70, and the air introduction valve 71.

During printing, the ink supply valve 70 and the air introduction valve 71 are maintained open to supply ink to the record head, and the valves 69 and 66 are maintained closed.

If printing terminates and power supply is shut off, the ink supply valve 70 is closed to inhibit communication between the ink storage chamber 44 and the record head, thereby preventing evaporation of the ink solvent and suppressing an increase in the ink viscosity. The air introduction valve 71 is closed to prevent the ink solvent from volatilizing from the atmospheric communication port 65, and both the valves 69 and 66 are maintained closed.

When power supply is again started, the air introduction valve 71 is opened so that the ink storage chamber 44 is restored to atmospheric pressure, and then the ink supply valve 70 is opened. This avoids destruction of the meniscus of the nozzle openings caused by the difference between the pressure in the ink storage chamber 44 and the atmospheric pressure.

If means for detecting the difference between the pressure in the ink storage chamber 44 and the atmospheric pressure is provided and the air introduction valve 71 is automatically opened when a given or more difference occurs between the pressure in the ink storage chamber 44 and the atmospheric pressure even in a state in which power supply is shut off, the ink leakage from the sub-tank 40 and the damage can be prevented.

Figure 42:
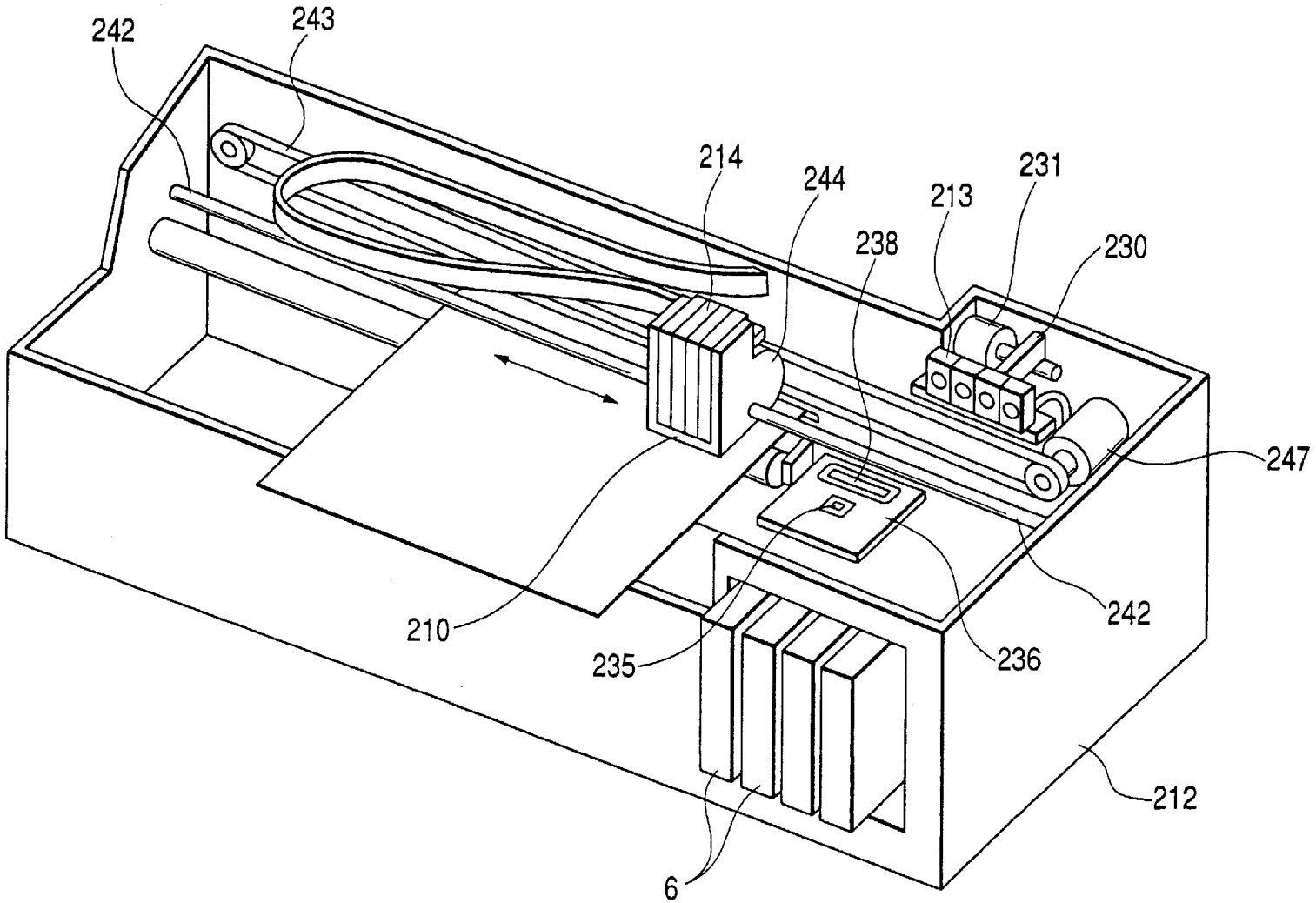
FIG. 42 is a perspective view to show another embodiment of an ink jet recording apparatus of the invention and FIG. 43 is a perspective view to show the main part of a record mechanism in FIG. 42.

In a full color ink jet recording apparatus shown in FIG. 42, a carriage 210 is provided with a sub-tank unit 214 for temporarily storing yellow ink, cyan ink, magenta ink, black ink, etc., and ink cartridges 6 as main tanks are installed in a housing 212. Both of them are momentarily connected together by a reciprocating coupler 213 so that ink can be supplied from the ink cartridges 6 to the sub-tank unit 214.

Figure 43:
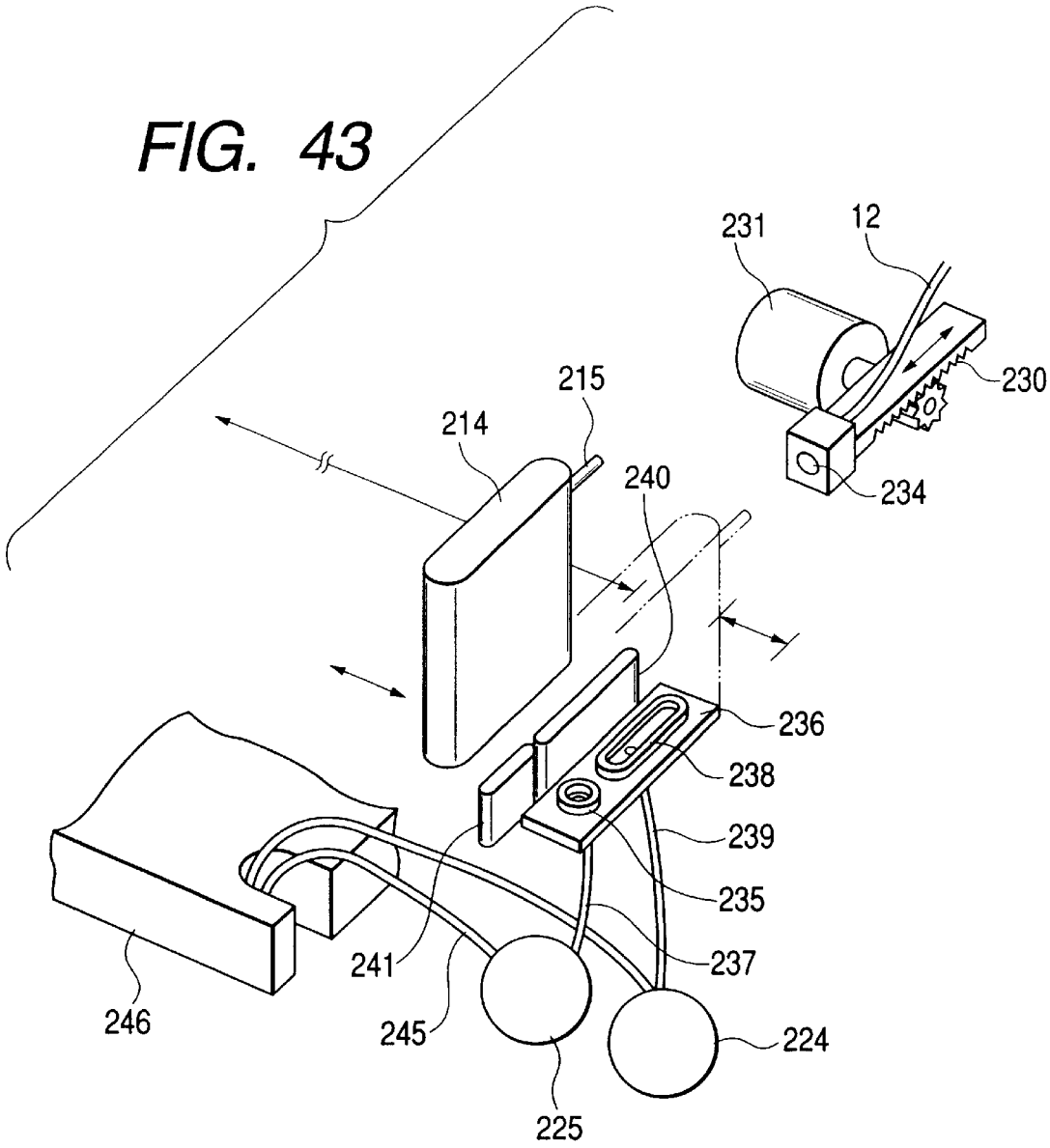
Figure 44:
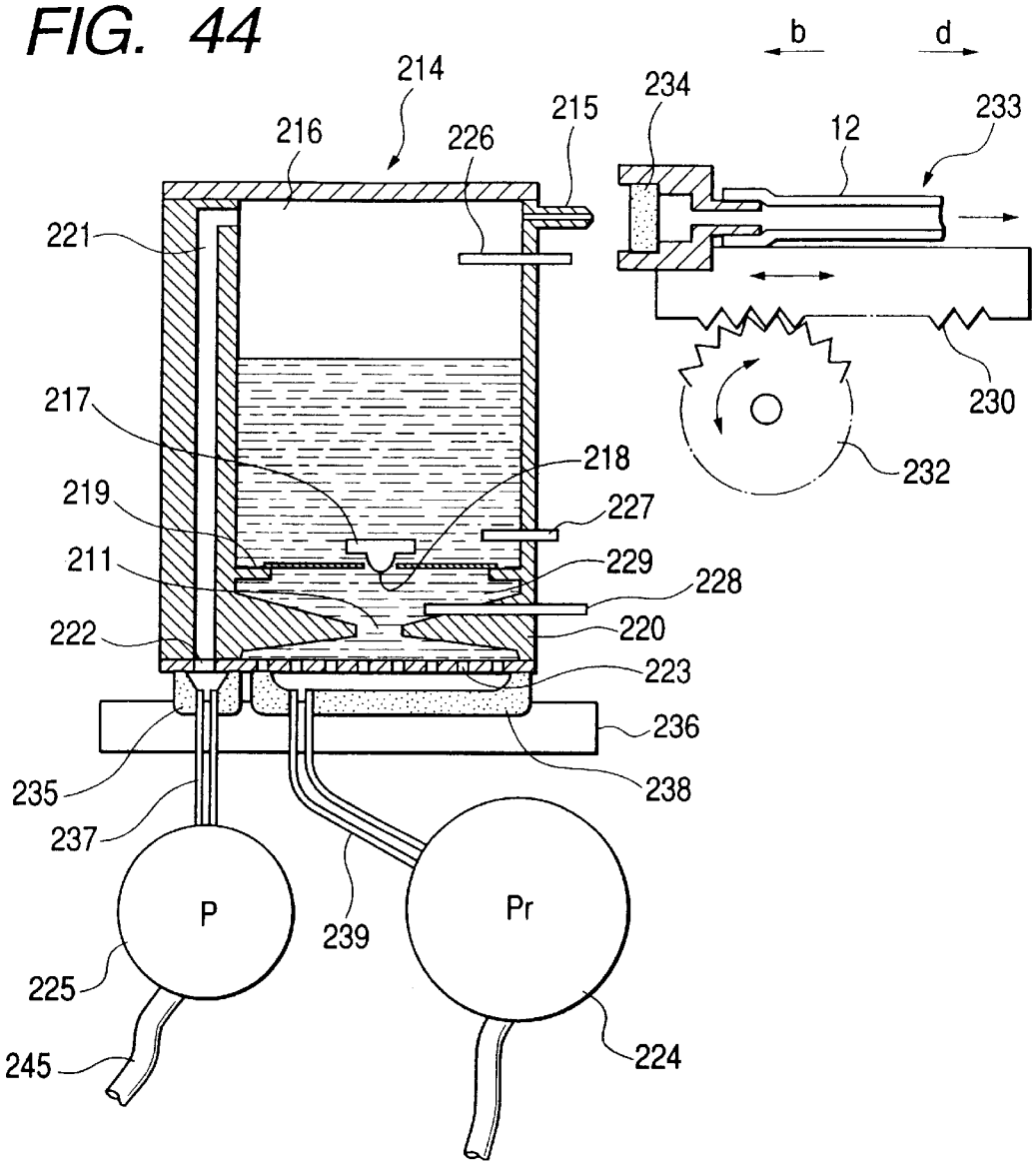
FIG. 44 is a sectional view to show one embodiment of sub-tank unit, replenishment means, and recovery means.

FIG. 43 shows an outline of a print mechanism and FIG. 44 shows one embodiment of the sub-tank unit 214. In a case 214, an ink storage chamber 216 for receiving ink injected from the ink cartridge 6 through an injection needle 215 is formed, and a valve body 217 and a diaphragm 219 having an ink flow hole 218 forming a check valve mechanism in corporation with the valve body 217 are arranged in a lower area to form a second ink storage chamber 229 for supplying ink to a record head 220 while suppressing pressure change as much as possible.

The check valve mechanism made up of the valve body 217 and the diaphragm 219 opens the ink flow hole 218 to supply ink to the second ink storage chamber 229 if the pressure in the lower area of the diaphragm 219 is lowered. When negative pressure acts on the ink storage chamber 216, the diaphragm 219 moves upwardly to close the ink flow hole 218. A specific structure of the check valve mechanism is shown, for example, in JP-A-8-174860, etc.

The injection needle 215 described later and the upper end of a suction passage 221 extended up and down are opened at the top of the ink storage chamber 216. The lower end of the suction passage 221 is formed in a non-print area of the record head 220, for example, in the proximity of the outside of nozzle openings 223 as a suction port 222. The nozzle openings 223 and the suction port 222 can be connected to a recovery pump 224 and a replenishment suction pump 225 described later.

In FIG. 44, electrodes 226 and 227 for detecting the upper and lower limits of the ink liquid level are arranged in the ink storage chamber 216, and a common electrode pin 228 is arranged in the second ink storage chamber 229, so that the upper and lower limits of the ink remaining amount in the ink storage chamber 216 can be detected based on the resistance values between the electrodes 226 and 227 and the common electrode pin 228.

The ink cartridges 6 store inks separately so as to correspond to the sub-tank units 214, and are connected to the reciprocating couplers 213 by tubes 12.

The reciprocating coupler 213 is provided with a rubber seal 234 hermetically attached to and detached from the injection needle 215 at the tip side of a reciprocating mechanism 233 made up of a rack 230 moving relative to the injection needle 215 projected from the sub-tank unit 214 and a pinion driven by a motor 231.

A suction port cap 235 that can engage the suction port 222 of the sub-tank unit 214 by a drive mechanism (not shown) is fixed to the surface of a base 236, and is connected to a suction pump 225, i.e. the replenishment means, by a tube 237.

A nozzle cap 238 connected to the recovery means 224 by a tube 239 is disposed on the base 236, and a nozzle cleaner 240 and a suction port cleaner 241 are juxtaposed to the side thereof. The nozzle cap 238 is made to communicate with a waste ink absorption material 246 via an exhaust pipe 239, and the recovery pump 224 is disposed on the exhaust pipe 239, so that ink can be absorbed.

The carriage 210 can be reciprocated on a guide shaft 242 laterally extending in a frame 212, and is driven to a record position or a replenishment, recovery position through a drive belt 243 by drive means 247. The sub tank unit 214 is provided on a holder 244 mounted on the carriage. The record head 220 and the suction port 222 are exposed to the lower face of the carriage 210, and can be confronted with an ink supply position or a recovery processing position selectively by moving the carriage 210.

Figure 45:
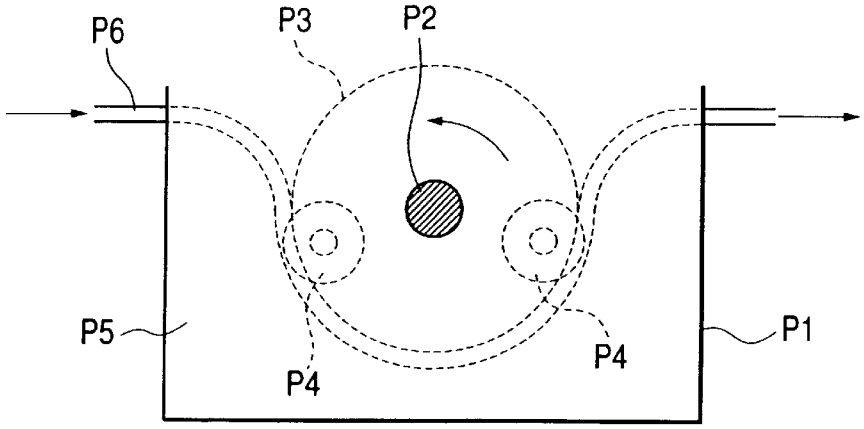
FIG. 45 is a side view to show one embodiment of a suction pump.

The replenishment pump 225 and the recovery pump 224 are designed as follows: As shown in FIG. 45, a rotation plate P3 is fixed onto a drive shaft P2 rotatably supported on a support frame P1 a pair of rollers P4 are loosely mounted on the rotation plate P3 so that the outer peripheries thereof are partially projected outwardly of the rotation plate P3, a tube P6 is arranged along a guide frame P5, and the drive shaft P2 is rotated by drive means (not shown) to move the position where the roller P4 presses the tube P6, thereby deforming and flattening the tube P6 partially, and thus generating suction pressure.

Next, the operation of replenishing the sub-tank unit 214, in which ink is consumed by continuing record processing, with ink from the ink cartridge 6 will be discussed based on a flowchart shown in FIG. 46.

If consumption of ink in the ink storage chamber 216 is detected by the electrode pin 227 for detecting the lower limit in the sub-tank unit 214 and an ink replenishment command is issued, the position of the carriage 210 is detected and whether or not the carriage is at the ink replenishment position is determined (S1). If the carriage is not at the home position (H), the carriage 210 on the guide shaft 242 is moved to the home position (H) so that the injection needle 215 of the sub-tank unit 214 is confronted with the rubber seal 234 of the reciprocating coupler 213 (S2).

In this state, the suction port 222 and the suction port cap 235 are joined, then the replenishment pump 225 is driven (S3).

Next, the reversible motor 231 of the reciprocating coupler 213 is started to rotating the pinion 232, so that the rubber seal 234 of the reciprocating coupler 213 is advanced in the arrow (B) direction to the needle 215 therein, thereby connecting the sub-tank unit 214, i.e. a sub tank unit, and the cartridge 6, i.e. a main tank (S5).

When they are connected, the replenishment pump 225 communicating with the sub-tank unit 214 has already been in an activated state for Tb time, thus even if the rubber seal 234 is opened, replenishment with ink is started smoothly without allowing ink to flow backward into the ink cartridge 6 leading to entry of air.

Pressure in the sub-tank unit 214 is reduced and ink flows into the sub-tank unit 214 via tube 12 from the ink cartridge 6. So long as the ink amount in the ink storage chamber 216 does not reach the upper limit value, replenishment with ink is continued over required replenishment time TS (S7) and if ink in the ink storage chamber 216 is detected by the electrode 226 for detecting the upper limit (S6), the reversible motor 231 is operated to retreat the reciprocating coupler 213 in the arrow (d) direction, thereby detaching the rubber seal 234 from the needle 215 and disconnecting the sub-tank unit 214, i.e. the sub tank unit, from the cartridge 6, i.e. the main tank (S9).

Then, after the pump 225 is driven for required time Ta, namely, the time for which ink remaining in the passage between the inside of the ink storage chamber 216 of the sub-tank unit 214 and the suction port 222 and in the needle 215 can be discharged (S10), the pump 225 is stopped. This makes the apparatus ready for record processing in a state in which clogging, etc., is prevented.

On the other hand, if ink in the ink cartridge 6 becomes insufficient to complete the replenishing, an empty signal is generated to disconnect the sub-tank unit 214 and the onk cartridge 6 (S9), and after the ink cartridge 6 is replaced, the above-described operation is restarted to complete replenishment with ink.

By the way, in the ink replenishing, pressure in the ink storage chamber 216 becomes lower than that in the ink storage chamber 211, and thus the diaphragm 219 moves up and the ink flow hole 218 is closed by the valve body 217, so that back-flow of ink into the ink storage chamber 211 from the record head 220 is prevented and air bubbles can be prevented from entering the ink storage chamber 211 through the nozzle openings 223 as much as possible.

Since the nozzle openings 223 are sealed with the cap 238 during replenishing with ink, an increase in the ink viscosity in the nozzle openings 223 during replenishing with ink can be prevented.

The spout port of the pump 225 is made to communicate with the waste ink absorption material 246 by the tube 245 and if ink spray flows in or the ink amount exceeds the upper limit, ink can be absorbed in the waste ink absorption material 246.

Figure 47:
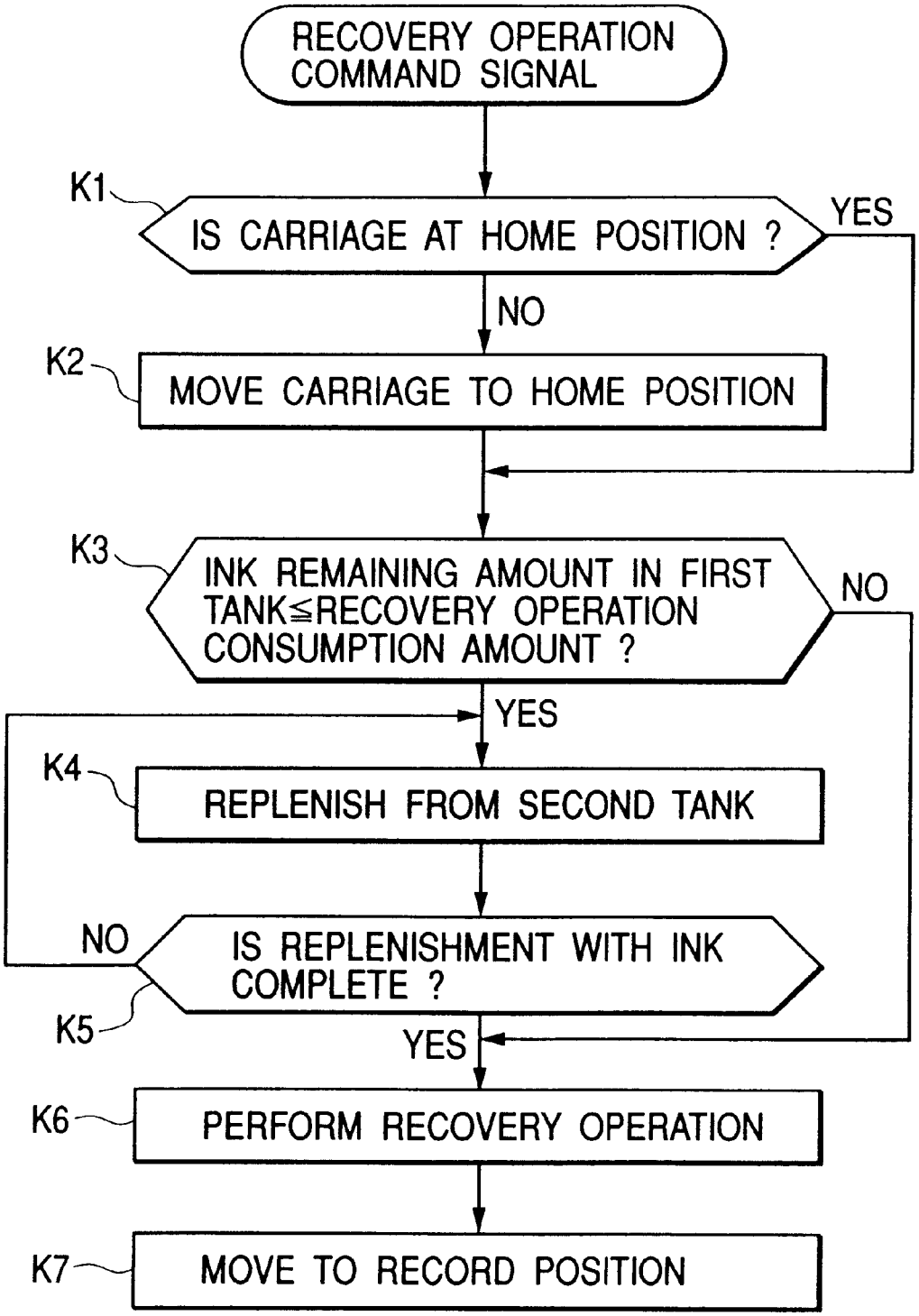

Next, recovery processing of the record head 220 will be discussed based on FIG. 47.

In response to a recovery processing command generated by an operator or generated based on a predetermined sequence, it is detected whether or not the carriage 210 is located at the home position (H), (K1) . If the carriage 210 is not at the home position (H), the carriage 210 is moved to the home position (H), (K2).

Next, the ink remaining amount resulting from subtracting the consumption amount of ink consumed by ejection and recovery operations from the ink full amount of the sub-tank unit 214 detected by the electrode pin 226 is compared with the ink consumption amount required for the recovery operation (K3), and if the remaining ink amount is greater than the amount of ink consumed by the recovery operation, a recovery operation command is given (K6). According to the command, the pump 224 is started and negative pressure is given to the nozzle openings 223 by the nozzle cap 238 to forcibly discharge ink from the record head 220, thereby executing recovery processing. After the recovery processing, the carriage 210 is moved to a record position (X), (K7)

On the other hand, if the remaining ink amount in the sub-tank unit 214 is less than the amount of ink consumed by the recovery operation, the sub-tank unit is replenished with ink from the ink cartridge 6, (K4), and it is detected whether or not the sub-tank unit has been replenished with ink until detection by the electrode pin 226 (K5). After the replenishment is completed, the above-described recovery processing is executed (K6).

Since recovery processing is performed only in the state in which sufficient ink exists, air bubbles can be prevented from entering the record head 220 during the recovery processing and an ink droplet ejection failure can be prevented.

Figure 48:
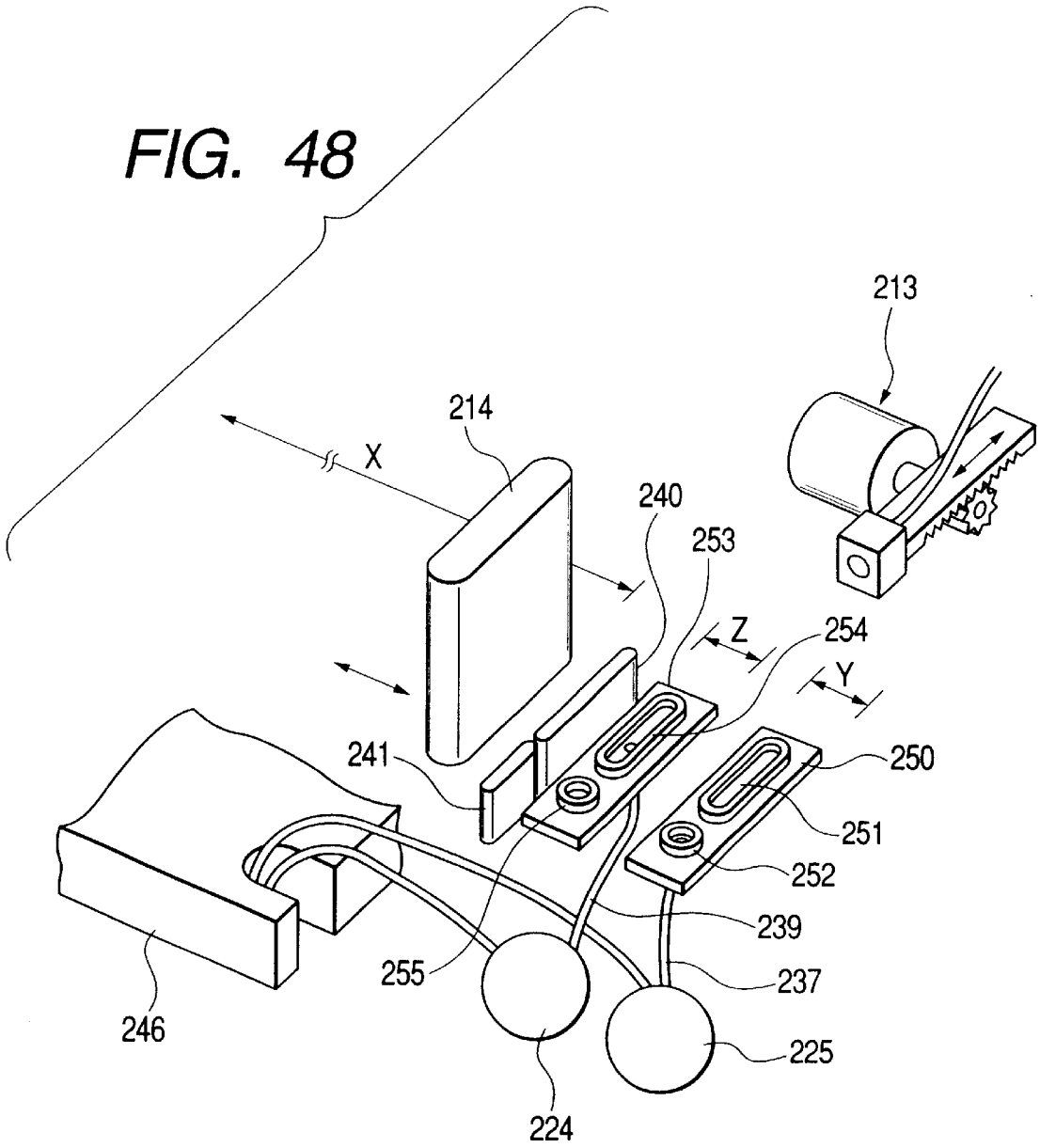
FIG. 48 is a perspective view to show another embodiment of the recording apparatus as the main part of a record mechanism and FIGS. 49 to 51 are flowcharts to show the ink replenishment operation and the recovery operation fitted to the record mechanism.

FIG. 48 shows another embodiment. In this embodiment, nozzle cap means are provided separately at two locations, a replenishment position (Y) at which a sub-tank unit 214 is replenished with ink and a recovery position (Z) at which ink is forcibly discharged from nozzle openings 223.

That is, a first base 250 at the replenishment position (Y) is provided with a nozzle cap 251 having a closed bottom, namely, in the form of a blind-hole plug, and a suction port cap 252 made to communicate with a replenishment pump 225 by a tube, and a second base 253 is provided with a nozzle cap 254 made to communicate with a recovery pump 224 by a tube 239 and a suction port cap 255 having a closed bottom, namely, in the form of a blind-hole plug.

According to the embodiment, the sub-tank unit 214 is replenished with ink at the replenishment position (Y), and is subjected to the recovery processing for the nozzle openings 223 at the recovery position (Z). When the recording apparatus is stopped, a carriage 210 is stopped at the recovery position (Z), and the nozzle openings 223 and the suction port 222 are respectively sealed with the nozzle cap 254 and the suction port cap 255.

On the other hand, if the sub-tank unit 214 is replenished with ink, the nozzle openings 223 are completely sealed with the cap 251 isolated from the outside, and therefore it is possible to more positively prevent dry on the nozzle openings 223 and back-flow of air during replenishing with ink.

Figure 49:
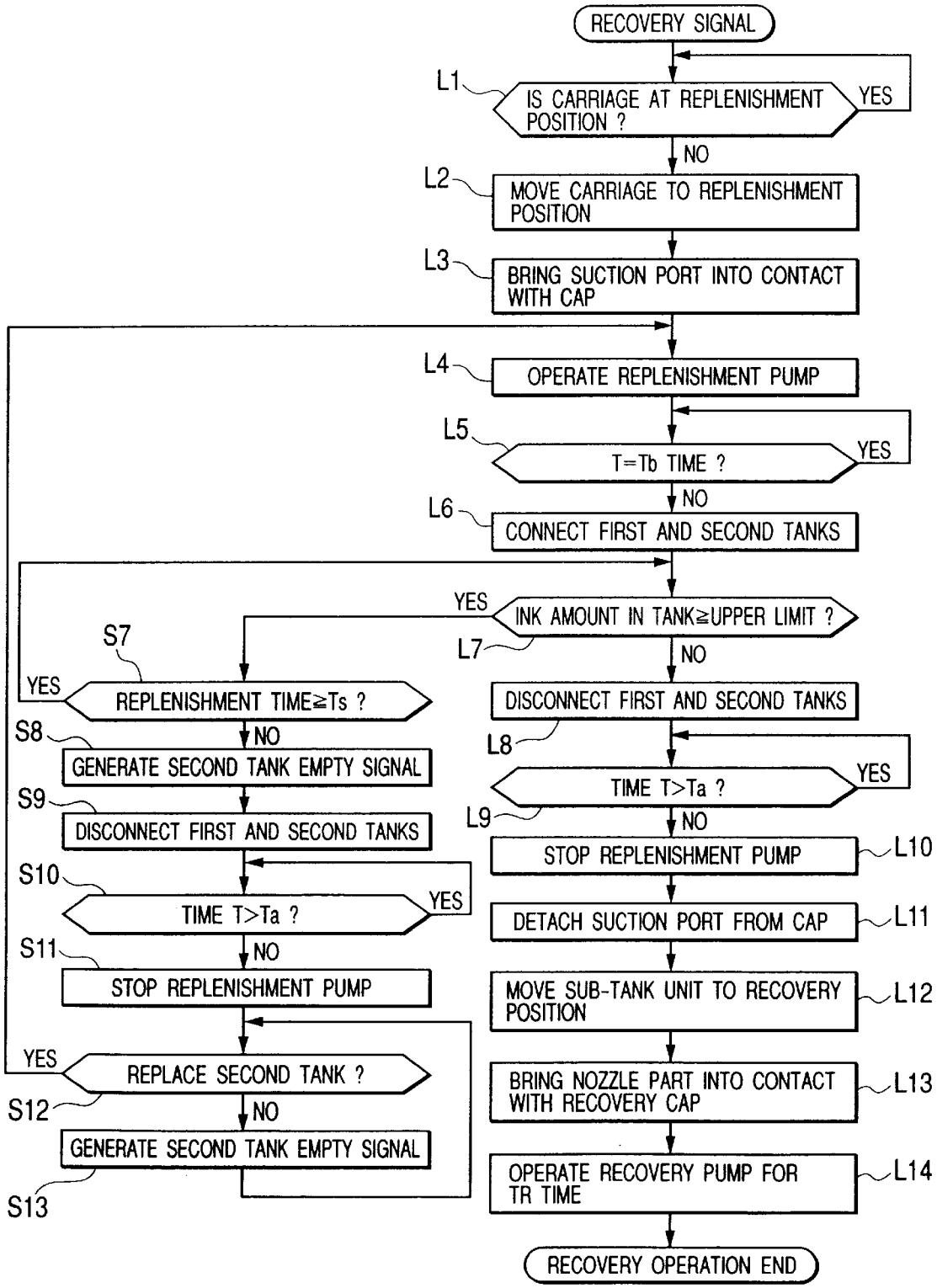

FIG. 49 shows the ink replenishment operation suitable for the recording apparatus of the embodiment. In response to a recovery command generated by an operator or generated based on a predetermined sequence, it is detected whether or not the carriage 210 is located at the position (Y), (L1), and the carriage 210 is moved to the replenishment position (Y) (L2). The operation for this is similar to that at steps S1 and S2 previously described with reference to FIG. 46.

Next, the suction port 222 is brought into intimate contact with the suction port cap 252 (L3), the replenishment pump 225 is operated (L4), if a predetermined time (Tb) has elapsed (L5), then a reversible motor 232 is operated to engage a rubber sheet 234 with a needle 215 in a state in which the pressure reduction state in the sub-tank unit 214 reaches a predetermined level, thereby connecting the sub-tank unit 214 and an ink cartridge 6 (L6).

The sub-tank unit 214 is replenished with ink and if a state in which the sub-tank unit 214 is replenished sufficiently with sufficient ink is detected by the upper limit detecting electrode pin 226 (L7), the rubber seal 234 is retreated to disconnecting the sub-tank unit 214 from the ink cartridge 6 (L8).

Next, after the expiration of a predetermined time (Ta) (L9), the replenishment pump 225 is stopped (L10), the suction port 222 is detached from the suction port cap 252 (L11), the sub-tank unit is moved to the recovery position (Z) (L12), and the nozzle openings 223 are brought into intimate contact with the nozzle cap 254 (L13). In this state, the recovery pump (Pr) 224 is operated to perform recovery processing for the nozzle openings 223 over required recovery time (TR) corresponding to the suction time (L14), and the recovery operation is completed. Next, it is returned to the record position (X) and the record operation is enabled.

Figure 46:
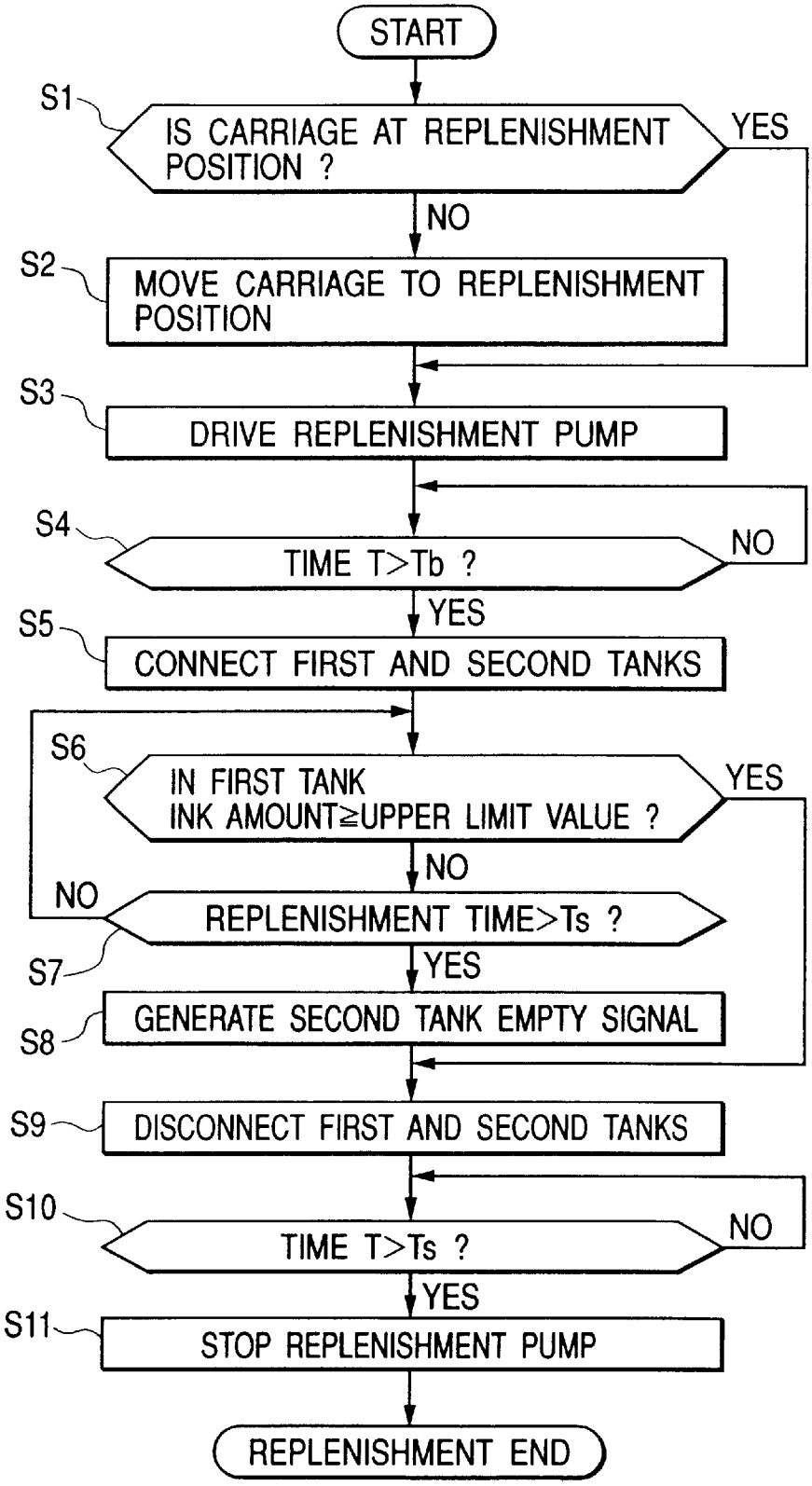
FIG. 46 is a flowchart to show the operation at the ink replenishing time in the recording apparatus and FIG. 47 is a flowchart to show the ink drop jet recovery operation of a record head.

In FIG. 49, if the ink amount in the sub-tank unit 214 does not reach the upper limit although the sub-tank unit is replenished with ink for Ts time, the operation (S7 to S11) previously described with reference to FIG. 46 is executed and an empty signal of the ink cartridge 6 is displayed (S8, S13) Upon completion of replacement of the ink cartridge, again control is returned to step L4 and the recovery processing is continued.

For good-quality print processing, it is indispensable to previously degas ink to be supplied to the sub-tank unit 214 sufficiently to reduce the dissolved air amount in the ink; however, it is also feared that air bubbles may be dissolved into ink in the sub-tank unit 214 during use, or in the flow passage, or the ink viscosity may rise due to drying, hindering recovery processing.

Figure 50:
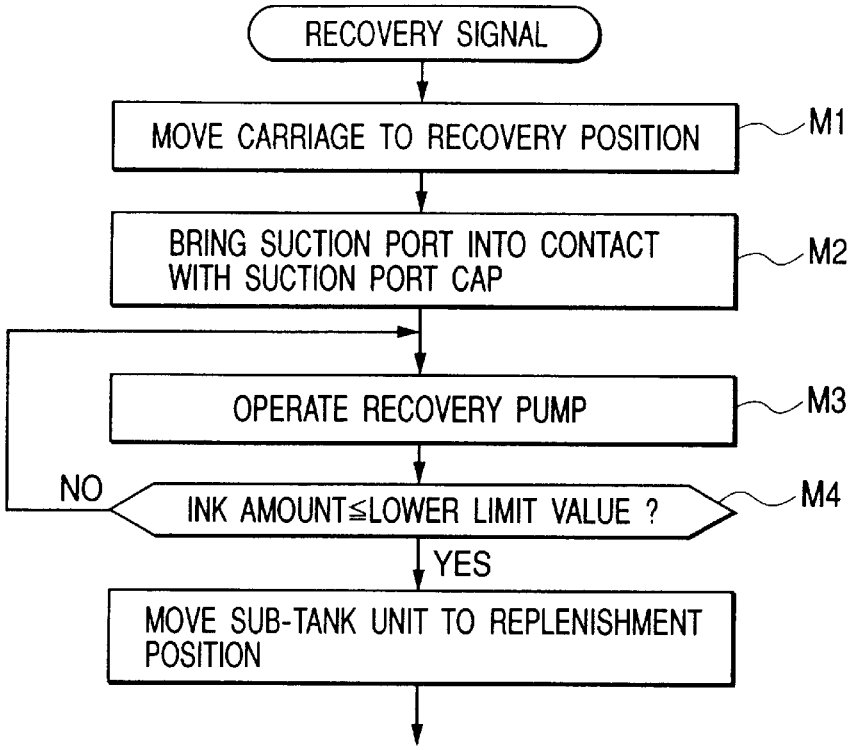

In such a case, the operation shown in FIG. 50 is executed. That is, before the recovery operation of the sub-tank unit 214 is performed, ink is preliminarily discharged to the minimum amount (lower limit value), and then the sub-tank unit 214 is replenished with ink to the maximum amount (upper limit value) from the ink cartridge 6, and thereafter the recovery operation is performed.

In FIG. 50, the carriage 210 is moved to the recovery position (Z) in response to a recovery signal (M1), the suction port 222 is brought into intimate contact with the suction port cap (M2), the recovery pump 224 is operated. (M3), and ink is discharged from the sub-tank unit 214 until detection of the lower limit value (M4).

Subsequently, the sub-tank unit 214 is moved to the replenishment position (Y) and is replenished with ink to the upper limit value from the ink cartridge 6, and then a recovery process similar to that described above is executed. According to this embodiment, the remaining ink in the sub-tank unit 214 is sufficiently discharged, degassed ink is supplied in a large amount from the ink cartridge 6, and therefore recovery processing can be made reliable to assure quality of subsequent print.

Figure 51:
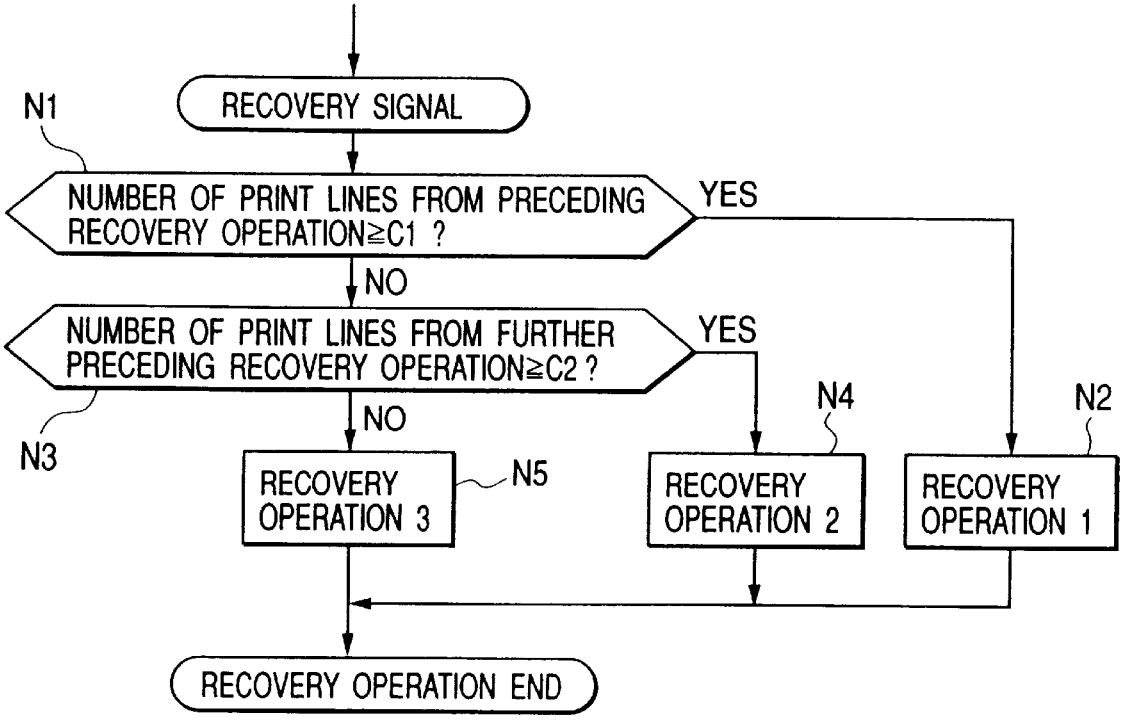

The recovery operation shown in FIG. 51 is a processing to be executed in a case where the ink droplet ejection capability of the record head 220 cannot be sufficiently recovered by normal recovery processing.

That is, in response to a recovery signal, it is detected whether or not the number of print lines after the preceding recovery operation is smaller than C1 (N1). If the number of print lines is not smaller than C1, normal recovery operation (1), namely, steps L12 to L14 in FIG. 47, is executed (N2).

If the number of print lines is smaller than C1, it is detected whether or not the number of print lines after the further preceding recovery operation is smaller than C2 (N3). If the number of print lines is not smaller than C2, recovery operation (2), namely, the operation with the recovery pump operation time TRat step L14 in FIG. 49 be prolonged is executed (N4).

If the number of print lines is smaller than C2, recovery operation (3), namely, the operation shown in FIG. 50 is executed (N5).

For example, the number of print lines C1 is 60 and C2 is 100, but the number of print sheets, the number of print characters, the print time, etc., can also be applied as C1 and C2 in place of the number of print lines.

While the recording apparatus is stopped, the carriage 210 is stopped at the recovery position (Z) and the nozzle openings 223 are sealed with the nozzle cap 251 and the suction port 222 is sealed with the suction port cap 252. While record is stopped, not only the nozzle openings 223 of the record head 220, but also the suction port 222 is capped. Accordingly, it is possible to prevent not only drying through the suction port 222, but also ink leakage occurring if the recording apparatus falls down. Further, during the replenishment of the ink to the sub-tank unit 214, the nozzle openings 223 are sealed with the nozzle cap 251 having a closed bottom, namely, in the form of a blind-hole plug, and during the recovery operation, the suction port 222 is covered with the cap 255 having a closed bottom, namely, in the form of a blind-hole plug. Accordingly, it is possible to reliably prevent drying of the nozzle openings 223 during the replenishment operation and the recovery operation, and also it is possible to prevent unnecessary air from flowing into the ink storage chamber 216 during the recovery operation.

By the way, since the sub-tank unit is designed to be suckingly replenished with ink by the action of negative pressure, the ink in the storage chamber may be brought into a degassed state to some, but not sufficient, extent. For example, it may be difficult to obtain a degassed degree to such an extent that air bubbles entering the record head are dissolved in ink.

Figure 52:
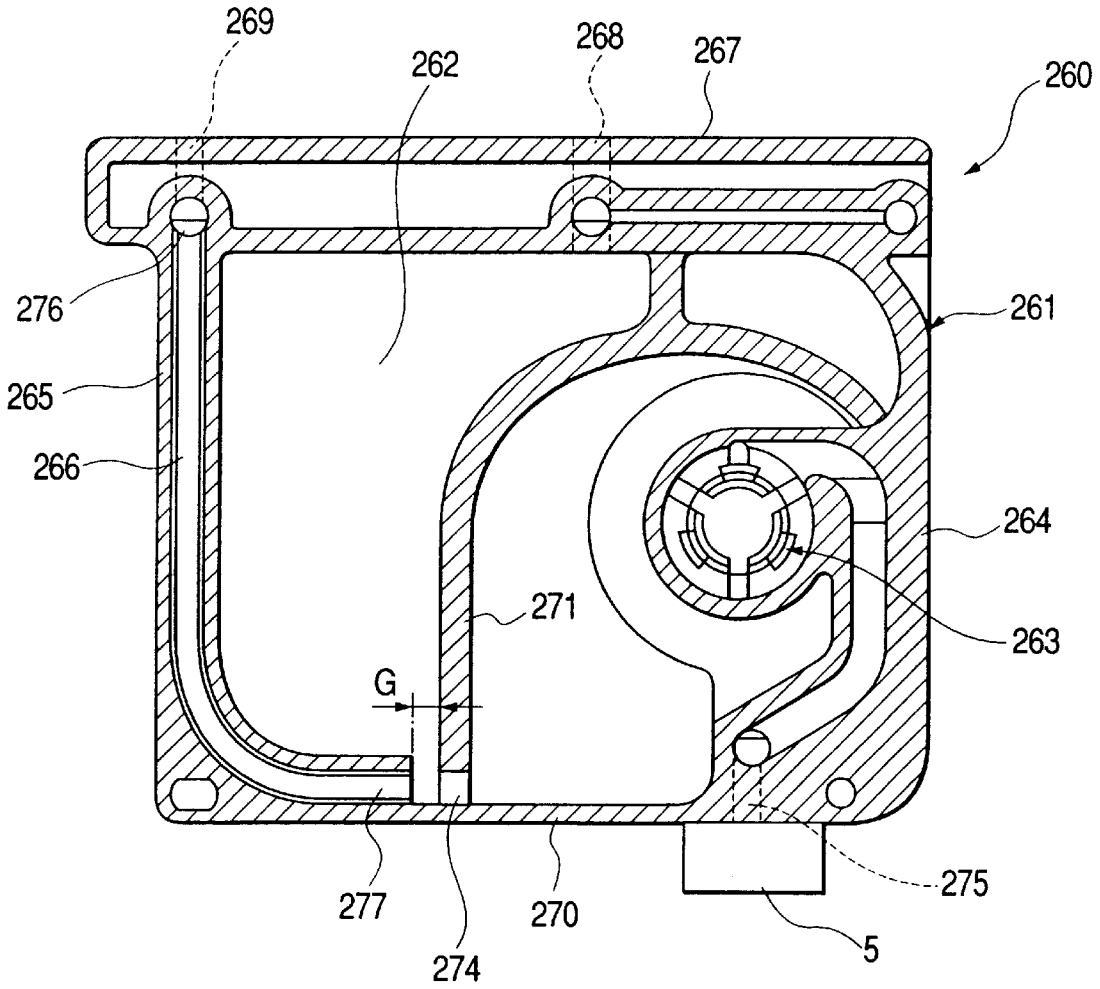
FIG. 52 is a longitudinal sectional view to show another embodiment of sub-tank unit of the invention and FIG. 53 is perspective views to show structures of both sides of the sub-tank unit.
Figure 53:
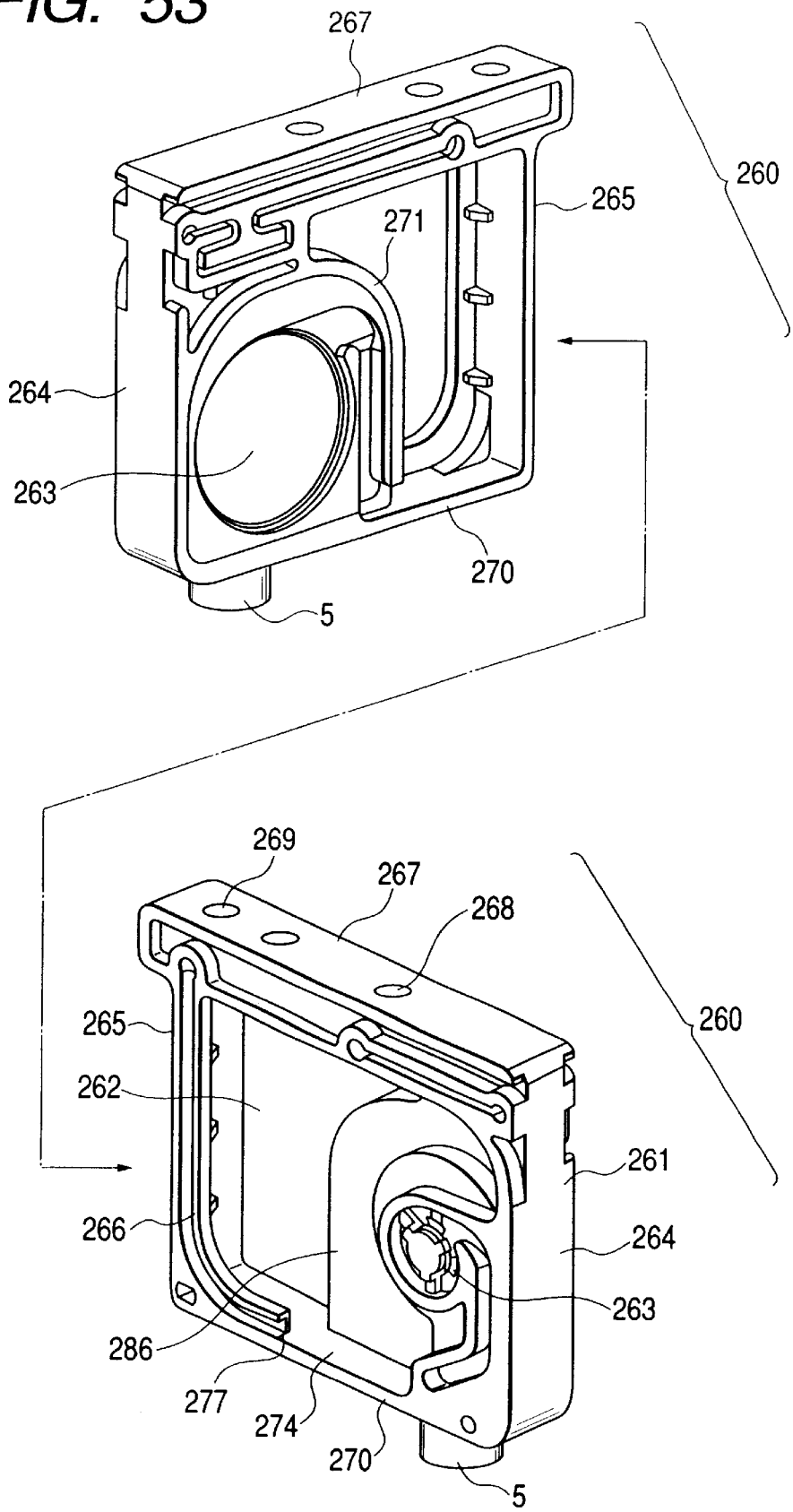

FIGS. 52 and 53 show another embodiment of sub-tank unit for solving such a problem. A sub-tank unit 260 is formed with an ink storage section 262 such that an unillustrated laminate film in which a metal layer extremely low in water vapor permeability and gas permeability is laminated on a polymer film is welded and attached to an opening in each of the sides of a casing 261 adopting a frame structure molded of a plastic material, etc. Negative pressure generation means 263 is disposed on a side of one side wall 264 to transport standby ink WI stored in the ink storage section 262 to the record head 5. Ink flow passage means 266 is formed on a side of the other side wall 265.

A ventilation hole 268 is formed in a top wall 267 of the casing 261, and a replenishment port 269 into which ink flows from the ink cartridge 6, i.e. the main tank, is formed to communicate with the upper end of the ink flow passage means 266. The record head 5 is fixed to a bottom wall 270 of the casing 261.

Figure 54:
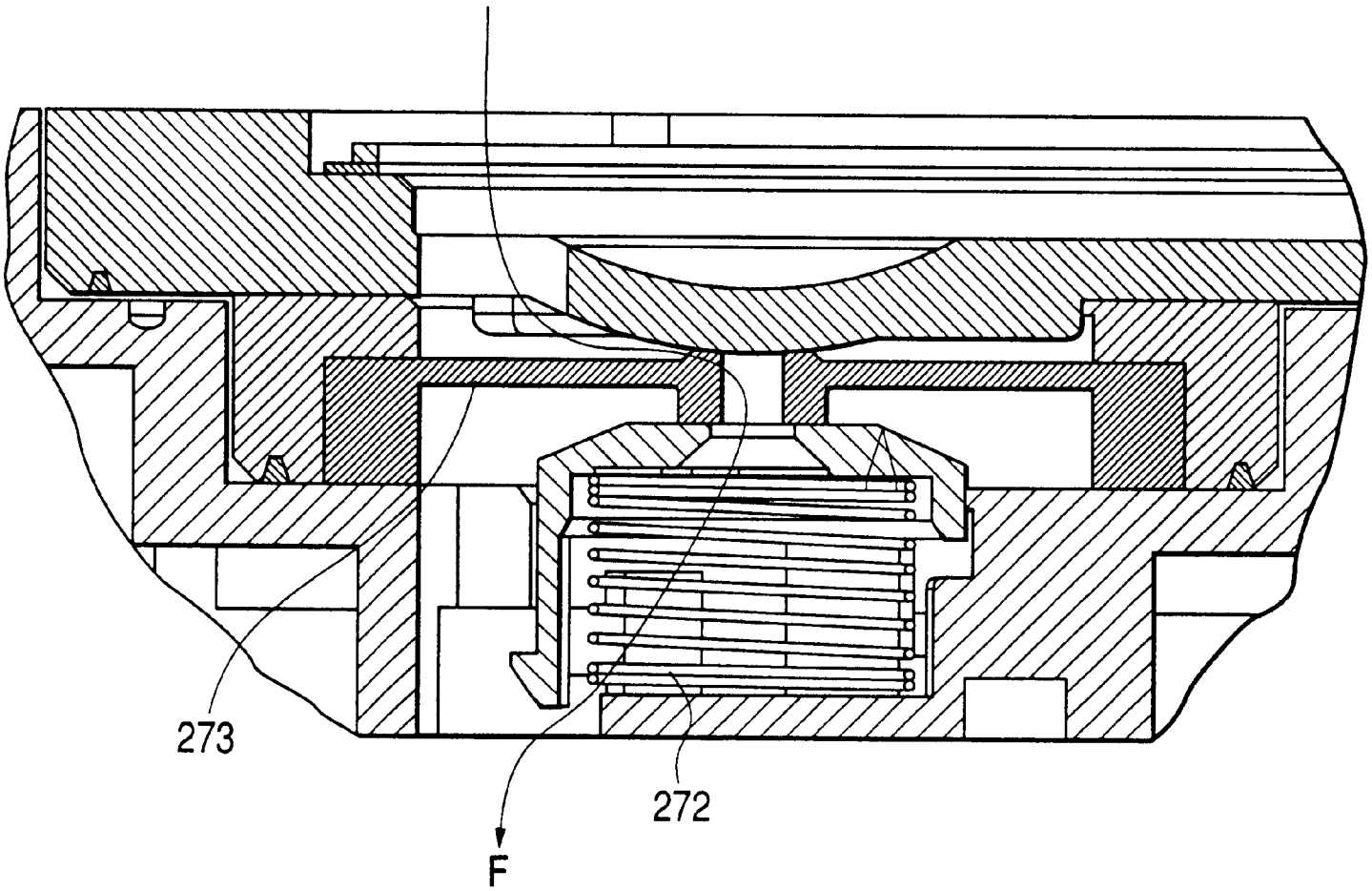
FIG. 54 is a fragmentary sectional view to show negative generation means of the sub-tank unit on an enlarged scale.

The negative pressure generation means 263 is separated from the ink storage section 262 by a partition wall 271, and designed so that standby ink WI or replenishment ink NI supplied from a flow-in port 274 in the bottom of the partition wall 271 is supplied through an ink passage 275 to the record head 5, using a valve 273 pulsated against a spring 272 as shown in FIG. 54 in response to pressure change produced by the print operation, etc., of the record head 5 ejecting ink droplets by drive means (not shown), such as piezoelectric means.

The ink flow passage means 266, which is bent roughly like an L letter, includes an introduction port 276 communicating with the replenishment port 269, a flow passage along the side wall 265, a traverse flow passage along the bottom wall 270 continuing the side wall 265, and a flow-out port 277 on the bottom wall 270 side, which is located close to the flow-in port 274 of the negative pressure generation means 263 with a given gap G.

Figure 55:
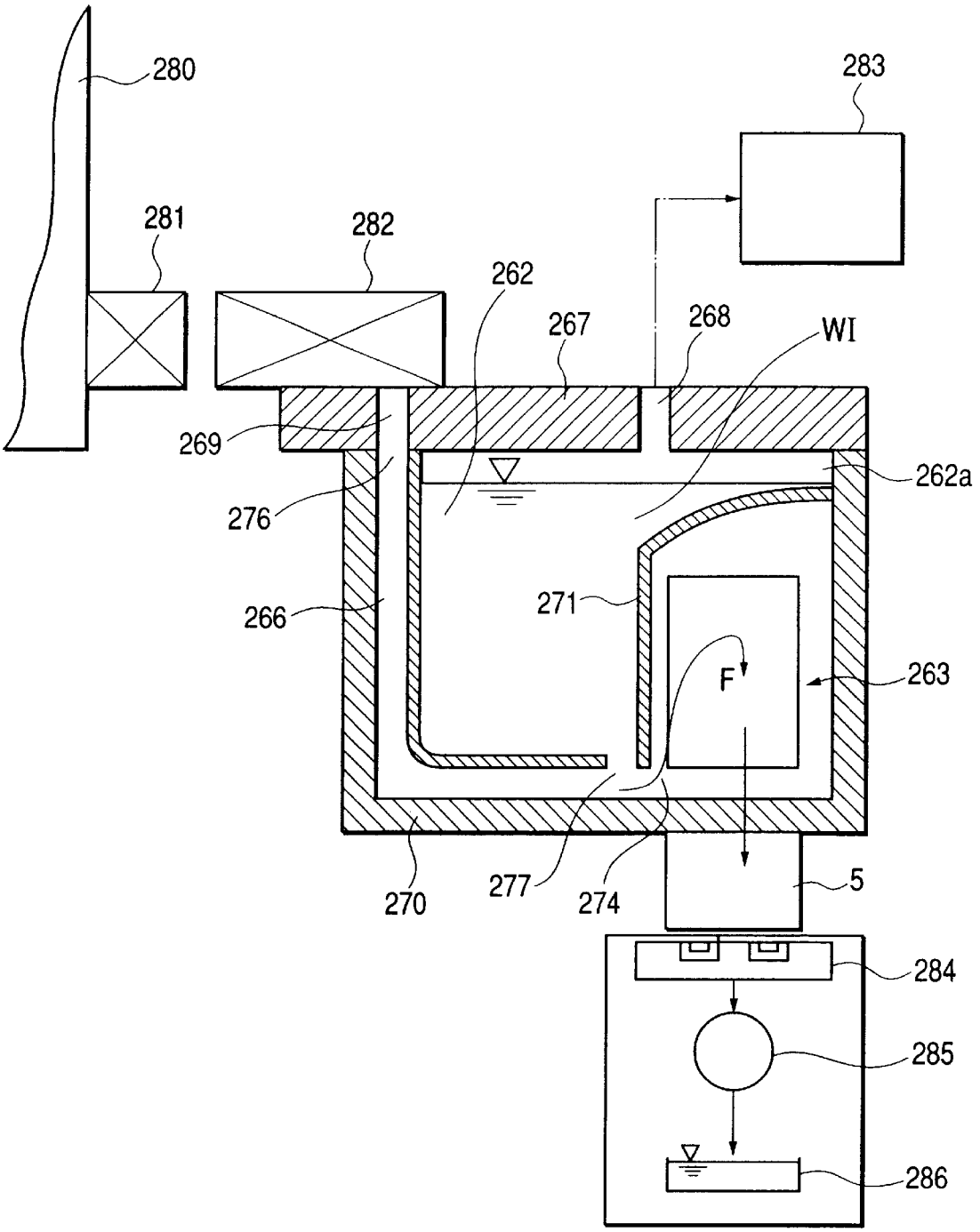
FIG. 55 is a drawing to schematically show a flow passage configuration at the ink replenishing time.

FIG. 55 shows an ink replenishment system for the sub-tank unit 260. A main tank 280 and the sub-tank unit 260 are provided with a first connector 281 and a second connector 282, respectively, that can be connected to each other. By connecting the first and second connectors 281 and 282 to each other, ink can be supplied from the main tank 280 to the sub-tank unit 260.

In the embodiment, standby ink WI in the ink storage section 262 of the sub-tank unit 260 is urged by the valve 273 pulsated against the spring 272 of the negative pressure generation means 263 to be transported from the flow-in port 274 to the negative pressure generation means 263, passes through the negative pressure generation means 263, and is supplied to the record head 5 through the ink passage 275 for printing.

If ink is consumed, the ventilation hole 268 is made to communicate with a suction pump 283 so that pressure in the space of an upper part 262*a* of the ink storage section 262 is reduced. In conjunction therewith, replenishment ink NI in the main tank 280 is allowed to flow into the introduction port 276 of the ink flow passage means 266 via the connectors 281 and 282 from the replenishment port 269 and is supplied to the ink storage section 262 through the flow-out port 277.

In this case, air entering the replenishment ink NI due to the connection operation of the connectors 281 and 282 becomes air bubbles in ink and flows into the ink storage section 262 to generating bubbles therein. However, since the flow-in port 274, i.e. an ink take-in port, is formed on the bottom wall 270, bubbles in a floating state are prevented from entering the negative pressure generation means 263.

To perform recovery processing when an ink droplet ejection failure occurs due to dust deposition on and around the nozzle (not shown) of the record head 5, generation of air bubble in a head pressure generation chamber (not shown), etc., the flow passage configuration shown in FIG. 55 is also formed, the nozzle openings are sealed with a cap 284, and a suction pump 285 is operated. With this process, ink is forcibly discharged from the record head into the cap 284 and is stored in a waste ink tank 286.

In this process, since the flow-out port 277 of the ink flow passage means 266 is confronted with and located closely to the flow-in port 274 of the negative pressure generation means 263 in the sub-tank unit 260, replenishment ink NI having a high degassed rate stored in the main tank 280 flows in taking precedence over standby ink WI in the ink storage section 262. As seen in FIG. 52, the ink flow-out port 277 is offset so as to have the given gap G from the flow-in port 274. Thus, if air enters the replenishment ink NI to form air bubbles, the air bubbles are moved through the gap G to the ink storage section 262 by a buoyant force, and cannot enter the negative pressure generation means 263.

The provision of an ink passage wall 286 makes it possible to more reliably remove air bubbles in ink. Needless to say, ink having a high degassed rate is high in capability of allowing air bubbles to be dissolved, and therefore air bubbles entering the record head 5 are allowed to be dissolved into ink, lowering of applied pressure for ejecting ink droplets is minimized, and ink droplets are ejected stably.

In the above-described embodiment, the electrode pin is arranged in the ink storage chamber to correspond to the ink-full liquid level so as to detect a state in which the ink storage chamber has been replenished with a predetermined amount of ink based on electrical resistance. The state may be detected based on pressure change in the ink storage chamber.

Figure 56A:
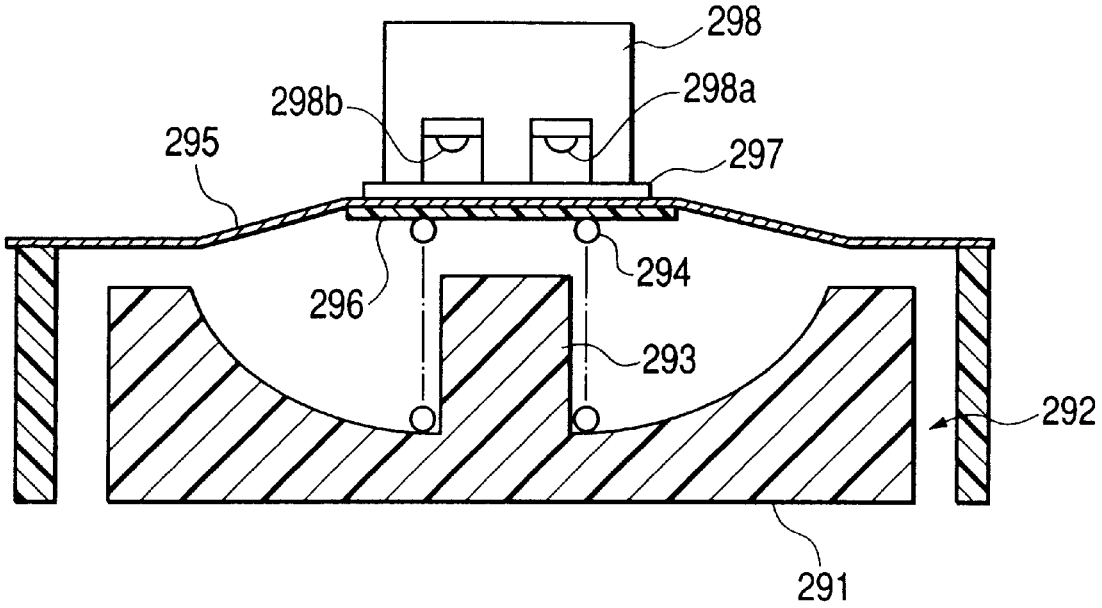
FIGS. 56(A) and (B) are sectional views to show an embodiment of a pressure detection unit as ink cartridge attachment detection means or ink full detection means in a normal pressure detection state and a negative pressure detection state.
Figure 56B:
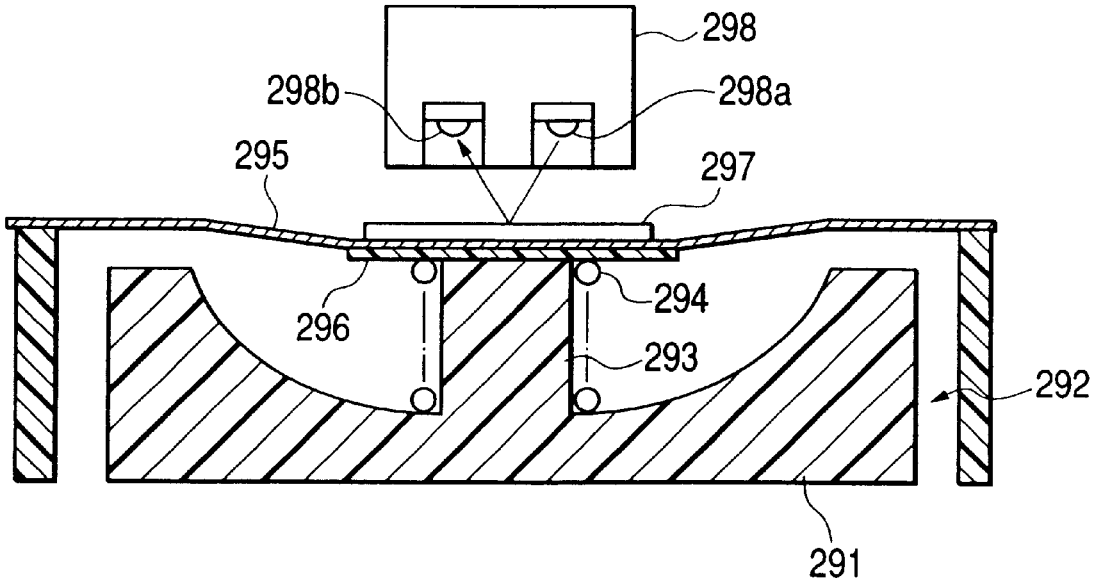

FIG. 56 shows an embodiment of a detection mechanism suitable for detecting an ink-full state in the ink storage chamber, or detecting whether or not the ink cartridge 6 is attached.

A main body 291 molded of a synthetic resin is formed with an ink flow passage 292 from side to side in the figure. The main body 291 is formed almost at the center with a guide projection 293, and a coil spring 294 is disposed surrounding the guide projection 293. Above the main body 291, a displacement member 295 molded of a flexible material is arranged above the main body 291 to seal an opening face in such a manner that the peripheral edge thereof is fixed, for example, by ultrasonic welding, etc. The member 295 forms a part of the ink flow passage 292 on the top side of the main body 291.

A resin plate 296 is adhered onto the lower face of the displacement member 295, and an end of a spring 294 abuts almost the center of the resin plate 296 to constantly urge the displacement member 295 upward. A reflection plate 297 formed of a material excellent in close contact property, such as rubber, with a white surface is adhered onto the surface of the displacement member 295.

On the other hand, a light sensor unit 298 forming displacement detection means for the displacement member 295 is disposed so as to face the reflection plate 297. The light sensor unit 298 is constructed such that a light emitting element 298*a* and a light receiving element 298*b* are disposed at positions where a light passage is formed when the displacement member 295 abuts the projection 293. Therefore, an electric signal from the light reception element 298*b* is turned off in a state in which the reflection plate 297 is in close contact with the unit 298, and the light reception element 298*b* senses light to provide an on-output in a state in which the reflection plate 297 is away from the unit 298.

Figure 57:
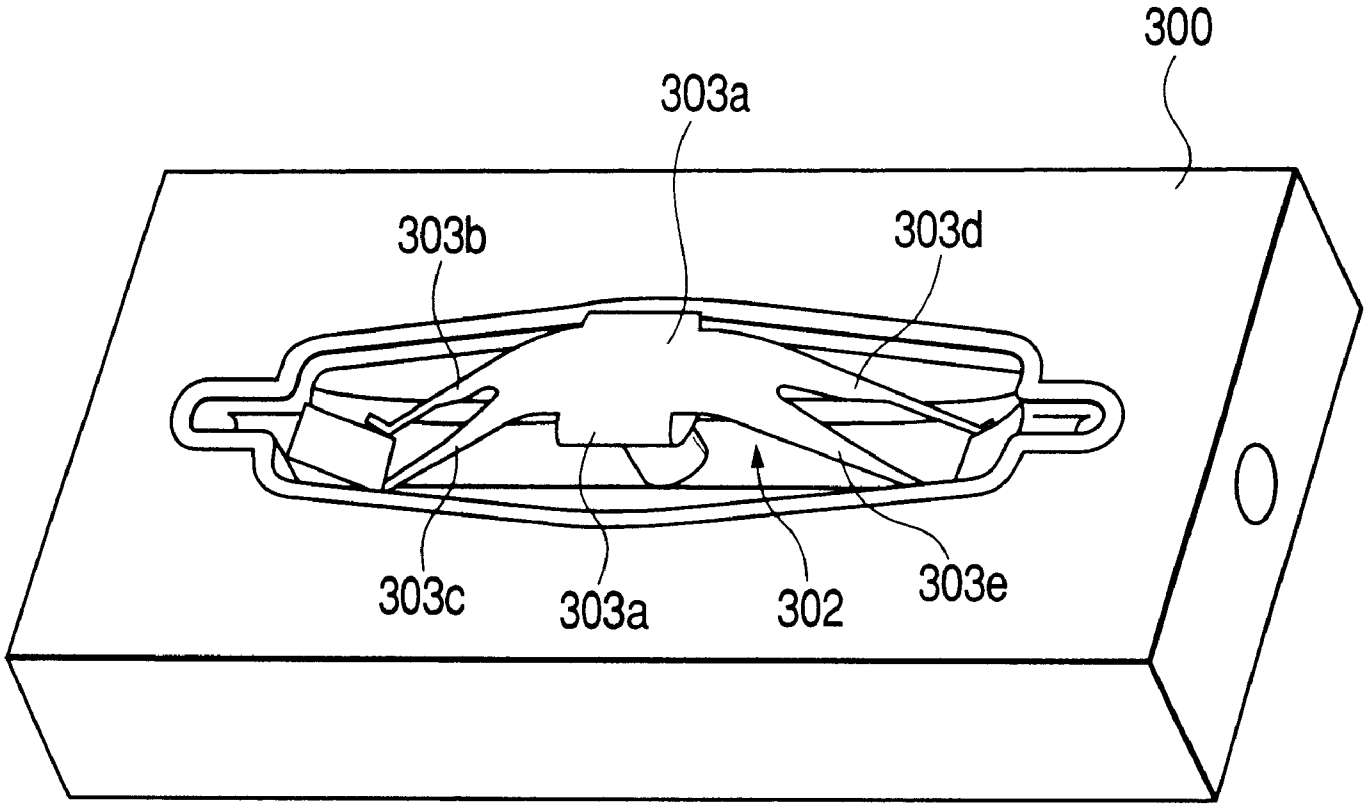
FIGS. 57 and 58(A) and (B) show another embodiment of pressure detection unit as ink cartridge attachment detection means or ink full detection means.
Figure 58A:
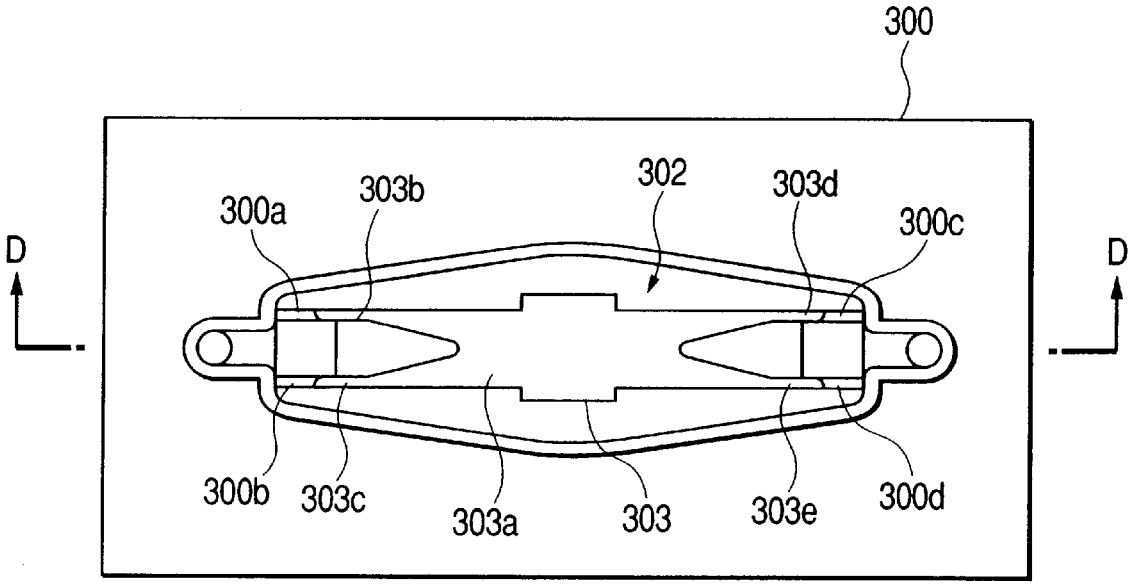

FIGS. 57 and 58(A) and (B) show another embodiment of an attachment state detection unit formed of pressure detection means. A main body 300 is formed with an ink flow passage 302 forming a part of an ink supply path from the ink cartridge 6 to the sub-tank unit 4 in the length direction of the main body 300. The ink flow passage 302 is formed in a bottom section with guide grooves 300*a* to 300*d* along the length direction, and a plate spring 303 is arranged in the guide grooves 300*a* to 300. The plate spring 303 is made up of a plate-like body 303*a* and four legs 303*b* to 303*e* extended integrally from the plate-like body 303*a*. The ends of the legs 303*b* to 303*e* are bent in a one-plane direction of the plate-like body 303*a*.

The tips of the legs 303*b* to 303*e* are assembled as a so-called four-leg state so that they are fitted into the guide grooves 300*a* to 300*d*.

Although not shown, like that shown in FIG. 56, a displacement member molded of a flexible material so as to wrap the upper face of the plate-like body 303*a* is attached, for example, by ultrasonic welding, etc. so as to seal the upper face of the main body 300. The displacement member forms a part of the ink flow passage 302 on the top side of the main body 300. Since the plate spring 303 is assembled as the four-leg state, the ink flow passage 302 can be formed between the legs 303*b* to 303*e*. As the displacement member, a film member having a high reflection factor, for example, an aluminum laminate film, is preferably used. A similar effect is produced if the displacement member is formed of a transparent film member, for example, without using the aluminum laminate film, and the plate-like body 303*a* forming a part of the spring member is provided with a reflection function. Although not shown, the above-described light sensor unit 298 is arranged so as to come in close contact with the displacement member covering the upper face of the plate-like body 303*a*.

Figure 58B:
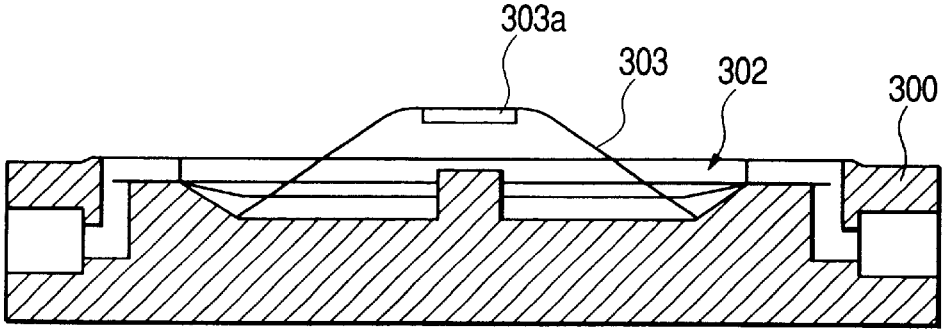

The operation of the attachment state detection units shown in FIGS. 56 to 58 will be discussed by taking the detection unit shown in FIG. 56 as an example. The attachment state detection unit is connected so that the flow passage 292 forms a part of the flow passage from the ink cartridge 6 to ink replenishment unit.

In this state, if the sub-tank unit 4 is connected to the ink replenishment unit and the pressure reducing pump 11 is operated, the sub-tank unit 4 enters a reduced pressure state after a predetermined time has elapsed. Consequently, the displacement member 295 of the attachment state detection unit is displaced and a signal is generated from the light sensor unit 298. On the other hand, if an ink cartridge is not attached, atmosphere flows in through an ink cartridge attachment port, thus pressure in the sub-tank unit 4 is not reduced and therefore no signal is output from the light sensor unit 298. Accordingly, attachment or detachment of an ink cartridge can be detected by monitoring the presence or absence of a signal from the light sensor unit 298.

To use the detection unit for detecting a state in which the sub-tank unit 4 has been replenished with ink to the full level, the strength of the spring 294 is set to such an extent that the spring pushes up the displacement member 295 in a state in which an ink cartridge is attached and ink flows into the ink storage chamber of the sub-tank unit and that the spring can be contracted upon direct reception of a suction force of the pressure reducing pump 11. According to this, in a state in which the valve member 62 is closed by the float member 45 in an ink-full state, namely, the tank has been replenished with ink to the full level, strong negative pressure of the pressure reducing pump 11 acts on the displacement member 295 and a signal can be output by the light sensor unit 298 in a similar manner to that described above.

Figure 59A:
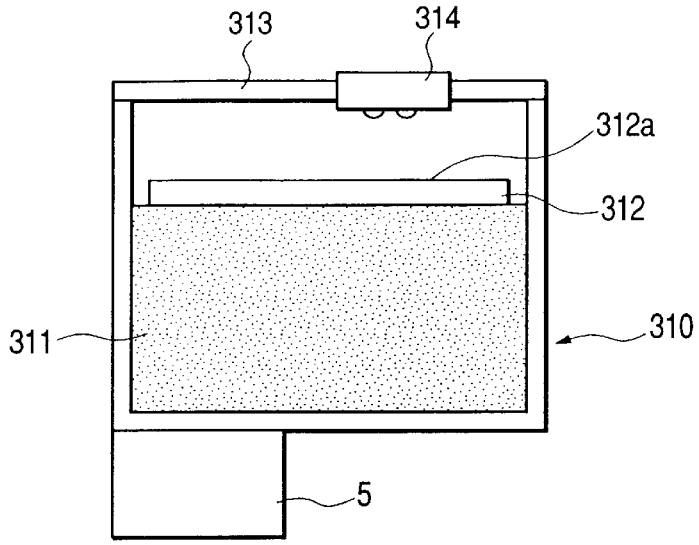
FIGS. 59(A) to (C) are sectional views to show embodiments of sub-tank units each having an ink full detection function.
Figure 59B:
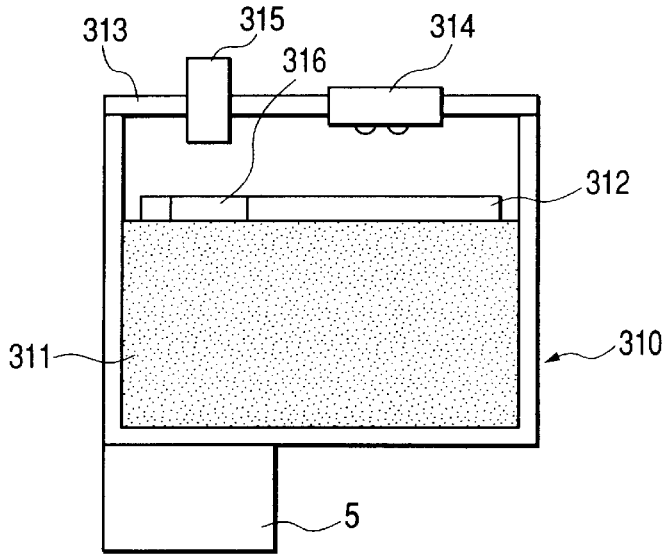

FIG. 59 shows other embodiments for detecting the ink amount in the ink storage chamber. As shown in FIG. 59(A), a float 312 may be housed movably in an ink storage chamber 311 of a sub-tank unit 310 provided with the record head 5 in a lower part, and means (contact 314 in this embodiment) for detecting a state in which the float 312 has arrived at a predetermined position due to fully filled ink may be provided in an upper part of the ink storage chamber 311 (in the embodiment, in a lid 313 of the sub-tank unit 310), so that the contacts 314 may be electrically connected to each other by a conductive layer 312*a* on the float 312.

To detect a state in which ink in the ink storage chamber 311 has been reduced to an ink near end, for example, the numbers of ink droplets ejected for print and the amounts of ink sucked by the recovery operation may be added up by calculation means, etc., for estimation. In ink replenishing, the ink supply amount is calculated, and the flow quantity of ink supplied depending on the ink level in the ink storage chamber 311 can also be adjusted by controlling the number of revolutions of the replenishment pump.

Preferably, a filter member 316 is disposed in an area of the float 312 facing an ink injection port 315, as shown in FIG. (B), for catching foreign materials such as air bubbles contained in supplied ink.

Figure 59C:
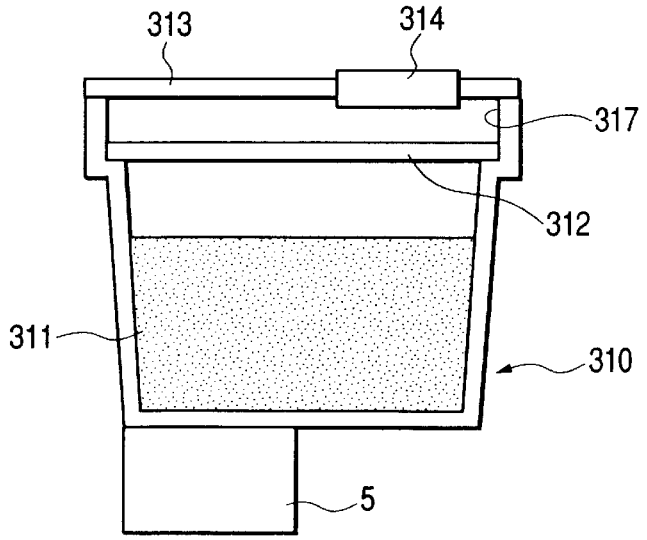

To prevent swinging of the float 312 in the ink replenishment, which may causes the lowering of the liquid level detection accuracy or chattering in a detection signal, it is preferable, as shown in FIG. 59(C), that a float guide part 317 is provided in an upper area to regulate the float 312 so that the float 312 can be moved only up and down.

Industrial Applicability

As described above, in the invention, the sub-tank unit has an ink injection port and an exhaust port communicating with an ink storage chamber via self-seal type valve means, and a valve mechanism for opening and closing the ink injection port or the exhaust port based on a liquid level of ink, and ink is supplied to the ink storage chamber by negative pressure produced by sucking air through the exhaust port. Therefore, the ink storage chamber can be forcibly replenished with a predetermined amount of ink for a short time period regardless of pressure in the ink storage chamber. Further, ink is degassed as much as possible by filling ink under reduced pressure, so that stable print can be executed.

If one container is divided into a plurality of ink storage chambers by a wall or walls, and different types of ink are stored in the respective ink storage chambers, all ink storage chambers can be automatically filled with degassed ink to a predetermined level by operating a common suction pump by forming the ink storage chambers of the same structure.

What is claimed is:

1. An ink jet recording apparatus comprising: a sub-tank unit, mounted on a carriage, for supplying ink to an ink jet record head; and an ink replenishment unit that is connected to a main tank installed in a housing and that is connectable to and disconnectable from said sub-tank unit, wherein said sub-tank unit includes:

an ink injection port and an exhaust port communicating with an ink storage chamber through self-seal type valve means; and a valve mechanism for opening and closing the ink injection port or the exhaust port based on a liquid level of ink;

wherein ink is supplied to the ink storage chamber by negative pressure of negative pressure generation means for sucking air through the exhaust port.

2. The ink jet recording apparatus as claimed in claim 1, wherein:

said sub-tank unit comprises a single container divided into a plurality of chambers by a wall or walls;

said sub-tank unit has, for each of the chambers, the ink injection port and the exhaust port communicating with the respective ink storage chamber through the self-seal type valve means, and the valve mechanism for opening and closing the ink injection port or the exhaust port based on the liquid level of the ink, wherein the ink is supplied to the respective ink storage chamber by negative pressure produced by sucking air through the exhaust port.

3. The ink jet recording apparatus as claimed in claim 1, wherein valve means closed by said ink replenishment unit is connected between said sub-tank unit and the record head.

4. The ink jet recording apparatus as claimed in claim 1, wherein the valve mechanism includes a float member.

5. The ink jet recording apparatus as claimed in claim 4, wherein the float member is movable vertically in a gravity direction with a support shaft arranged in said sub-tank unit as a rotation center.

6. The ink jet recording apparatus as claimed in claim 4, wherein the float member includes a box member that is formed by one side face and a peripheral side face molded integrally with the one side face to have an opening part in an opposite face side, and a plate-like lid jointed to the opening part of the box member close the box member.

7. The ink jet recording apparatus as claimed in claim 4, wherein the float member includes a quadrate volume body formed at a position away from a support shaft as viewed in a horizontal direction, and a trilateral volume body having a bottom face formed substantially linearly from a bottom face of the quadrate volume body to the support shaft side in the proximity of the support shaft.

8. The ink jet recording apparatus as claimed in claim 4, wherein the float member is formed with at least a pair of positioning pins, projected to respective outsides of the float member in a horizontal direction, each for holding a predetermined gap between the float member and an inner wall of said sub-tank unit.

9. The ink jet recording apparatus as claimed in claim 8, wherein each of the positioning pins is formed so as to hold a distance of at least 1 mm or more between the float member and the inner wall of said sub-tank unit.

10. The ink jet recording apparatus as claimed in claim 4, wherein the valve mechanism for opening and closing the exhaust port is located at an intermediate point between a center of gravity of buoyancy of the float member and the support shaft.

11. The ink jet recording apparatus as claimed in claim 4, wherein the valve mechanism for opening and closing the exhaust port closes an end face of a valve member in a horizontal state when the buoyancy of the float member reaches maximum buoyancy.

12. The ink jet recording apparatus as claimed in claim 1, wherein said ink replenishment unit includes an ink droplet discharge port communicating with the main tank through a self-seal valve, and an air suction port.

13. The ink jet recording apparatus as claimed in claim 1, wherein said sub-tank unit includes an atmospheric communication port, and said ink replenishment unit includes a valve for sealing the atmospheric communication port.

14. The ink jet recording apparatus as claimed in claim 1, wherein the valve mechanism for opening and closing the exhaust port is provided for each ink storage chamber, and wherein the negative pressure generation means is formed as a single unit.

15. The ink jet recording apparatus as claimed in claim 1 or 2, wherein an ink flow exit part of the main tank is positioned lower in gravity direction than the ink injection port of said sub-tank unit, or is adapted to cause negative pressure to act on the ink injection port.

16. The ink jet recording apparatus as claimed in claim 1, wherein the valve mechanism for opening and closing the exhaust port includes a flexible thin film forming a space communicating with the negative pressure generation means, and an opening that is formed in a part of the flexible thin film and that is closed by a seal member arranged on a float member when said sub-tank unit is filled with a given amount of ink, and wherein a communication part with the negative pressure generation means is sealed with the flexible thin film which is contracted upon the opening is closed by the seal member.

17. The ink jet recording apparatus as claimed in claim 1 or 16, wherein said sub-tank unit and said ink replenishment unit have alignment means capable of matching ink supply passages of both said sub-tank unit and said ink replenishment unit with each other when they are engaged with each other.

18. The ink jet recording apparatus as claimed in claim 17, wherein:

said ink replenishment unit is connected to the main tank by a tube and is arranged movably in a vertical direction and a horizontal direction, said sub-tank unit is mounted on the carriage so as to be moved to and stopped at a predetermined ink supply area, the alignment means includes a guide rib on an engagement side of said ink replenishment unit, and a guide member on said sub-tank unit, and said ink replenishment unit and said sub-tank unit are positioned to each other by contacting the guide rib with the guide member during movement of the ink replenishment unit to the sub-tank unit.

19. The ink jet recording apparatus as claimed in claim 18, further comprising:

guide means provided at at least two locations between said ink replenishment unit and an attitude maintaining member, each of the guide means including an elongated hole formed in a direction orthogonal to a movement direction, and a protruded part inserted slidably into the elongated hole, wherein said ink replenishment unit is supported movably relative to the attitude maintaining member in the direction orthogonal to the movement direction.

20. The ink jet recording apparatus as claimed in any of claims 18 to 19, wherein:

said ink replenishment unit is supported movably up and down by guide projections inserted into elongated grooves formed in a vertical direction at left and right end parts, and each of the elongated grooves in said ink replenishment unit are partially formed with a spread section to provide a predetermined allowance with respect to the guide projection during movement of said ink replenishment unit to said sub-tank unit.

21. The ink jet recording apparatus as claimed in any of claims 18 to 20, wherein the guide rib and the guide member forming the alignment means are arranged in orthogonal relation to each other to align said ink replenishment unit in one horizontal direction and in another horizontal direction orthogonal thereto.

22. The ink jet recording apparatus as claimed in claim 17, wherein:

said ink replenishment unit is supported movably in a direction orthogonal to a movement direction by an attitude maintaining member that is made movable in a vertical direction by at least a pair of support shafts, said ink replenishment unit is also supported by the support shafts in a state in which the support shafts are passed through elongated holes formed in parallel to the movement direction, and said elongated holes are partially formed with spread sections enlarged to provide a predetermined allowance with respect to the support shaft during the movement to said sub-tank unit.

23. The ink jet recording apparatus as claimed in claim 22, wherein said ink replenishment unit is driven in a vertical direction by a drive member that is engaged with an engagement hole formed in a part of said ink replenishment unit and that is moved up and down by the rotation operation of a cam member.

24. The ink jet recording apparatus as claimed in claim 23, wherein one of the pair of support shafts is a drive shaft for rotationally driving the cam member.

25. The ink jet recording apparatus as claimed in claim 1 or 26, wherein an ink supply valve is closed in a state in which power is off.

26. An ink jet recording apparatus, comprising:

a sub-tank unit, mounted on a carriage, for supplying ink to an ink jet record head; and an ink replenishment unit that is connected to a main tank installed in a housing by a conduit and that is connectable to and disconnectable from said sub-tank unit, wherein said sub-tank unit comprises a single container divided into a plurality of chambers by a wall or walls;

said sub-tank unit has, for each of the chambers, an ink injection port and an exhaust port communicating with a respective ink storage chamber through self-seal type valve means, and a valve mechanism for opening and closing the ink injection port or the exhaust port based on a liquid level of ink, wherein ink is supplied to the respective ink storage chamber by negative pressure produced by sucking air through the exhaust port.

27. The ink jet recording apparatus as claimed in claim 1 or 26, wherein the valve mechanism for opening and closing the exhaust port includes a valve member having a valve opening communicating with the negative pressure generation means, and a seal member, arranged on the float member, for opening and closing the opening of the valve member.

28. The ink jet recording apparatus as claimed in claim 27, wherein the valve mechanism for opening and closing the exhaust port is molded of a soft material, and the seal member is molded of a hard material.

29. The ink jet recording apparatus as claimed in claim 27, wherein the valve mechanism for opening and closing the exhaust port is molded of soft elastomer.

30. The ink jet recording apparatus as claimed in claim 27, wherein the valve member is formed into a trapezoidal shape in cross section in a vertical direction, and is formed at a center vertically with the valve opening communicating with the negative pressure generation means, and wherein the seal member abuts a short side portion of the trapezoidal shape in cross section.

31. The ink jet recording apparatus as claimed in claim 30, wherein the valve member is designed so that the valve opening communicating with the negative pressure generation means is enlarged in a triangular manner in cross section in a long side portion of the trapezoidal shape in cross section.

32. The ink jet recording apparatus as claimed in claim 30, wherein the valve member is molded integrally with an inner peripheral surface of an annular fixing member, and is attached to said sub-tank unit through the fixing member.

33. The ink jet recording apparatus as claimed in claim 30, wherein the valve member is surrounded by a tubular rib for preventing ink from being deposited.

34. The ink jet recording apparatus as claimed in claim 1 or 26, wherein said ink replenishment unit includes:

a slide plate moved up and down;

a connection suction passage formed on the slide plate, and connected at one end to the negative pressure generating means and at the other end to said sub-tank unit, and atmospheric communication port opening and closing means, formed on the slide plate, for opening and closing the atmospheric communication port.

35. The ink jet recording apparatus as claimed in claim 34, wherein up and down movement of the slide plate establishes a first state in which the connection suction passage is not connected to said sub-tank unit and the atmospheric communication port is opened, a second state in which the connection suction passage is not connected to said sub-tank unit and the atmospheric communication port is closed, and a third state in which the connection suction passage is connected to said sub-tank unit and the atmospheric communication port is closed.

36. The ink jet recording apparatus as claimed in claim 35, wherein the atmospheric communication port opening and closing means is formed at the same height as a tip part of the connection suction passage connected to said sub-tank unit, wherein the atmospheric communication port provided in said sub-tank unit is formed at a height different from that of a tip part of the suction passage on the sub-tank unit side, and wherein one of the first to third states is selected as the slide plate is moved up and down.

37. The ink jet recording apparatus as claimed in claim 35, wherein the atmospheric communication port opening and closing means is formed at a height different from that of a tip part of the connection suction passage connected to said sub-tank unit, and wherein one of the first to third states is selected as the slide plate is moved up and down.

38. The ink jet recording apparatus as claimed in claim 37, wherein the atmospheric communication port opening and closing means is a press member provided to elastically move a closing member formed movably up and down with respect to the slide plate.

39. The ink jet recording apparatus as claimed in claim 37 or 36, wherein the atmospheric communication port in said sub-tank unit is formed with a valve body that is movable up and down, that opens the atmospheric communication port at an upward position and that closes the atmospheric communication port when the valve body is moved down, and wherein the valve body is moved down by the atmospheric communication port opening and closing means provided in a lower end part of the slide plate to closing the atmospheric communication port.

40. The ink jet recording apparatus as claimed in claim 1 or 26, further including valve units for enabling the ink to flow in a state in which said sub-tank unit and said ink replenishment unit are connected, and automatically closing connection parts of said sub-tank unit and said ink replenishment unit in a state in which they are disconnected.

41. The ink jet recording apparatus as claimed in claim 40, wherein one of the valve units is disposed in an ink supply area positioned above a movement path of the carriage, and the other valve unit is mounted on the carriage, and wherein the sub-tank unit and the ink replenishment unit can be connected to each other by the two valve units in a state in which the carriage is positioned in the ink supply area.

42. The ink jet recording apparatus as claimed in claim 40 or 41, wherein each of the valve units includes a push rod disposed in a cylindrical case and urged in a projection direction, and a seal member made of a flexible material for closing the ink supply passage in a projected state of the push rod, and wherein movement of the pushing rods caused due to connection between the sub-tank unit and the ink replenishment unit makes flow of ink enabled.

43. The ink jet recording apparatus as claimed in claim 40, wherein a taper part is formed partially on at least one of the push rods of the valve units, and the taper part abuts the seal member in the projected state of the push rod.

44. The ink jet recording apparatus as claimed in any of claims 40 to 43, wherein the push rod in the cylindrical case is supported slidably in an axial direction by at least three fins projecting toward an axis center of the cylindrical case.

45. The ink jet recording apparatus as claimed in any of claims 40 to 44, wherein at least one of the seal members of the valve units is extended to a joint face of the cylindrical case.

46. The ink jet recording apparatus as claimed in claim 45, wherein the seal member is arranged on a joint face of at least one of the valve units, and after sealing isolating from outside air is established with the seal member arranged on the connection end face, the push rod is moved to forming an ink flow.

47. The ink jet recording apparatus as claimed in claim 1 or 26, wherein an air introduction port is closed in a state in which power is off.

48. The ink jet recording apparatus as claimed in claim 1 or 26, wherein an ink supply passage and an air introduction port are closed in a state in which power is off.

49. The ink jet recording apparatus as claimed in claim 1 or 26, wherein an air introduction port is opened if the pressure difference between said sub-tank unit and outside air exceeds a given value in a state in which power is off.

50. The ink jet recording apparatus as claimed in claim 49, wherein an ink supply valve is maintained closed even in a state in which the air introduction port is opened.

51. The ink jet recording apparatus as claimed in claim 1 or 26, wherein an air introduction port is opened prior to an ink supply port if the pressure difference between said sub-tank unit and outside air exceeds a given value in a state in which power is off.

52. The ink jet recording apparatus as claimed in claim 51, wherein an ink supply valve is maintained closed.

53. An ink jet recording apparatus comprising:

a sub-tank unit provided with a record head; and a main tank capable of replenishing said sub-tank unit with ink, wherein an ink storage chamber and the record head of said sub-tank unit are connected through backflow prevention means for enabling ink to flow into the record head from the ink storage chamber, and wherein an ink replenishment unit for replenishing said sub-tank unit with ink from the main tank by reducing pressure in the ink storage chamber by negative pressure generation means is provided.

54. The ink jet recording apparatus as claimed in claim 53, wherein a carriage to which said sub-tank unit is attached is moved to a record area, an ink replenishment area, and a recovery position for recovering an ink droplet ejection capability.

55. The ink jet recording apparatus as claimed in claim 54, wherein the ink replenishment area and the recovery position are the same area.

56. The ink jet recording apparatus as claimed in claim 54, wherein the ink replenishment area is more distant from the record area than the recovery position.

57. The ink jet recording apparatus as claimed in claim 54 or 55, wherein said sub-tank unit is allowed to communicate with said main tank in the ink replenishment area and at the recovery position.

58. An ink jet recording apparatus as claimed in any of claim 1, 26, or 53, wherein first and second connection parts for forming an ink flow passage between said sub-tank unit and the main tank are arranged in a conduit, and wherein first and second ink seal means opened if the first and second connection parts are connected to each other are provided.

59. The ink jet recording apparatus as claimed in claim 58, wherein the first ink seal means is designed so that a hollow ink flow passage member is slidably inserted into a first seal hole of a first seal body, and that an ink small hole opened in the ink flow passage member is exposed from the first seal body to open the ink flow passage only when the first connection part is connected to the second connection part.

60. The ink jet recording apparatus as claimed in claim 59, wherein when the first and second connection parts are connected, the shaft part of the slide shaft is urged by the ink flow passage member to open the ink flow passage.

61. The ink jet recording apparatus as claimed in claim 60, wherein the ink flow passage member is formed with a conical convex part, and the shaft part of the slide shaft is formed with a conical concave part engaging the conical convex part.

62. The ink jet recording apparatus as claimed in claim 58, wherein the second ink seal means includes a second seal body and a slide shaft having a shaft part inserted slidably into a second seal hole of the second seal body, and the shaft part is projected from the second seal hole to open the ink flow passage only when the second connection part is connected to the first connection part.

63. The ink jet recording apparatus as claimed in any of claim 1, 26, or 53, further comprising pressure detection means, arranged in a flow passage from for communication from said sub-tank unit to the negative pressure generation means, for detecting a predetermined or more pressure drop, wherein ink replenishment completion is detected based on a signal of the pressure detection means.

64. The ink jet recording apparatus as claimed in any of claim 1, 26, or 53, further comprising pressure detection means connected to a flow passage between the main tank and said sub-tank unit, for generating electric output upon detection of a predetermined or more pressure drop in the flow passage, wherein an attachment state of the main tank is detected based on the electric output of the pressure detection means.

65. The ink jet recording apparatus as claimed in claim 63 or 64, wherein the pressure detection means includes a flexible displacement member that forms a part of the flow passage and that is displaceable in association with pressure change in the flow passage, a spring member, added to the displacement member, for urging the displacement member in a direction opposite to a direction in which the displacement member is displaced in association with the pressure drop in the flow passage, and displacement detection means for detecting displacement of the displacement member.

66. A sub-tank unit for an ink jet recording apparatus, adapted to be mounted on a carriage, to be connectable to and disconnectable from a main tank installed in a housing side by a conduit, to receive ink supplied from an ink replenishment unit in an ink storage chamber and to supply ink to an ink jet record head, said sub-tank unit comprising:

an ink injection port and an exhaust port communicating with an ink storage chamber through self-seal type valve means, and a valve mechanism for opening and closing the ink injection port or the exhaust port based on a liquid level of ink, wherein said sub-tank unit receives supply of negative pressure in the exhaust port, to thereby receive supply of ink in the ink storage chamber.

67. The sub-tank unit for an ink jet recording apparatus as claimed in claim 66, further comprising a float that stops ink replenishment at a stage at which the ink storage chamber is replenished with the ink up to a predetermined value of ink amount.

68. The sub-tank unit for an ink jet recording apparatus as claimed in claim 67, wherein at least a part of the float is formed of an electric conductive material, and a move-up of the float is detected electrically.

69. The sub-tank unit for an ink jet recording apparatus as claimed in claim 68, wherein the ink storage chamber and the record head are communicated with each other through backflow prevention means for enabling the ink to flow into the record head from the ink storage chamber.

70. A sub-tank unit for an ink jet recording apparatus, adapted to be mounted on a carriage, to be connectable to and disconnectable from a main tank installed in a housing side by a conduit, to receive ink supplied from an ink replenishment unit in an ink storage chamber and to supply ink to an ink jet record head, said sub-tank unit comprising:

ink flow passage means for guiding the ink supplied from the main tank into the ink storage chamber, and negative pressure generation means for supplying the ink to the record head, wherein the ink flow passage means and the negative pressure generation means are located in the ink storage chamber, wherein an ink flow-out port of said ink flow passage means and an ink flow-in port of said negative pressure generation means are arranged to face each other through such a gap as to allow air bubbles to be moved upward.

71. An ink droplet ejection capability recovery method for a recording head of an ink jet recording apparatus comprising a sub-tank unit provided with a record head and a main tank capable of replenishing the sub-tank unit with ink, the method comprising:

determining if an ink remaining amount in the sub-tank unit is greater than a recovery operation consumption amount, replenishing the sub-tank unit with the ink from the main tank when it is determined that the ink remaining amount in the sub-tank unit is less than or equal to the recovery operation consumption amount, and performing a recovery operation after the replenishing step is complete.

72. The ink droplet ejection capability recovery method as claimed in claim 71, wherein after the ink is previously discharged from the sub-tank unit, the sub-tank unit is replenished with the ink from the main tank and then the recovery operation is carried out.

73. The ink droplet ejection capability recovery method as claimed in claim 71, wherein an ink consumption state in the sub-tank unit is detected, and the recovery operation is carried out at least once or more as long as ink exists.

* * * * *

UNITED STATES PATENT AND TRADEMARK OFFICE

CERTIFICATE OF CORRECTION

PATENT NO. : 6,390,611 B1 
DATED : May 21, 2002
INVENTOR(S) : Atsushi Kobayashi et al.

It is certified that error appears in the above-identified patent and that said Letters Patent is hereby corrected as shown below:

Title page,
Item [75], the first named inventor reading "Atushi Kobayashi" should read
-- Atsushi Kobayashi --.

Signed and Sealed this

Nineteenth Day of August, 2003

JAMES E. ROGAN
*Director of the United States Patent and Trademark Office*